US008356674B2

(12) United States Patent
Murray et al.

(10) Patent No.: US 8,356,674 B2
(45) Date of Patent: Jan. 22, 2013

(54) TUBULAR RUNNING TOOL AND METHODS OF USE

(75) Inventors: Richard Lee Murray, Foothill Ranch, CA (US); Pieter Dekker, Baarland (NL); Keith Mitchell Wien, Irvine, CA (US); Neils De Keijzer, Etten-Leur (NL); Antonius Dimphena Maria Krijnen, Klundert (NL); Rene Mulder, Etten-Leur (NL); Johannes Wilhelmus Henricus Van Rijzingen, Oosterhout (NL); David Cardellini, Spring, TX (US); David Brian Mason, Anaheim, CA (US)

(73) Assignee: National Oilwell Varco, L.P., Houston, TX (US)

( * ) Notice: Subject to any disclaimer, the term of this patent is extended or adjusted under 35 U.S.C. 154(b) by 602 days.

(21) Appl. No.: 12/595,724

(22) PCT Filed: Apr. 26, 2008

(86) PCT No.: PCT/US2008/005404

§ 371 (c)(1), (2), (4) Date: Nov. 30, 2009

(87) PCT Pub. No.: WO2008/127740

PCT Pub. Date: Oct. 23, 2008

(65) Prior Publication Data

US 2010/0193198 A1 Aug. 5, 2010

Related U.S. Application Data

(63) Continuation-in-part of application No. 11/414,515, filed on Apr. 28, 2006.

(60) Provisional application No. 60/926,679, filed on Apr. 28, 2007.

(30) Foreign Application Priority Data

Apr. 13, 2007 (EP) ..... GB2007/050192

(51) Int. Cl.
*E21B 19/16* (2006.01)

(52) U.S. Cl. ..... 166/380; 166/77.51

(58) Field of Classification Search ..... 166/380, 166/379, 77.1, 77.51, 85.1, 85.5, 75.14
See application file for complete search history.

(56) References Cited

U.S. PATENT DOCUMENTS

| | | | | |
|---|---|---|---|---|
| 3,915,244 | A | 10/1975 | Brown | 175/85 |
| 4,126,348 | A | 11/1978 | Palmer | 294/88 |
| 4,458,768 | A | 7/1984 | Boyadjieff | 175/85 |
| 4,878,546 | A | 11/1989 | Shaw et al. | 173/163 |
| 5,577,566 | A | 11/1996 | Albright et al. | 175/321 |
| 5,755,289 | A | 5/1998 | Angman et al. | 166/378 |
| 6,073,699 | A | 6/2000 | Hollingsworth, Jr. | 166/379 |
| 6,276,450 | B1 * | 8/2001 | Seneviratne | 166/85.1 |
| 6,315,051 | B1 | 11/2001 | Ayling | 166/380 |

(Continued)

*Primary Examiner* — Daniel P Stephenson
(74) *Attorney, Agent, or Firm* — Williams, Morgan & Amerson, P.C.

(57) ABSTRACT

Generally, the present disclosure is directed to wellbore tubular running systems and methods of their use. In one illustrative embodiment, a tubular running system is disclosed that includes, among other things, a torque frame, a main shaft extending through a top opening of the torque frame and rotatable by rotation apparatus, slip setting apparatus connected to the torque frame and including a levelling beam and a plurality of slip assemblies, each of the slip assemblies connected independently and pivotably to the levelling beam, and movement apparatus connected to the levelling beam for moving the slip assemblies in unison with respect to a tubular projecting into the torque frame.

33 Claims, 70 Drawing Sheets

U.S. PATENT DOCUMENTS

| | | | | |
|---|---|---|---|---|
| 6,443,241 | B1 | 9/2002 | Juhasz et al. | 175/52 |
| 6,494,273 | B1 | 12/2002 | Martin | 175/220 |
| 6,527,493 | B1 | 3/2003 | Kamphorst et al. | 414/22.57 |
| 6,581,692 | B1 * | 6/2003 | Koch et al. | 166/380 |
| 6,588,509 | B2 | 7/2003 | Allyn et al. | 166/340 |
| 6,591,916 | B1 | 7/2003 | Ayling | 166/380 |
| 6,637,526 | B2 | 10/2003 | Juhasz et al. | 175/52 |
| 6,688,394 | B1 | 2/2004 | Ayling | 166/380 |
| 6,691,801 | B2 | 2/2004 | Juhasz et al. | 175/27 |
| 6,779,599 | B2 | 8/2004 | Mullins et al. | 166/90.1 |
| 6,920,926 | B2 | 7/2005 | York et al. | 166/77.1 |
| 7,013,759 | B1 | 3/2006 | Childress, II | 81/57.34 |
| 7,140,443 | B2 * | 11/2006 | Beierbach et al. | 166/380 |
| 2005/0098352 | A1 | 5/2005 | Beierbach et al. | 175/57 |
| 2006/0000600 | A1 * | 1/2006 | Pietras | 166/77.52 |
| 2006/0249292 | A1 | 11/2006 | Guidry | 166/380 |
| 2007/0251700 | A1 * | 11/2007 | Mason et al. | 166/379 |
| 2010/0108330 | A1 * | 5/2010 | Shahin et al. | 166/382 |
| 2011/0232919 | A1 * | 9/2011 | Snider et al. | 166/380 |

* cited by examiner

650

DL1
DJ1
X1
PCX
I
X2
SVX
CVX
FLP
FLX
XP
II
SJ ELEVATOR OPEN
OPEN
A
B
P
T
SVT3
FC13
ELEVATOR CLOSED FEEDBACK

500

500

TUBULAR RUNNING TOOL AND METHODS OF USE

CROSS-REFERENCE TO RELATED APPLICATIONS

The present invention and this application claim priority under the Patent laws from and under: U.S. application Ser. No. 11/414,511 filed Apr. 28, 2006 and 60/926,679 filed Apr. 28, 2007 and PCT International Application PCT/GB2007/050192, International fining date 13 Apr. 2007—all co-owned with the present invention, and all incorporated fully herein for all purposes. This application is a continuation-in-part of U.S. application Ser. No. 11/414,515 filed Apr. 28, 2006.

BACKGROUND OF THE INVENTION

1. Field of the Invention

This present invention is directed to, among other things, wellbore tubular running systems; tubular handling apparatus for such systems; casing running tools; and methods of their use.

2. Description of Related Art

The prior art discloses a wide variety of wellbore tubular running systems, including, but not limited to, those disclosed in U.S. Pat. Nos. 6,443,241; 6,637,526; 6,691,801; 6,688,394; 6,779,599; 3,915,244; 6,588,509; 5,577,566; 6,315,051; and 6,591,916; and in U.S. Applications Pub. Nos. 2005/0098352, May 12, 2005; and 2006/0249292, Nov. 29, 2006—all said patents and applications incorporated fully herein for all purposes.

The prior art discloses a variety of tubular handling apparatuses, including but not limited to, those disclosed in U.S. Pat. Nos. 6,527,493; 6,920,926; 4,878,546; 4,126,348; 4,458,768; 6,494,273; 6,073,699; 5,755,289; and 7,013,759, all incorporated fully herein for all purposes.

Certain prior tubular running systems and methods using them require controlled manipulation of a tubular through a rig V-door area using rope(s) and/or a tailing arm; stabbing board operations and other necessary manual handling of tubulars; the use of power tongs for certain functions; a relatively large number of personnel with associated expenses and stand-by costs; and a separate single joint elevator to be mated with a running tool system.

BRIEF SUMMARY OF THE PRESENT INVENTION

The present invention discloses, in certain aspects, a tubular running system with a novel slip system in which each of a plurality of slip segments are individually and independently connected to a level beam. The slip segments move up and down without tangential movement and apply equal loads to a tubular. In one aspect, the level beam is located above and outside of a slip body that houses the slip segments.

The present invention discloses, in certain aspects, a tubular running system with an instrumented sub adjacent a running tool. The instrumented sub has instrumentation that interfaces with the running tool and which provides measurement of the rate of rotation (rpm's) of the running tool and a measurement of the torque applied to a connection by the running tool.

The present invention discloses, in certain aspects, a casing running system for both running casing and cementing the casing.

The present invention discloses, in certain aspects, a tubular running system with a dedicated control loop and, in one aspect, a dedicated control panel for accomplishing a variety of functions (e.g. link tilt movement, elevator clamping, tool rotation, safety interrupts).

The present invention discloses, in certain aspects, a tubular running system with hydraulic control circuits for performing a variety of functions, with hydraulic controls; or a computerized system in which the functions are automated and are effected electrically.

The present invention discloses, in certain aspects, a tubular running system with an integrated swivel assembly which can hold a link tilt apparatus static while the system is holding or rotating a tubular. In certain aspects, the system swivel assembly provides terminal location for field service loops, in certain aspects eliminating the need for such connections with a top drive.

The present invention discloses, in certain aspects, a tubular running system which includes: a tubular running tool (e.g., but not limited to, a casing running tool and a pipe running tool); a drive system (e.g. a rotary drive system, a power swivel system or a top drive system); and a joint handling system connected between the running tool and the top drive system. In certain particular aspects the joint handling system is a single joint system located between a running tool and a top drive. In other aspects, multiples (e.g. doubles or triples of tubulars) are handled.

In certain particular aspects, the single joint handling system has two spaced-apart extensible arms between whose ends are pivotably connected to an elevator for releasably engaging a tubular. In one aspect the arms are moved toward and away from the running tool by mechanical apparatus, e.g., but not limited to, by a rotary actuator. In other aspects, one, two, or more cylinder apparatus connected at one end to the extensible arms and at the other end to the running tool or to a mount body moves) the arms toward and away from the running tool.

Certain prior art running tool systems employ a relatively long lower stabbing guide to assist in the acquisition and positioning of a tubular. Certain of such guides use a relatively wide, relatively long skirt section for guiding a tubular with respect to the running tool. With certain embodiments of the present invention, the single joint handling system pulls a tubular coupling up to or into a running tool so that a relatively short, smaller stabbing section or bell can be used which results in a shorter overall system length. A compensator associated with the running tool can be used to facilitate the introduction ("soft stab") of a pin/male tubular end into a box/female tubular end.

In one aspect, after the single joint handling system elevator is connected to a tubular, the traveling equipment is raised until the tubular stand is in a vertical position under the running tool. The extensible arms are then extended to lower and "soft stab" the tubular stand into a tubular coupling of the tubular string, e.g. a string held in the slips at a rig floor rotary table.

Accordingly, the present invention includes features and advantages which are believed to enable it to advance tubular running tool technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, there are other objects and purposes which will be readily apparent to one of skill in this art who has the benefit of this invention's teachings and disclosures.

It is, therefore, an object of at least certain preferred embodiments of the present invention to provide new, useful, unique, efficient, nonobvious systems and methods, including, but not limited to, casing running tools, single joint handling systems, tubular running systems, and methods of their use.

The present invention recognizes and addresses the problems and needs in, this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

Figure 1A:
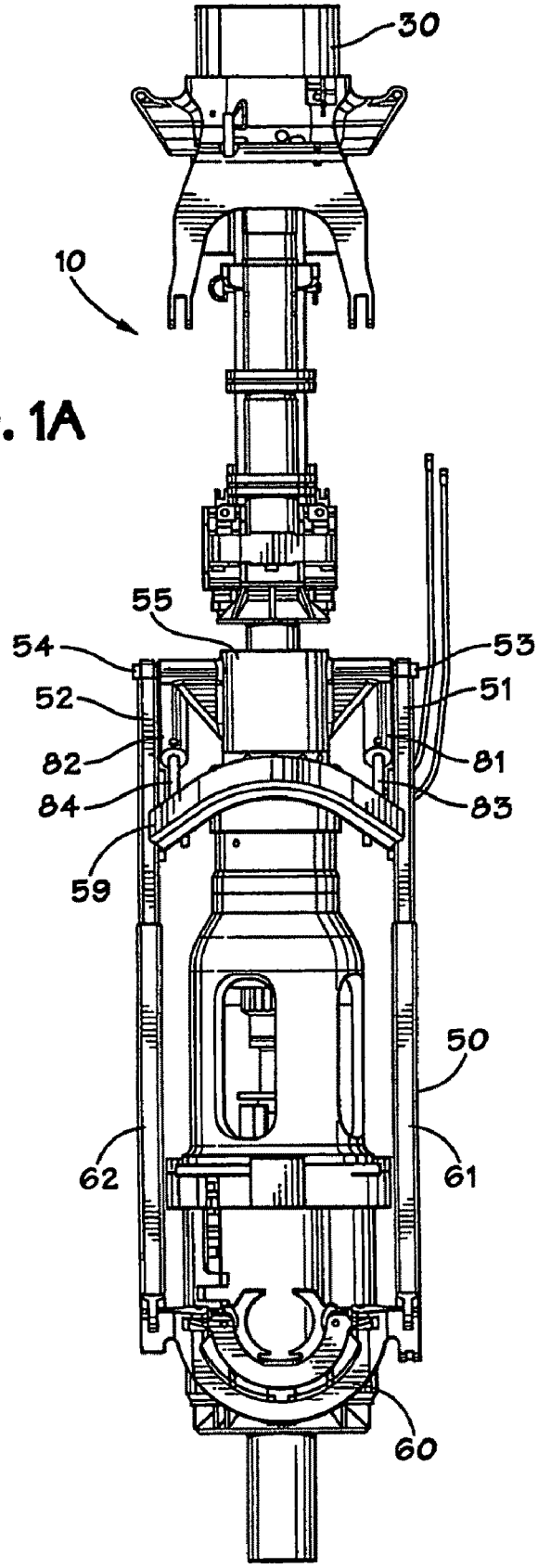
FIG. 1A is a front view of a tubular running system according to the present invention with a single joint handling system according to the present invention.
Figure 1B:
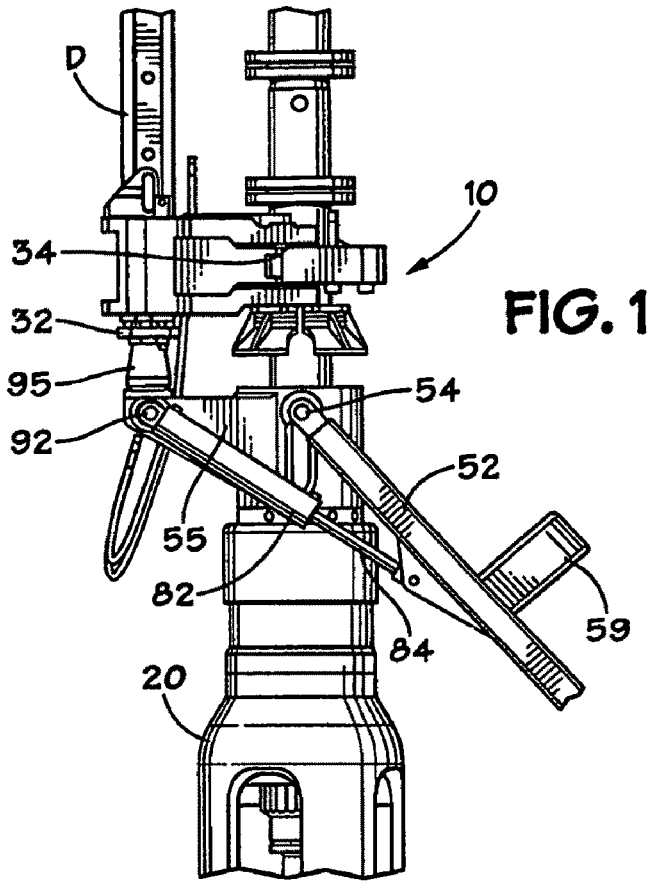
FIG. 1B is a side view of a systems of FIG. 1A.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

This is a description of embodiments of the present invention preferred at the time of filing for this patent.

FIGS. 1A-1D show a system 10 according to the present invention which includes a tubular running tool system 20; a drive system 30 (shown schematically, FIGS. 1A, 1D; e.g., but not limited to, a top drive system); and a single joint handling system 50 according to the present invention. The tubular running system 20 may be any suitable known tubular running tool apparatus and, in one particular aspect, is a casing running tool system, e.g., but not limited to, a known casing running tool Model CRT 14 as is commercially available from National Oilwell Varco, owner of the present invention. In one particular aspect, the system 20 is a system according to the present invention (any disclosed herein).

The drive system 30 (as is true for any system according to the present invention disclosed herein) can be any suitable known top drive system or power swivel system that can rotate tubulars which is connectible to a derrick D. Optionally a drive system is used with an upper IBOP U and a lower IBOP L. In one aspect the drive system is a National Oilwell Varco TDS 11 500 ton system.

The single joint handling system 50 has a base 53 with two spaced-apart beams 51, 52 connected by a crossmember 54. Each beam 51, 52 is pivotably connected to a corresponding shaft 53, 54 (which may be a single unitary shaft through the mount body) projecting from a mount body (or "swivel assembly") 55. Arms 61, 62 are extensibly mounted on the beams 51, 52, respectively. Cylinder/piston apparatuses 56 (shown schematically) within the beams and arms (and connected thereto) move the arms 61, 62 with respect to the beams 51, 52. Hoses 57, 58 provide power fluid to the cylinder/piston apparatuses 56 (e.g. from a typical power fluid source on a rig). A single joint elevator 60 is pivotably connected to ends 71, 72 of the arms 61, 62. Any suitable known elevator may be used. In one particular aspect, the elevator is a Model SJH commercially available from National Oilwell Varco. According to the present invention, such an elevator is modified to be remotely-operable with a closed feedback system. In one aspect a tilt system 70 provides selective controlled tilting of the elevator 60. The tilt system 70 has a piston-cylinder apparatus 73 interconnected between the arm 61 and a body 65 of the elevator 60. A line 66 connects the system 70 to a control system CS (shown schematically, FIG. 1E), e.g., a rig control system, a TRS (trademark) system, a top drive control system (e.g., but not limited to, a known National Oilwell Varco Driller's Control Station, or a stand alone driller's control system and station that is temporarily or permanently installed on, with, or into an existing rig control system).

In one embodiment pivot cylinder apparatuses 81, 82 are connected between the mount body 55 and the beams 51, 52. Hoses 57, 58 provide power fluid (e.g. from a rig power source PS, shown schematically, FIG. 1D) to the cylinder apparatuses 56 and 81, 82. Each cylinder apparatus 81, 82 has one end connected to a shaft 91, 92, respectively, projecting from the mount body 55 and an end of a piston 83, 84, respectively, connected to one of the beams 51, 52. Extension and retraction of the pistons 83, 84 results in movement of the arms 61, 62 with respect to the running system 20. Optionally, the pivot cylinder apparatuses 81, 82 are connected to the system 20 or to structure above the system 20. Optionally, only one pivot cylinder apparatus is used.

A pin 95 projecting form the mount body 55 projects into a fixture 32 of the pipe handler 34, e.g. a torque tube of a pipe handler 34 to react torque generated by the tubular running system 20 into the fixture 32 (and to structure interconnected therewith) and to prevent rotation of the system 50 with the system 20. Optionally, as shown in FIG. 2E, a pin 96 (or multiple pins) extend from the mount body 55 into a stabbing bell 39 of the drive system 30 which prevent the system 50 from rotating with the system 20.

In certain aspects, a system 50 according to the present invention falls within a width envelope of a top drive system above it.

Figure 1E:
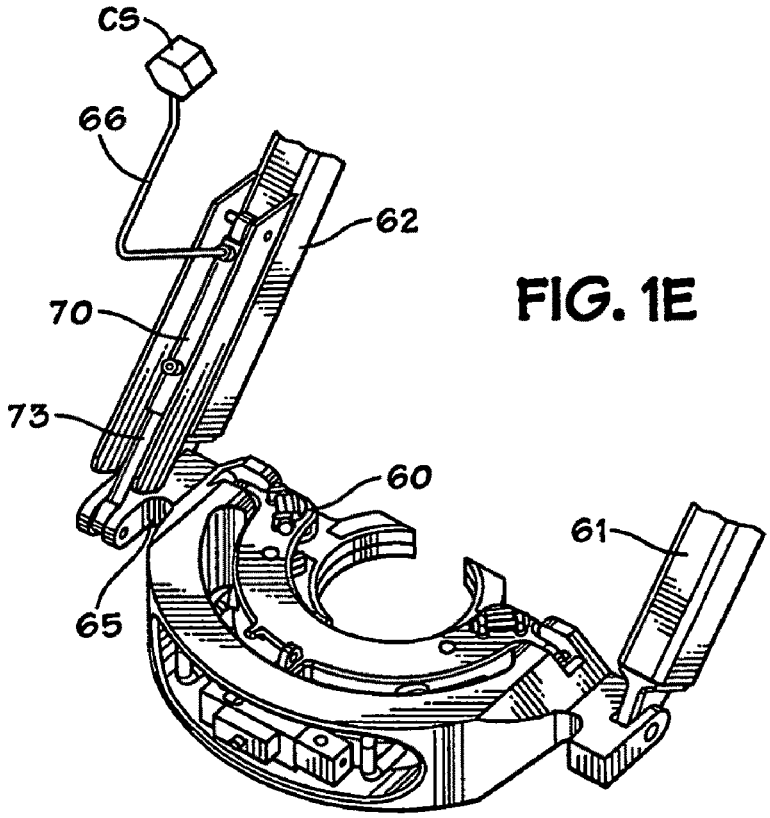
FIG. 1E is a partial perspective view of part of the single joint handling system of FIG. 1A.
Figure 1C:
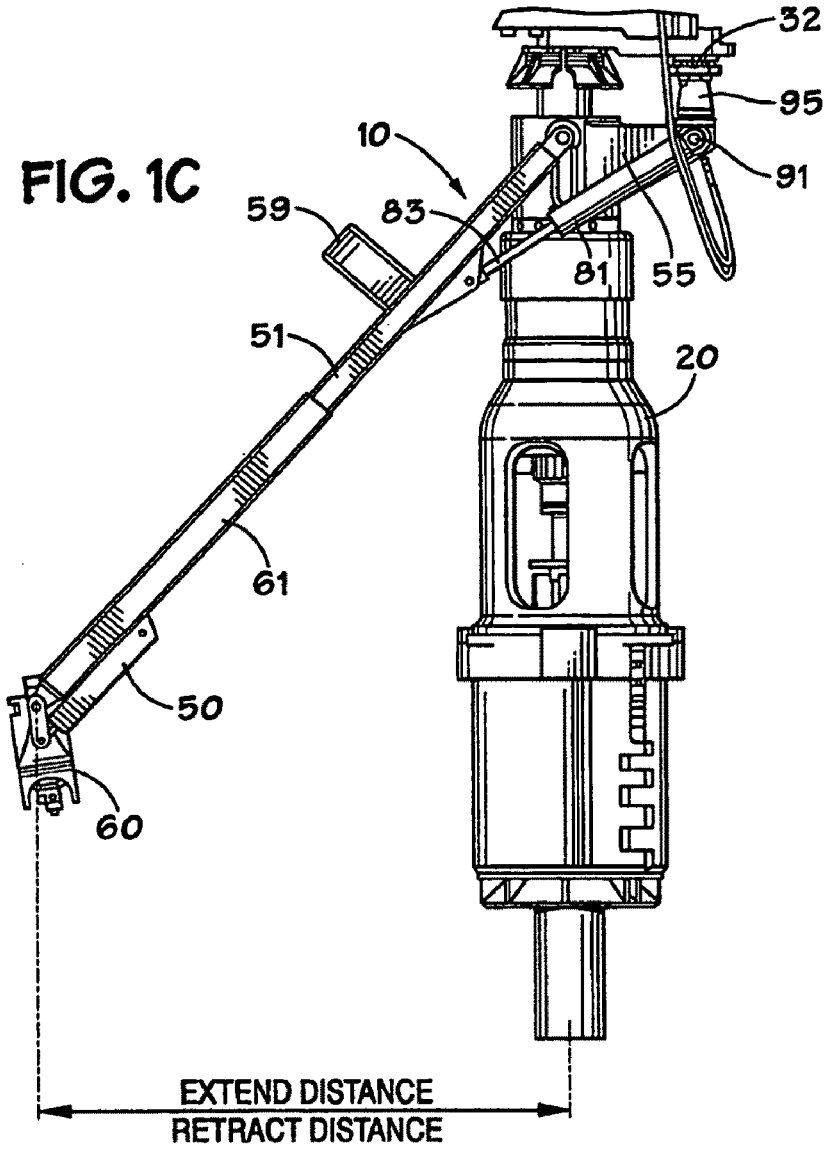
FIG. 1C is a side view of a systems of FIG. 1A.
Figure 1F:
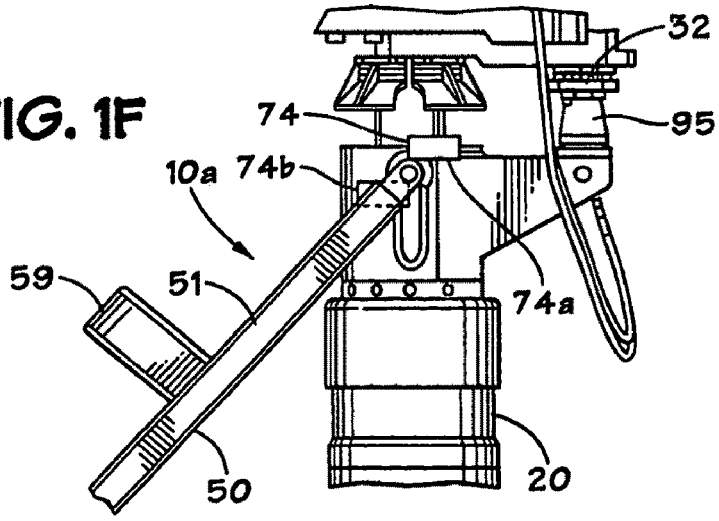
FIG. 1F is a side view of a system according to the present invention.
Figure 1D:
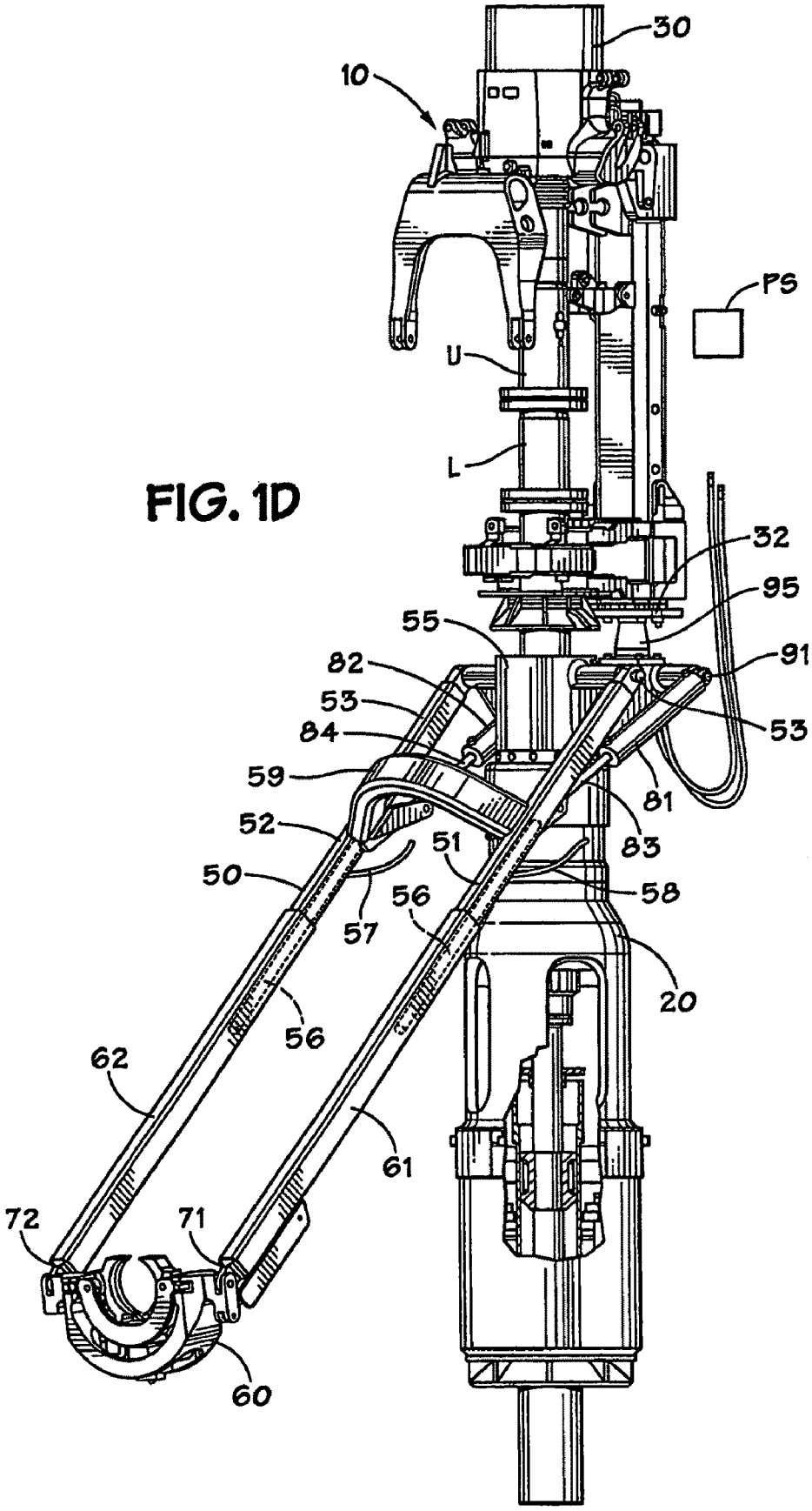
FIG. 1D is a perspective view of the system of FIG. 1A.
Figure 1G:
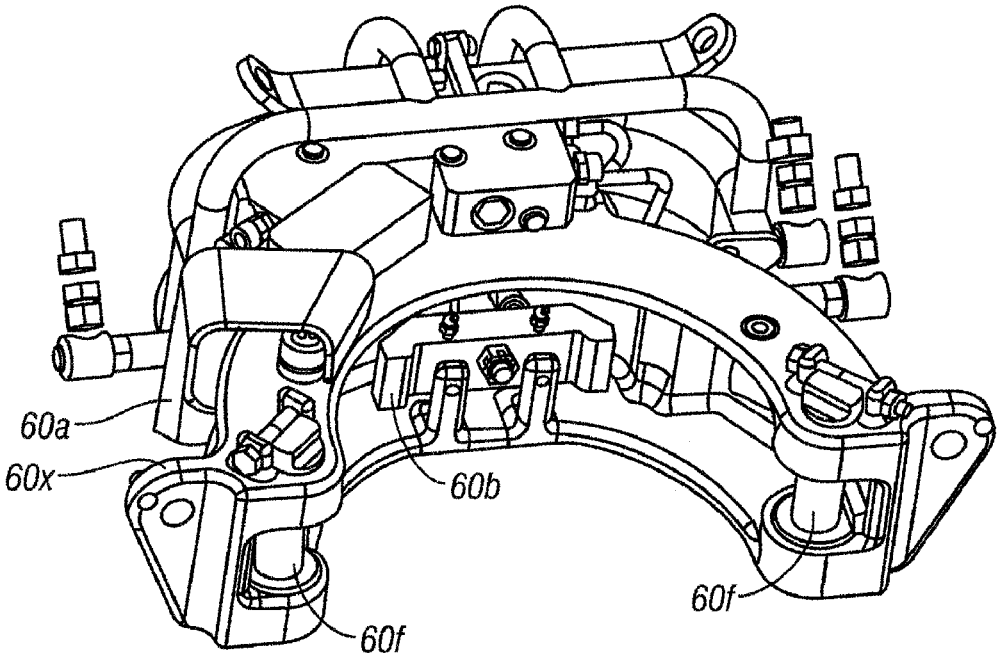
FIG. 1G (Prior Art)
FIG. 1G is a perspective view of a prior art elevator.

FIG. 1F shows another embodiment of a system 10*a*, like the system 10, and like numerals indicate like parts. The system 10*a* has no pivot cylinder apparatuses 81, 82. The beams 51, (one shown in FIG. 1F; as in FIG. 1A); connected arms (not shown; as in FIG. 1A); and elevator (not shown; as in FIG. 1A) are moved toward and away from the running tool system by a mechanical apparatus 74 that rotates the shaft 53*a* a single shaft extending through the mount body 55 to which both beams are connected. In one particular aspect the mechanical apparatus 74 is a rotary actuator apparatus with parts 74*a*, 74*b* interconnected with the shaft 53*a* (or two rotary actuator apparatuses if each beam is mounted to a separate shaft, e.g. shafts 53, 54).

Figure 2A:
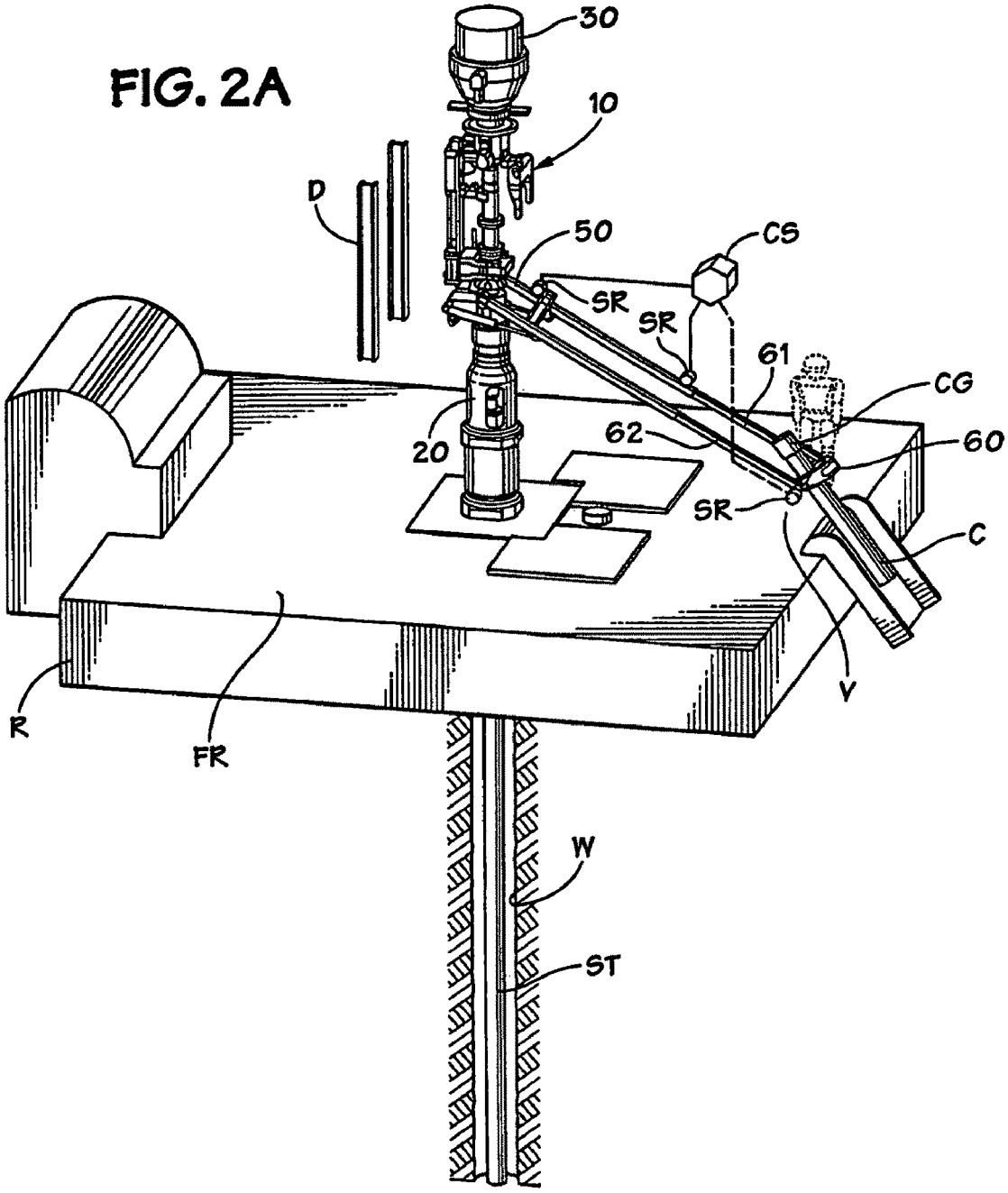
FIG. 2A is a schematic view of part of a method according to the present invention using systems according to the present invention.
Figure 2B:
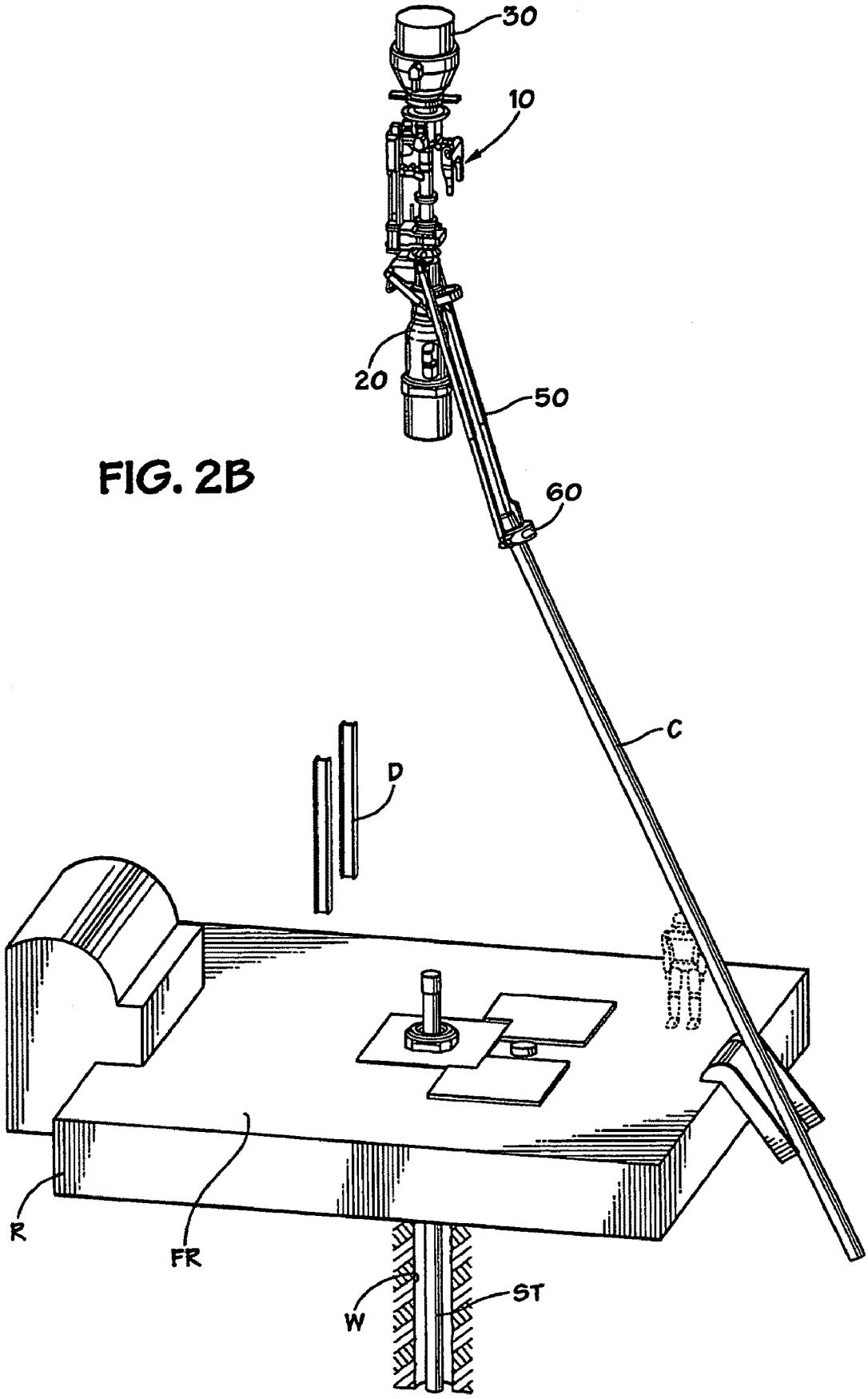
FIG. 2B is a schematic view of part of a method according to the present invention using systems according to the present invention.
Figure 2C:
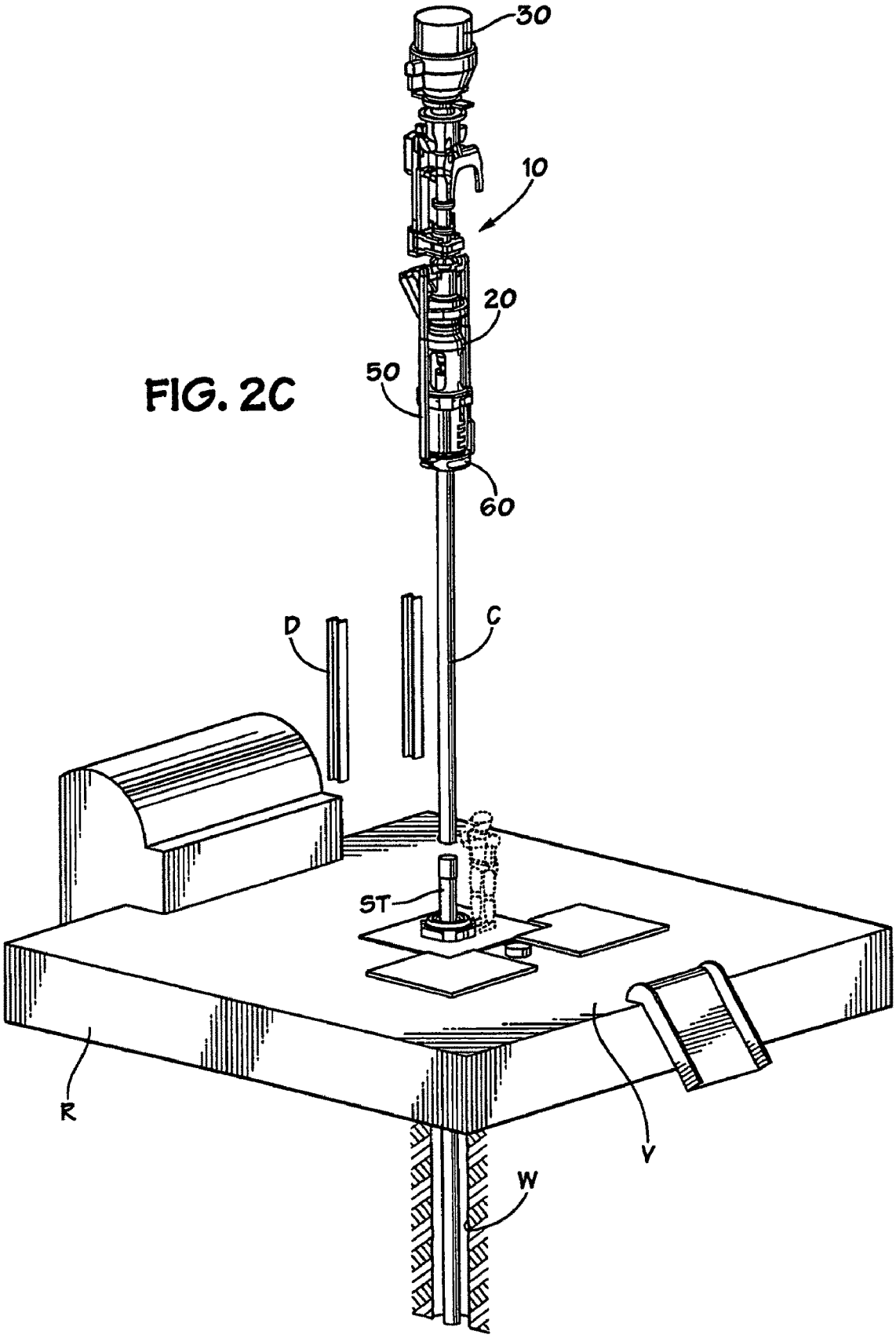
FIG. 2C is a schematic view of part of a method according to the present invention using systems according to the present invention.
Figure 2D:
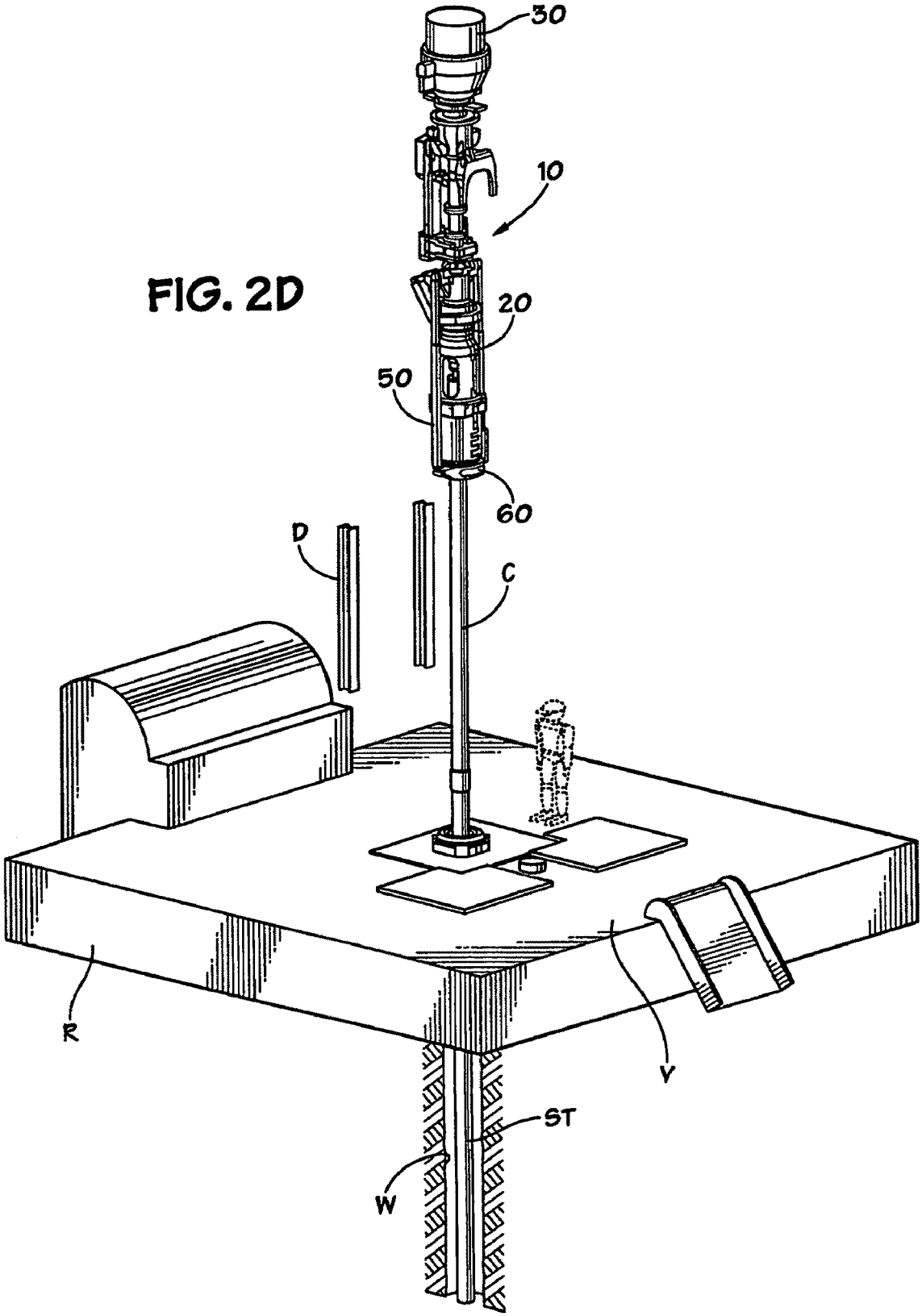
FIG. 2D is a schematic view of part of a method according to the present invention using systems according to the present invention.
Figure 2E:
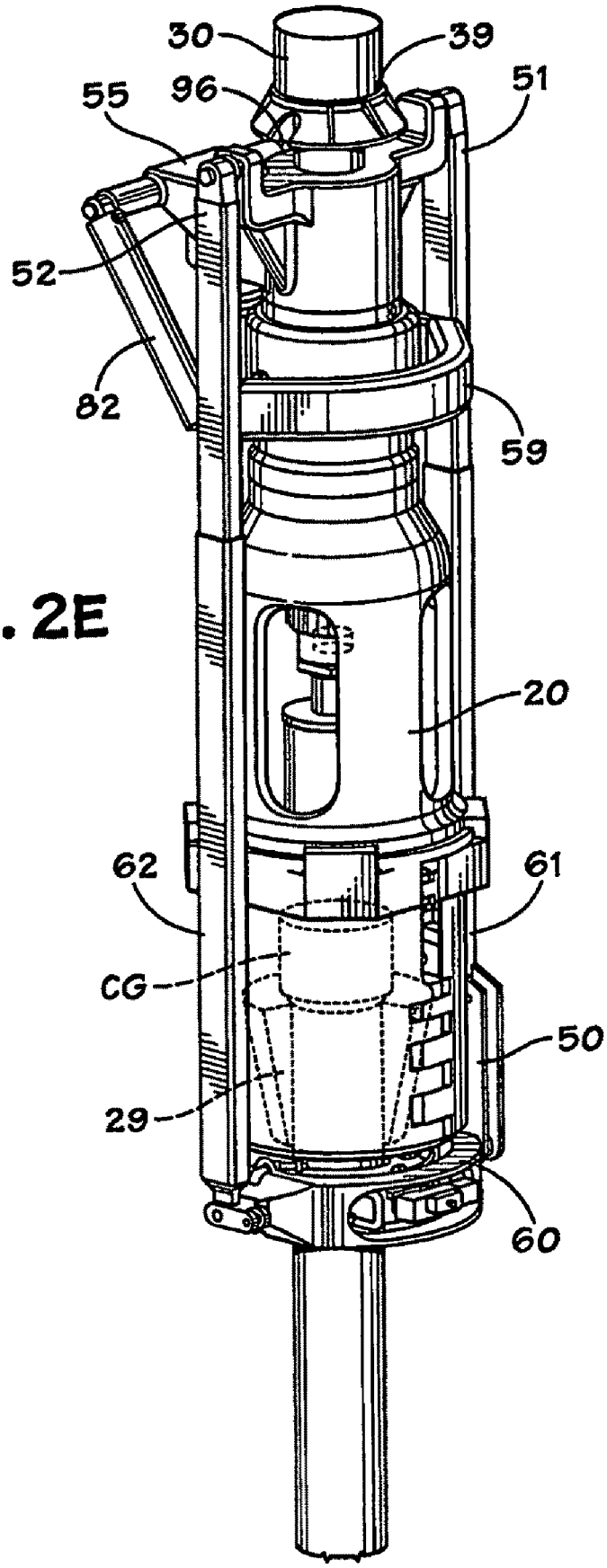
FIG. 2E is a schematic view of part of a method according to the present invention using systems according to the present invention.

FIGS. 2A-2E illustrate one method according to the present invention using a system 10 according to the present invention to move casing on a rig R (e.g. a typical drilling rig system) above a wellbore W. As shown in FIG. 2A the drive system 30 has been lowered and the arms 61, 62 have been extended toward a piece or joint of casing C in the V-door area V of the rig R having a rig floor FR. The elevator 60 is latched onto the piece or joint of casing C below a coupling CG of the casing C. Such a step is used in adding a joint of casing to a casing string either during the typical casing of an already-drilled bore or in a casing-drilling operations. Sensors SR (shown schematically) indicate to the control system CS the extent of extension of the arms 61, 62; the angle of the beams 51, 52 with respect to the system 20; and the latch status of the elevator 60.

As shown in FIG. 2B, the joint of casing C has been hoisted upwardly by raising the system 10 in the derrick. Optionally tailing rope(s) and/or tailing arms(s) are used to support the joint C during this movement. In one aspect no such rope(s) or arm(s) are used and the system 50 supports the joint C.

As shown in FIG. 2C, the joint of casing C has been moved over the wellbore W in line with a string ST of casing. The coupling CG has been pulled up within the running tool system 20 by the single joint handling system 50 by retracting the arms 61, 62.

FIG. 2D illustrates lowering of the joint of casing C down to the top joint of the casing string ST for threaded mating and connection therewith. The system 10 is then lowered so that the coupling CG is located within the running tool system 20 so that holding slips 29 within the system 20 can be set on the body of the casing joint C and not on the coupling (see FIG. 2E, coupling CG and slips 29 in dotted lines). The other systems described below have, in certain methods, similar operation steps.

The present invention, therefore, provides in some, but not in necessarily all, embodiments a tubular running system including: a running tool system for running wellbore tubulars; a tubular handling system connected to the running tool system; the tubular handling system having two arms comprising two spaced-apart extensible arms extendable in length and movable toward and away from the running tool system. Such a method may have one or some, in any possible combination, of the following: an elevator connected to the arms for releasably engaging a tubular to be moved with respect to the running tool system; the tubular handling system is a single joint handling system; a tubular to be handled by the tubular handling system is connected to at least one additional tubular; the tubular to be handled is connected to two additional tubulars; the tubular running system including engagement apparatus connected to the two arms for selectively engaging a tubular; wherein the two arms are sufficiently extensible and movable to move the tubular up to the running tool; wherein the wellbore tubulars are casing; a body positioned above the running tool system, and the two arms pivotably connected to the body; pivoting apparatus connected to the two arms for moving the two arms with respect to the running tool; wherein the two arms are connected to movable shaft apparatus on the body, the tubular running system further including the pivoting apparatus including rotation apparatus for rotating the movable shaft apparatus to move the two arms toward and away from the running tool system; pivoting apparatus having a first end and a second end, the first end pivotably connected to the body and spaced-apart from the two arms, and the second end pivotably connected to the two arms; a drive system connected to and above the running tool system; and/or wherein the drive system is a top drive system for wellbore operations.

The present invention, therefore, provides in some, but not in necessarily all, embodiments a method for running tubulars, the method including engaging a tubular with a joint engagement apparatus of a tubular running system as any disclosed herein with a running tool system according to the present invention; and moving the tubular to the running tool system with the joint handling system. Such a method may have one or some, in any possible combination, of the following: wherein the arms of the tubular running system are sufficiently extendable and movable to move the joint into the running tool system, and moving the joint into the running tool system; wherein the joint engagement apparatus is an elevator; wherein the tubular running system includes a body positioned above the running tool system, the two arms pivotably connected to the body, and pivoting the arms with respect to the running tool system; wherein the tubular running system further comprises a drive system connected to and above the running tool system; and/or wherein the drive system is a top drive system for wellbore operations.

Figure 3:
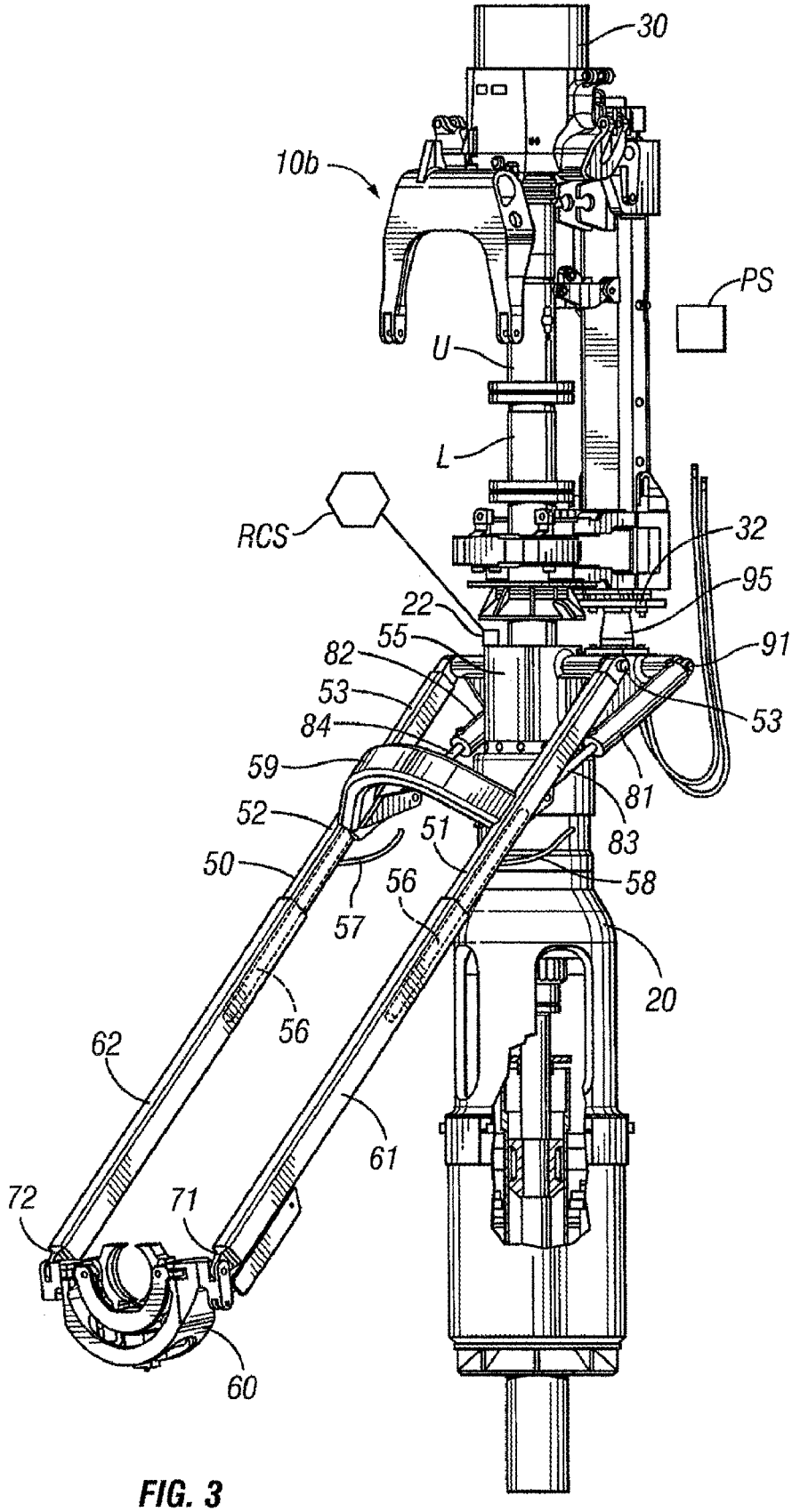
FIG. 3 is a side view of a system according to the present invention.

FIG. 3 shows a system 10*b* according to the present invention, (like the system 10, FIG. 1A, like numerals indicate like parts). The system 10*b* has a control system 22 which is in communication with the tubular running system 20 and with a rig control system RCS. The rig control system RCS may be any known rig control system including, but not limited to, the commercially available AMPHION (trademark) system of National Oilwell Varco.

The control system 22 includes control apparatus in communication with hydraulic lines, valves, and circuits for the joint handling system 50 and the running tool system 20. The control system 22 may be run by a driller from a console. Each function of the systems 20 and 50 can be accomplished using the control system 22. Also, all of these functions can be done automatically, e.g., in concert with an AMPHION (trademark) system or by the control system 22.

Figure 4:
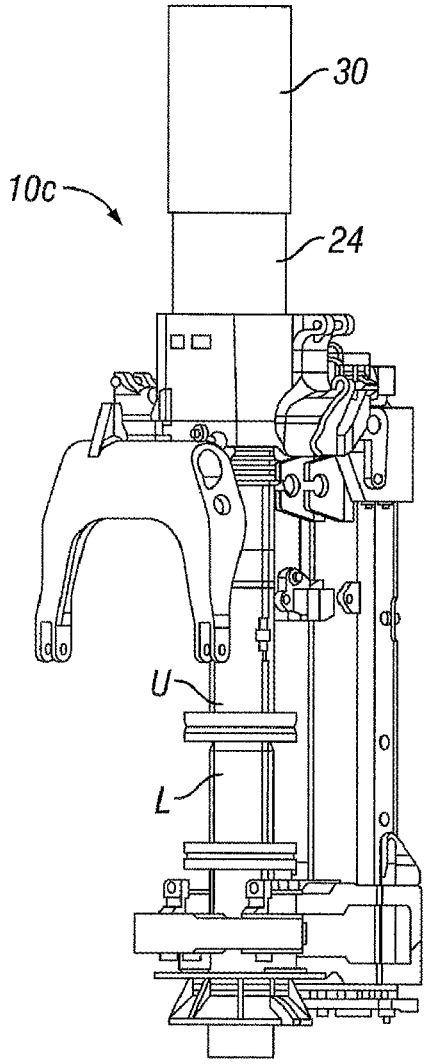
FIG. 4 is a side view of a system according to the present invention.

FIG. 4 shows a system 10*c* according to the present invention (like the system 10, FIG. 1A (like numerals indicate like parts). The system 10*c* has an instrumented sub 24 located above the running tool system 26 (e.g. like the running tool system 20, FIG. 1A or any known running tool system). The instrumented sub 24 measures the rotation of the running tool system 20 and provides a signal indicative of this rotation in revolutions per minute. The instrumented sub 24 measures the torque applied to a connection. The instrumented sub 24 is in communication with the control system and provides signals indicative of rotation speed and applied torque.

Figure 5:
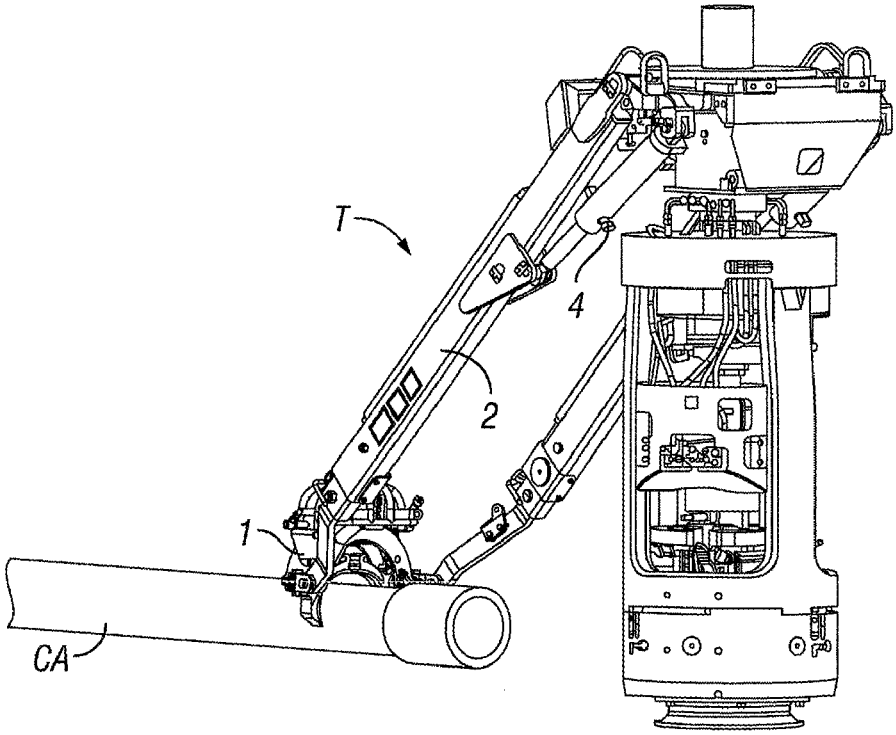
FIG. 5 is a perspective view of a system according to the present invention.
Figure 5A:
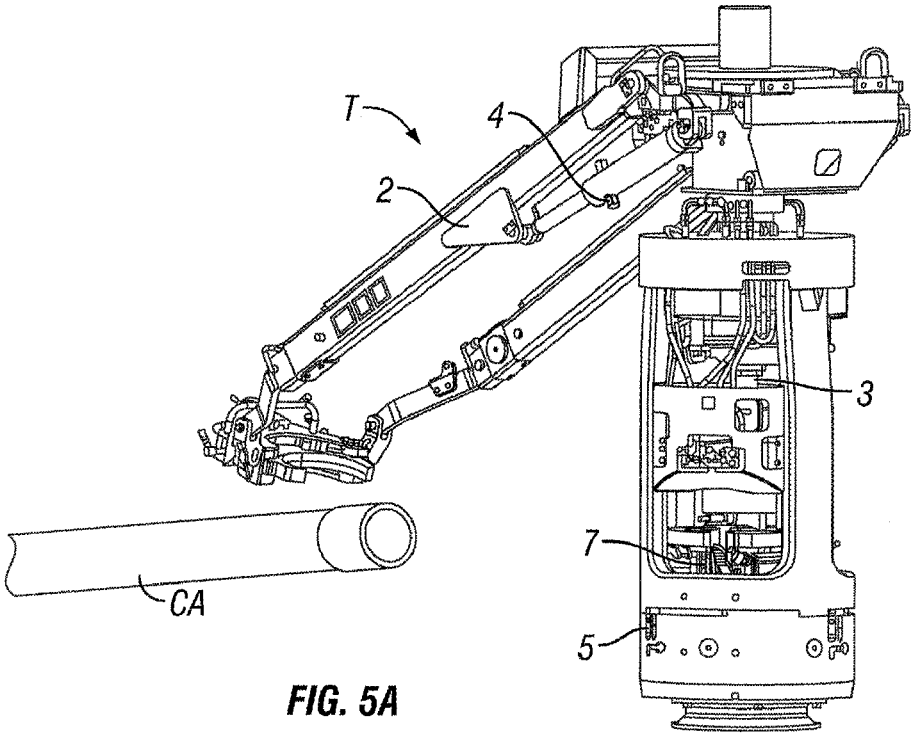
FIG. 5A is a perspective view of the system of FIG. 5.
Figure 5B:
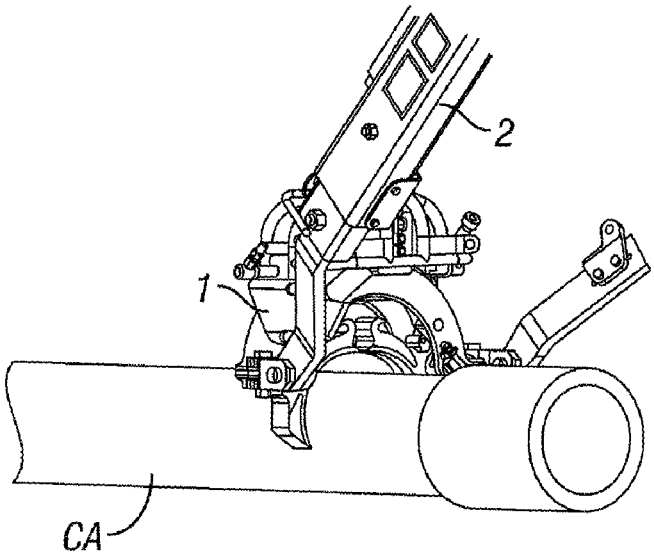
FIG. 5B is a perspective view of part of the system of FIG. 5.
Figure 5C:
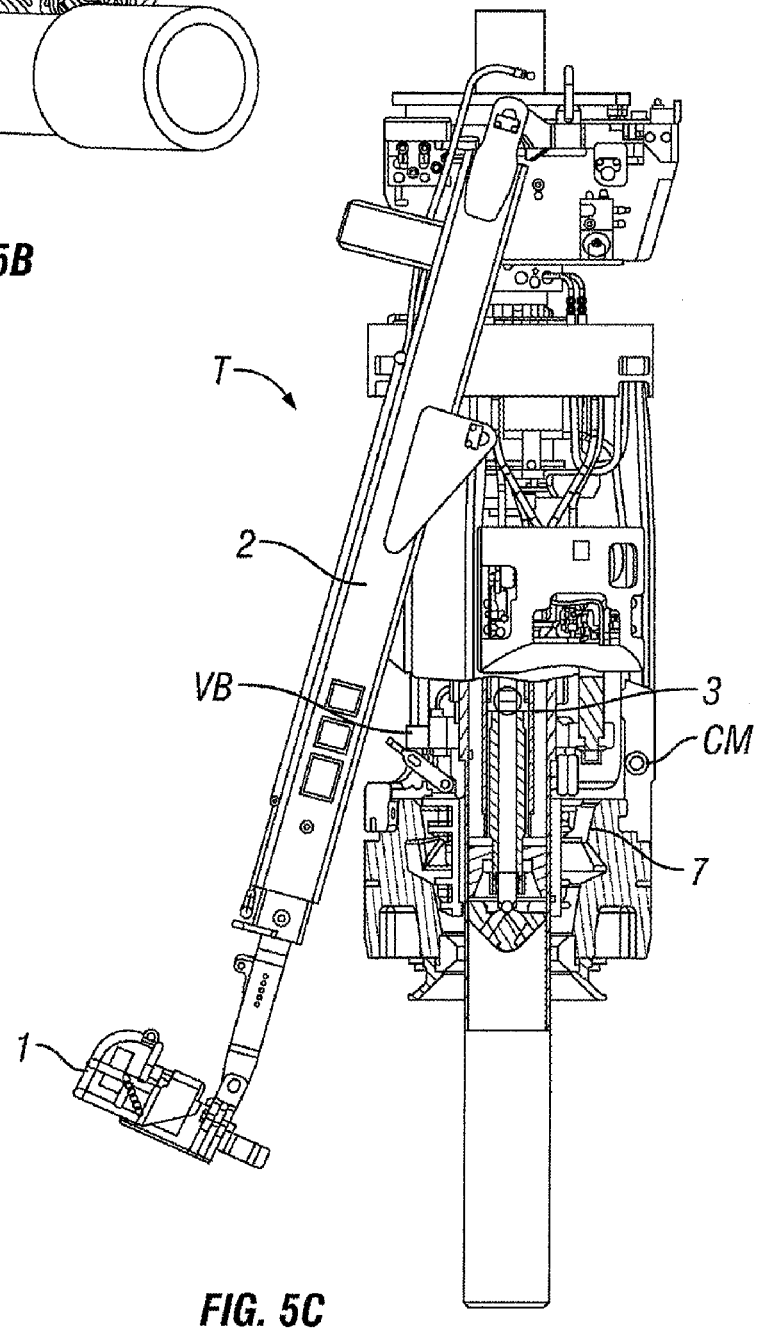
FIG. 5C is a side view, partially cutaway, of the system of FIG. 5.

FIGS. 5-5C show a tool system T according to the present invention which performs the functions of a casing running tool (e.g. for pieces of casing CA) and, in one aspect, of a cementing system. As shown in FIG. 5A the system T has an automated hydraulically operated single joint handling system 1; an adjustable link-tilt frame 2; a fill and circulation tool 3; a cylinder assembly 4 for the frame 2; and a twist lock structure 5 for easy access to slips within a slips system 7. In one aspect, the single joint handling system is remotely operated with the system hydraulically operated or air operated and a "set" signal is provided from the handling system to the operator. In certain aspects, such a system T eliminates stabbing-board operations and requires less manual handling of tubulars; and in certain particular aspects, there are no power casing tong operations and work platforms are removed. In certain aspects, the system T includes an integral compensator that reduces the risk of damage due to cross-threaded tubulars. Such a system T assures that casing can be set to the casing point with the ability to push casing to bottom, fill, circulate, rotate and reciprocate.

Such a system T (since it has the single joint elevator system, rigid link hoist and stabbing assembly, fill and circulation tool and compensator in one assembly) has less equipment to rig up. A single load path design eliminates links. An operator can determine and control running/tripping speed, spin-in, and make-up torques. When running mixed strings, size components can be changed in a short time (e.g. minutes) using the twist-lock design and the insert carrier/slip design (e.g. insert carriers from 4.5 inches to 9⅝ inches).

In certain aspects, pipe sensors are used with the system T to detect the casing coupling so the slips set automatically at the correct position, ensuring casing connection integrity.

The fill and circulation tool enables fast change out of seals and guide elements when mixed strings are run; inhibits or prevents spills of expensive fluids; and reduces the risk of environmental incidents. In one aspect, a catch plate directly operates the fill and circulation tool. An optional camera system CM (shown schematically, FIG. 5C) provides visual confirmation of the slip set function and fill-up tool position. In certain aspects, a drawworks stop signal presented by the system T to the operator tells the operator that the system T is lowered to its correct position to set the slips and that the driller can/must stop lowering the system T/Top Drive combination by stopping the drawworks.

FIG. 5C shows the system T with a visible levelling beam VB and with the slips system 7. In certain particular aspects, a system T has these specifications and dimensions:

Specifications And Dimensions

| | |
|---|---|
| API 8C Hoist Rating | 350 tons/317 M tons |
| Casing Size | 4½" to 9⅝" |
| Fill-Up and Circulation | 4½" to 9⅝" circulation & fill-up (fill-up, circulate, and recovery over the full range) |
| Maximum Mud Circulation Pressure | 5,000 psi/34,500 KPa |
| Rotational speed | 0-20 rpm |
| Weight | 7,700 lbs/3,493 kg |
| Maximum Push Down Force | 20,000 lbs/9,072 kg |
| Transport skid | Complies to DnV rules for Lifting Appliances. |
| Temperature Range | −20° to +40° [Celsius] |
| Maximum Torque | 35,000 ft. lb. |
| Diameter of CRT body | 31½" |
| Height* | 120½" (compensator in neutral position) |

*Stackup length is from TDS Bell Guide

Figure 6:
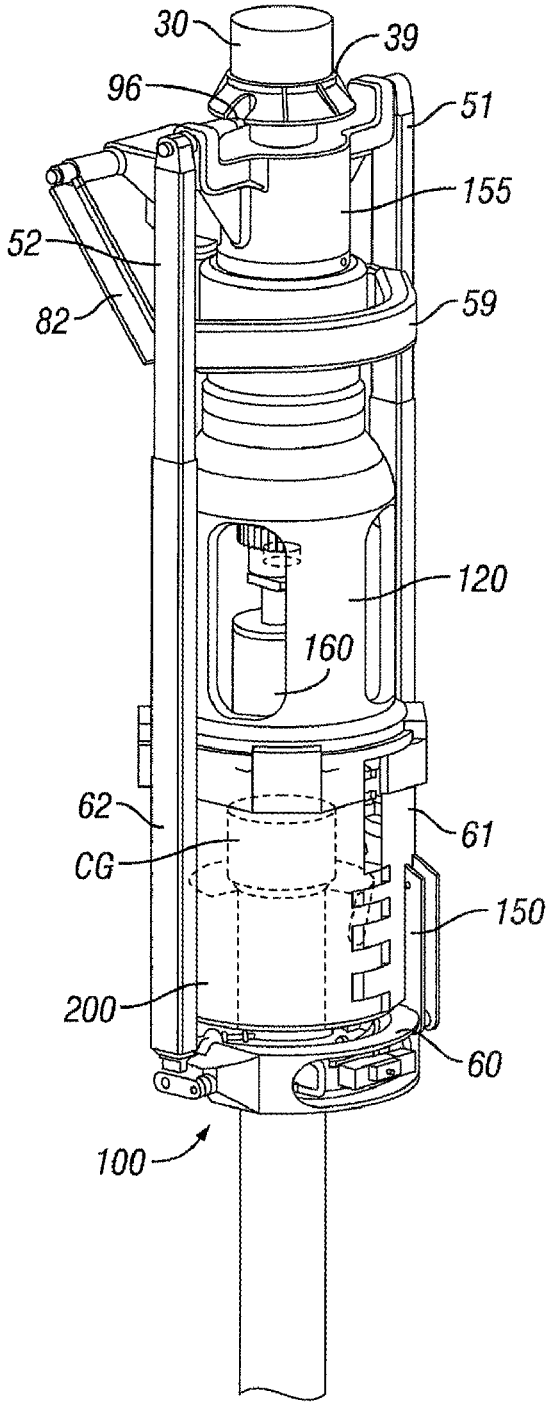
FIG. 6 is a perspective view of a system according to the present invention.

FIG. 6 shows a system 100 according to the present invention. The system 100 has a main shaft (like that of any system according to the present invention disclosed herein) and a swivel assembly 155. The main shaft is the primary load supporting part of the tubular running system and has a load shoulder (like that of any system according to the present invention disclosed herein) that transfers tubular weight from the slips and slip body to the shaft. The swivel assembly 155 is an integrated swivel assembly interconnected with a link tilt system (like the link tilt system 50, FIG. 1A or like that of any system according to the present invention disclosed herein). The integrated swivel assembly 155 holds the link tilt system static while the link tilt system is holding a pipe and while the pipe is rotating.

The integrated swivel assembly 155 can also serve as a terminal point for field service loops.

A fill-up and circulation tool according to the present invention may be incorporated into the system 100.

Figure 8A:
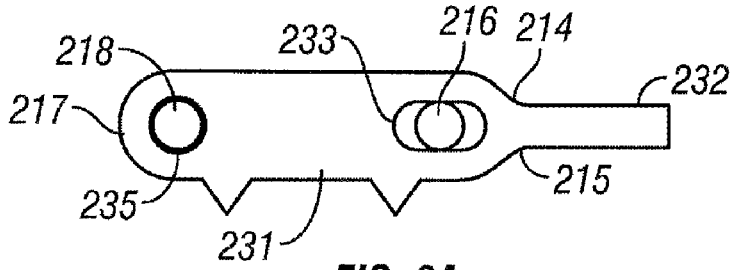
FIG. 8A is a top view of a link of the system of FIG. 7B.

The system 100 has a slip setting system 200 with a levelling beam 210 (like that of any system according to the present invention disclosed herein) to which are connected a plurality of movable slip segments. The beam is visible. It is within the scope of the present invention to employ any desired number of slip segments, e.g. two, three, four or more. Each slip segment is connected to the levelling beam 210 with a link 214 (see FIG. 8A) which is pivotably pinned at one end 215 with a pin 216 through a slot 233 to the levelling beam and pivotally pinned at the other end 217 with a pin 218 through a hole 217*a* to a corresponding slip segment.

The levelling beam is connected to lifter apparatuses 220 (like that of any system according to the present invention disclosed herein). The lifter apparatuses 220 raise and lower the levelling beam 210.

In one particular aspect of a slip setting system 200 according to the present invention, there are three independent slip segments (e.g., as in any system according to the present invention described herein with three slips). There is no connection between adjacent slip segments. The three slip segments when moving up and down, move radially with respect to a pipe without any tangential movement. Ideally then the three slip segments form a circle around a pipe and apply identical loads to the pipe. Thus an overall balanced load is applied to the pipe when it is engaged simultaneously by the three slip segments. The slips are pushed down via sliding push blocks instead of typical slip brackets.

Figure 7A:
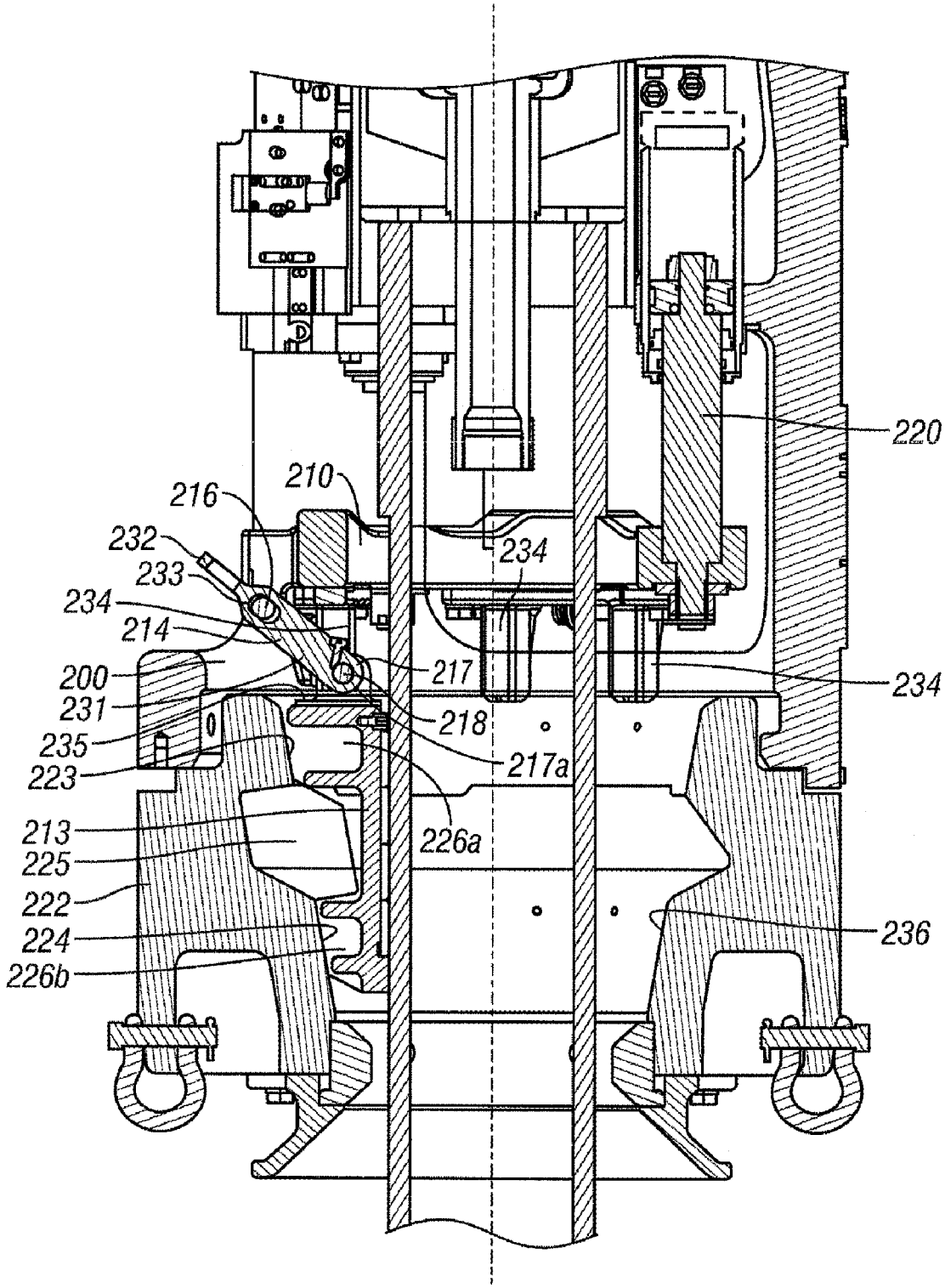
FIG. 7A is a cross-section view of a slip setting system of the system of FIG. 5.
Figure 7D:
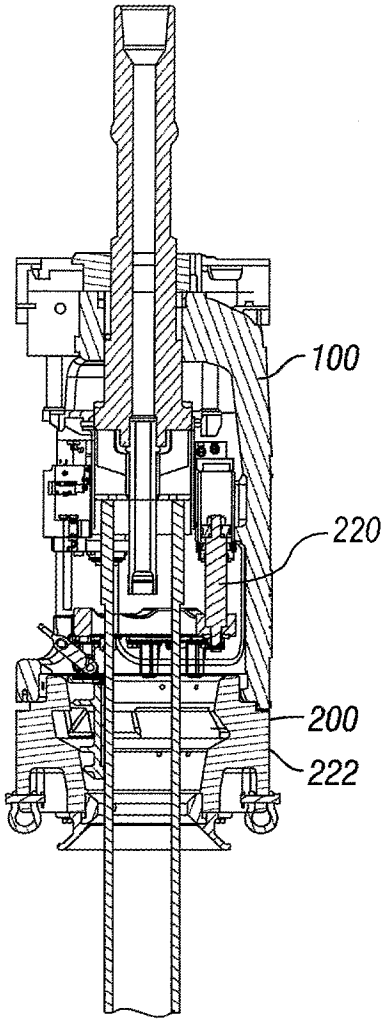
FIG. 7D is a cross-section view of the system of FIG. 7B showing a step in a method according to the present invention.
Figure 7C:
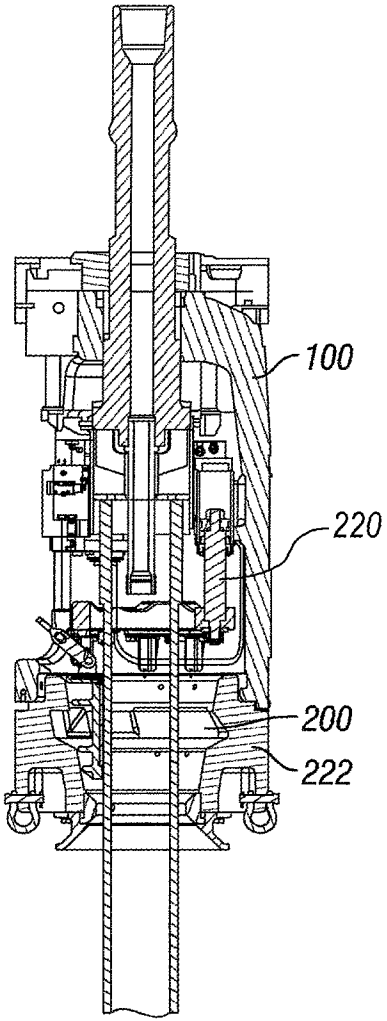
FIG. 7C is a cross-section view of the system of FIG. 7B showing a step in a method according to the present invention.
Figure 7B:
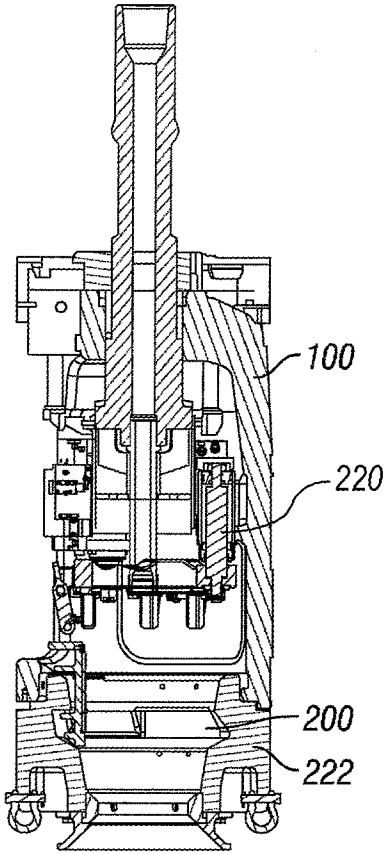
FIG. 7B is a cross-section view of the system of FIG. 7B showing a step in a method according to the present invention.

FIGS. 7B-7D illustrate steps in a slip setting method according to the present invention with a running tool system 100 having a slip setting system 200. As shown in FIG. 7B the slips have been raised and the slip segments 211-213 are not engaging a tubular As shown in FIG. 7C the levelling body 210 has been lowered by the apparatuses 220 and the slip segments 211-213 (one shown) have been moved down and radially inward to grip a pipe P, but without yet penetrating the pipe P. As shown in FIG. 7D, the slip segments 211-213 have moved down to the farthest extent of their travel possible and have penetrated the pipe P, engaging it.

The slip segments 211-213 are housed within a slip body 222 which has recesses 223, 224 and a projection 225 which co-act with a slip segment projections 226*a* and 226*b* to releasably hold the slip segments 211-213 in place within a body bore 236.

Figure 8B:
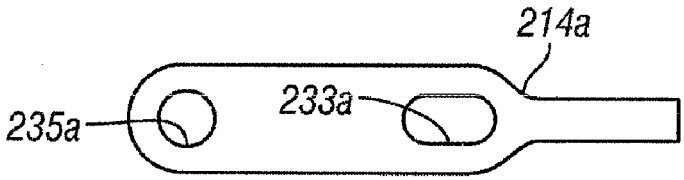
FIG. 8B is a top view of a link for use with systems according to the present invention.
Figure 9A:
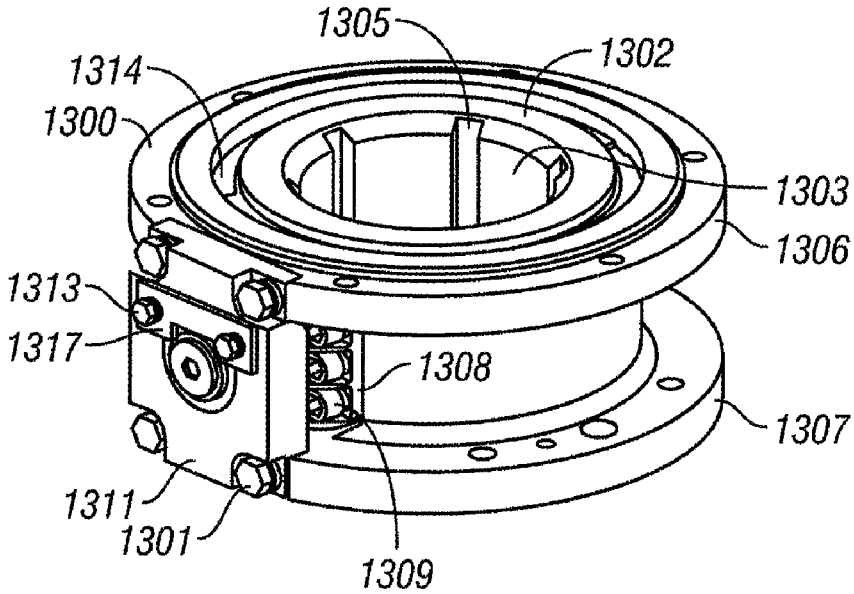
FIG. 9A is a perspective view of a torque transducer for use with systems according to the present invention.
Figure 9B:
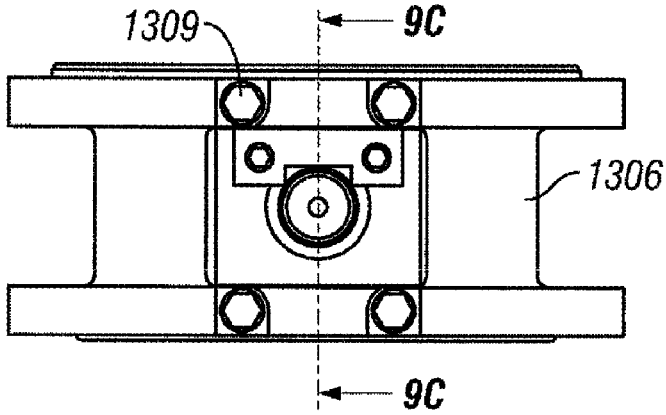
FIG. 9B is a side view of the torque transducer of FIG. 9A.
Figure 9C:
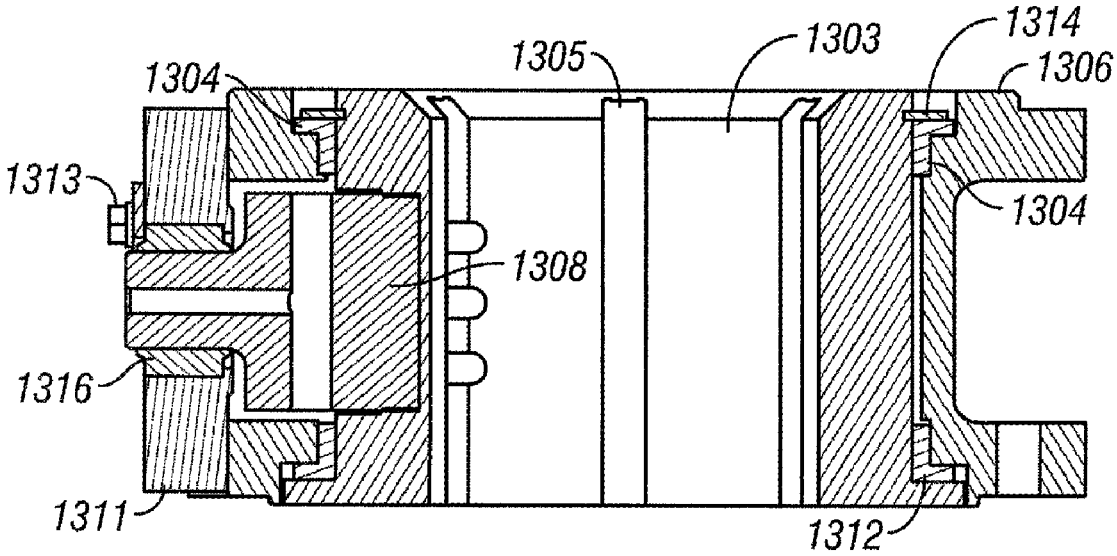
FIG. 9C is a cross-section view along line 9C-9C of FIG. 9B.
Figure 9D:
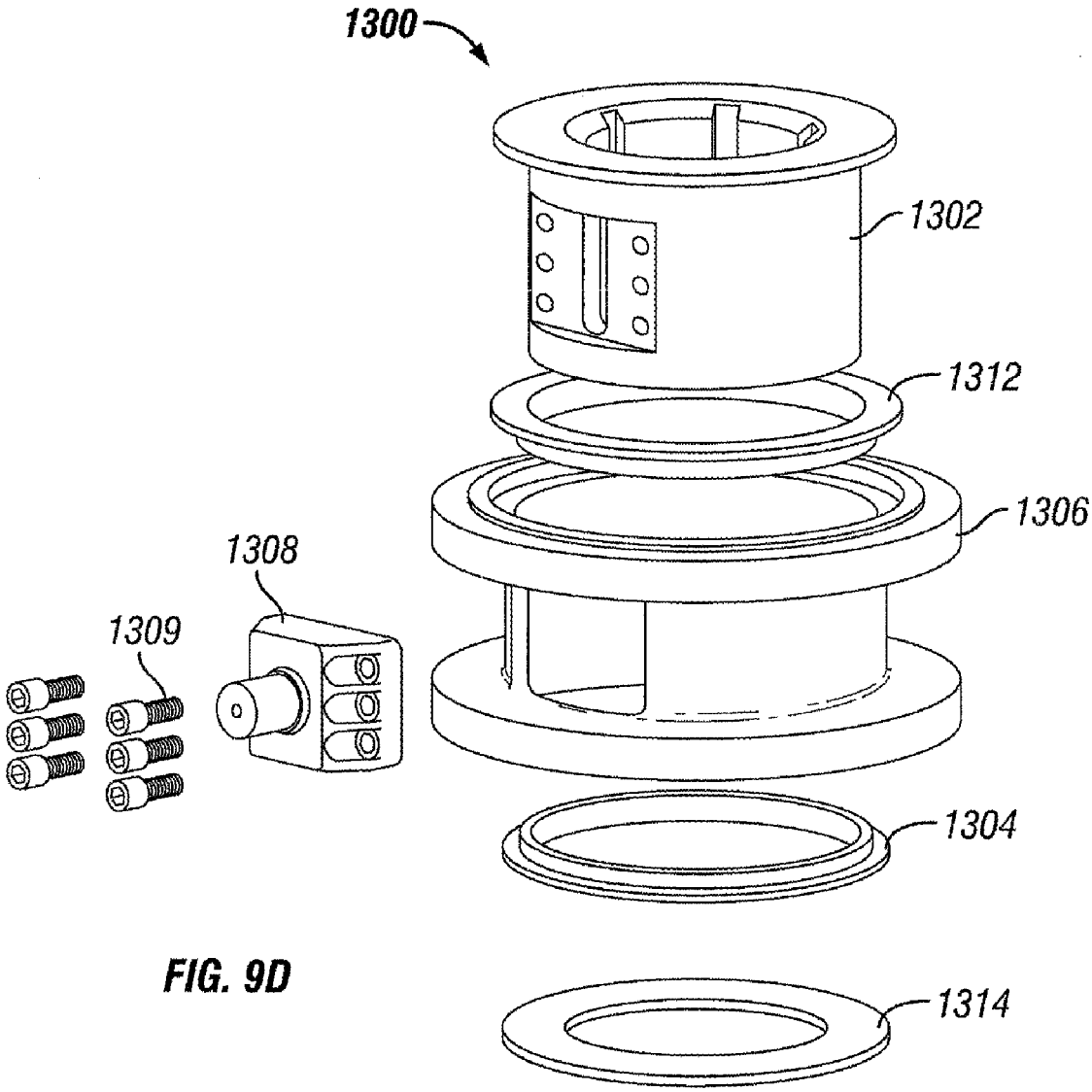
FIG. 9D is an exploded view of the torque transducer of FIG. 9A.

Each link 214 has a body 231 with a top handle 232 and a top slot 233. The pin 218 is in hole 235. The pin 216 is movable within the slot 233. Thus, when a slip segment 211-213 is being lifted from the bore 236 of the slip body 222, the pin 216 pulls the link and thus the slip segment comes up and out of engagement with a tubular. When the slip segments are lowered and pushed down by the links 214 into engagement with a tubular, the links 214 reach a point in their travel at which the pins 216 move within the slots 233 and the links 214 no longer push down on the pins 216 and thus no longer push the slip segments down. On the bottom of the levelling beam 210, push down blocks 234 protrude downwards toward the upper surfaces 235 of the slips. When the levelling beam 210 travels down, gravity allows the individual slip segments to fall into the bore 236 of the slip body 222. As soon as the slip segments touch the pipe OD, they stop traveling down until the push down blocks 234 on the levelling beam 210 are in contact with all slip segments 211-213 and push down all three slip segments 211-213 evenly, simultaneously and purely axially downwards. No radial forces act on slip segments 211-213. The individual slip segments 211-213 are thus free to find their theoretically optimum position around the OD-circle of the pipe. FIG. 8B shows an alternate shape for links 214*a* for the slips. The links 214*a* have pin openings 233*a* and 235*a*.

In certain particular aspects torque is measured in a system according to the present invention (e.g. any described herein) using a torque transducer assembly 1300 as shown in FIGS. 9A-9D. The assembly 1300 includes an inner ring 1302, a sliding bearing 1304, an outer ring 1306, a strain element 1308, a sliding bearing 1312, a bearing retainer 1314, and bolts 1309 for the strain element 1308. The inner ring 1302 has a channel 1303 therethrough and splines 1305. Bolts 1313 secure a retainer 1317 over a spherical bearing 1316 mounted in a reaction bracket 1311 attached to the outer ring 1306 with bolts 1301. The spherical bearing 1316 engages the strain element 1308 (connection 1315 for strain element in FIGS. 10A-10C).

In certain aspects using systems according to the present invention, torque is applied from a top drive motor to the splines 1305 of the inner ring 1302 through a splined shaft (not shown). The inner ring 1302 transfers the torque to the strain element 1308 which in turn transfers the torque through the spherical bearing 1316 to the outer ring 1306 through the reaction bracket 1311. The outer ring 1306 transfers the torque through a bottom flange 1307 to the running tool system (e.g. as in FIG. 4 or FIG. 5) frame and body.

Figure 10A:
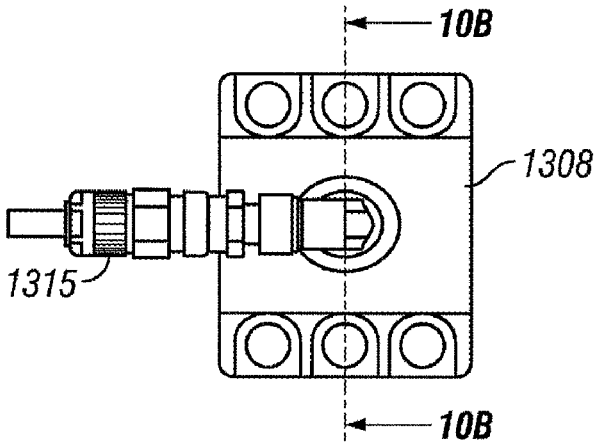
FIG. 10A is a top view of a strain element for use with the torque transducer of FIG. 9A.
Figure 10B:
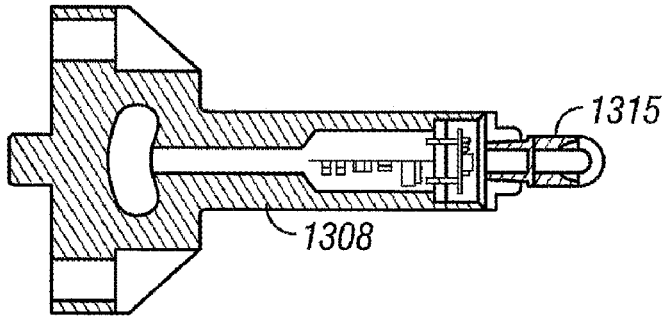
FIG. 10B is a cross-section view along line 10B-10B of FIG. 10A.
Figure 10C:
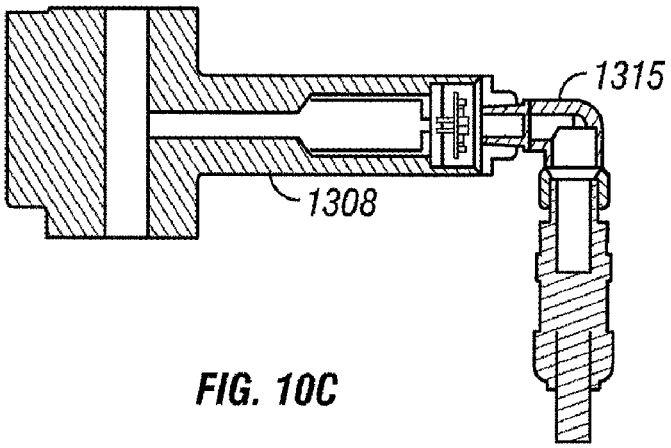
FIG. 10C is a cross-section view of the strain element shown in FIG. 10B.
Figure 10D:
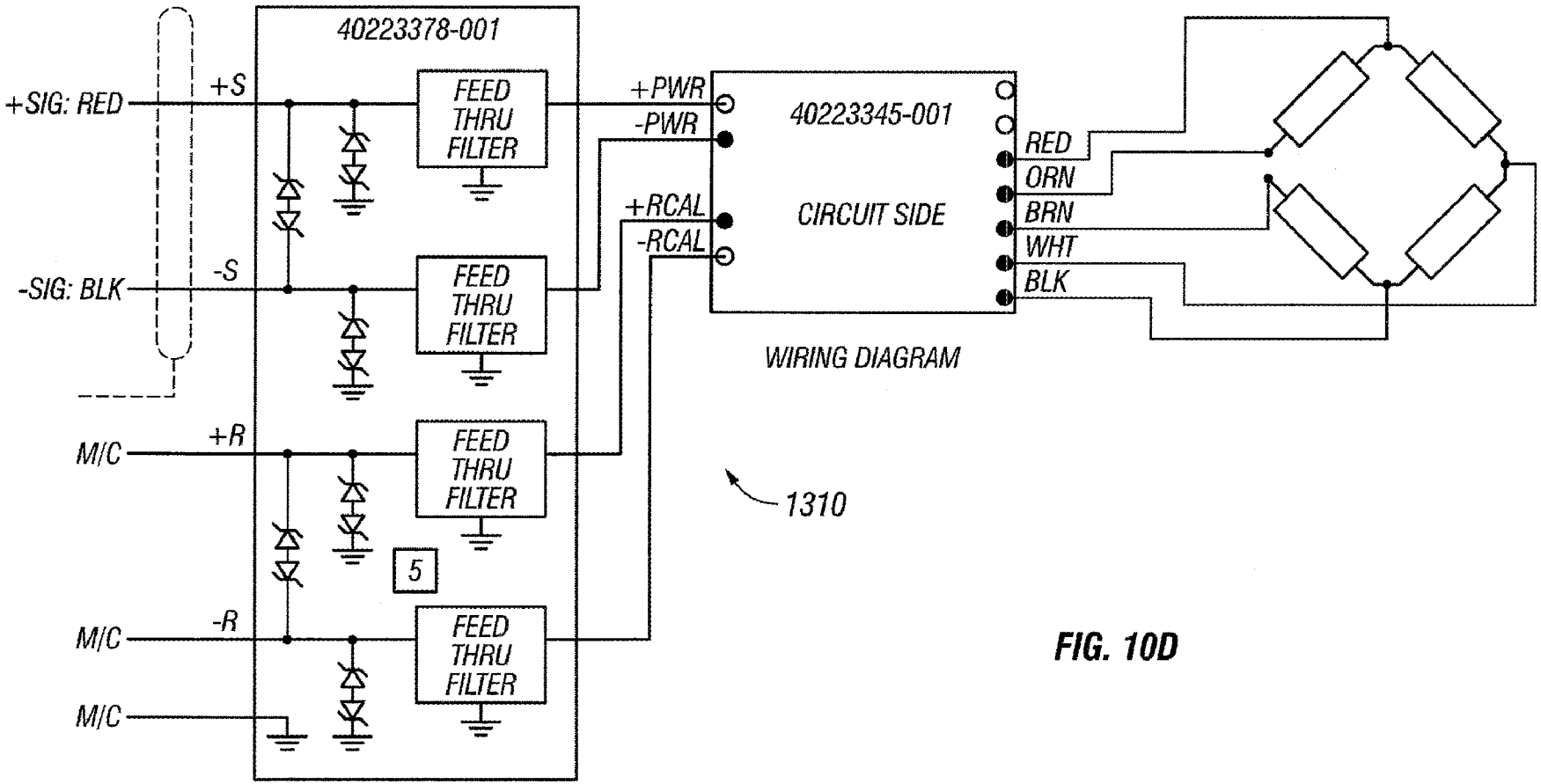
FIG. 10D is a circuit diagram for use with the strain element of FIG. 10A.

FIGS. 10A-10C show a strain element 1308 with its connection 1315. FIG. 10D shows one typical wiring circuit 1310 for use with the assembly 1300.

Figure 11:
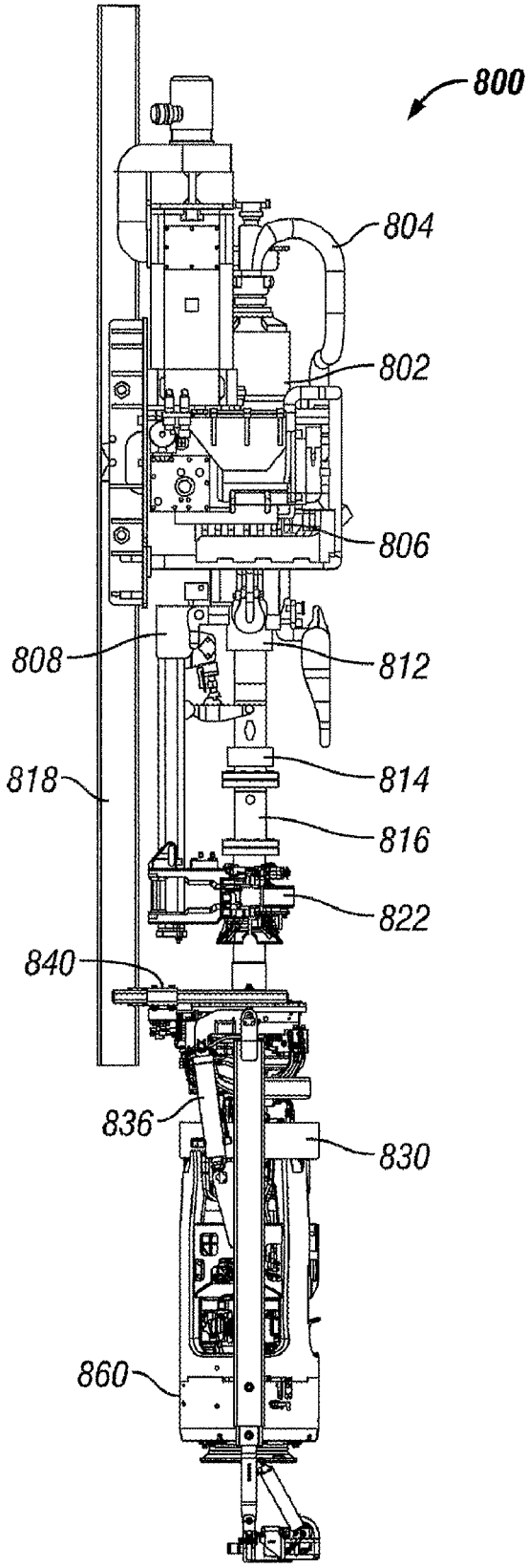
FIG. 11 is a side view of a system according to the present invention.
Figure 12:
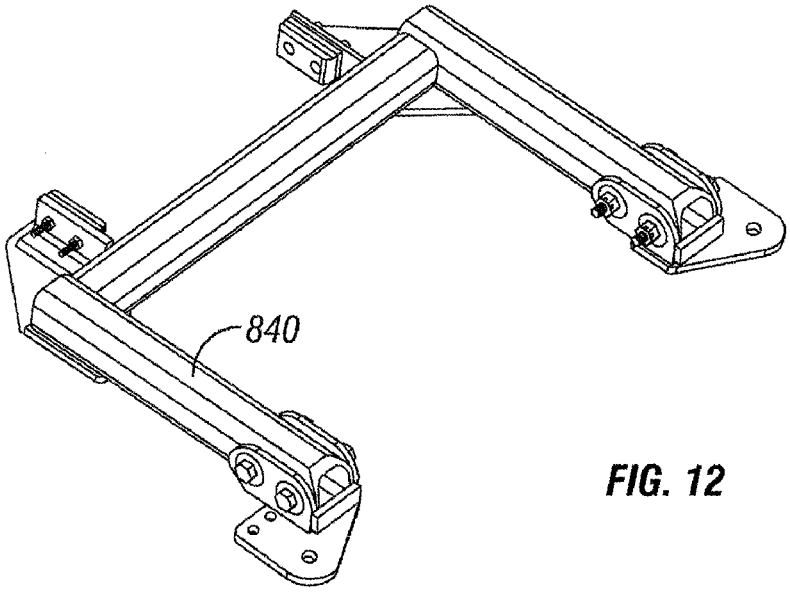
FIG. 12 is a perspective view of a torque reaction frame of systems according to the present invention.
Figure 13:
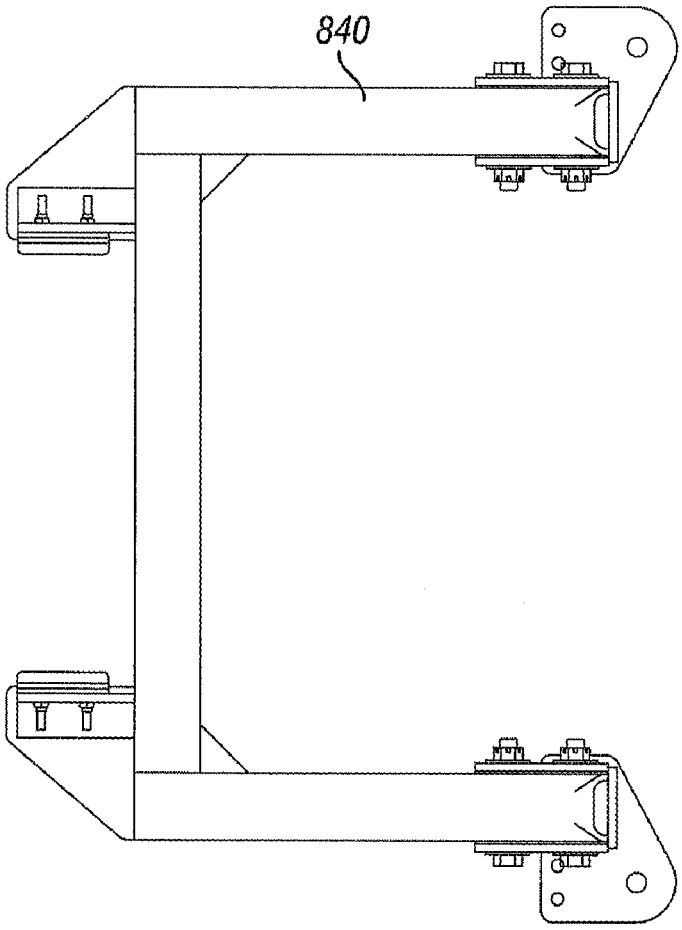
FIG. 13 is a top view of the torque reaction frame of FIG. 12.

FIG. 11 shows a system 800 according to the present invention with a casing running tool 830 according to the present invention. The system 800 includes a top drive 802, gooseneck 804, link adapter 806, link tilt 808, connection clamps 812 and 814, lower IBOP 816, guide beam 818, and pipe handler 822. The casing running tool 830 has a torque reaction frame 840 (see also FIGS. 12, 13) connected to the top of the tool 830 and is movably connected to and guided by the guide beam 818.

A main shaft 832 (like the shaft 170, FIG. 6) has a splined connection with a torque frame 850 to allow the transmission of torque from the top drive 802 to slips in a slip assembly 860 (like the slip setting system 200 described above) and hence to casing being run with the tool 830. A crossover sub is used to adapt the shaft for connection to the top drive connection (or to a lower IBOP).

The casing running tool 830 has a joint handling system 836 (e.g. like the system 50 described above).

Any suitable known fill and circulation tool may be used with systems according to the present invention; e.g., such a tool includes an internal ball valve for controlling mud flow through the system.

Figure 14A:
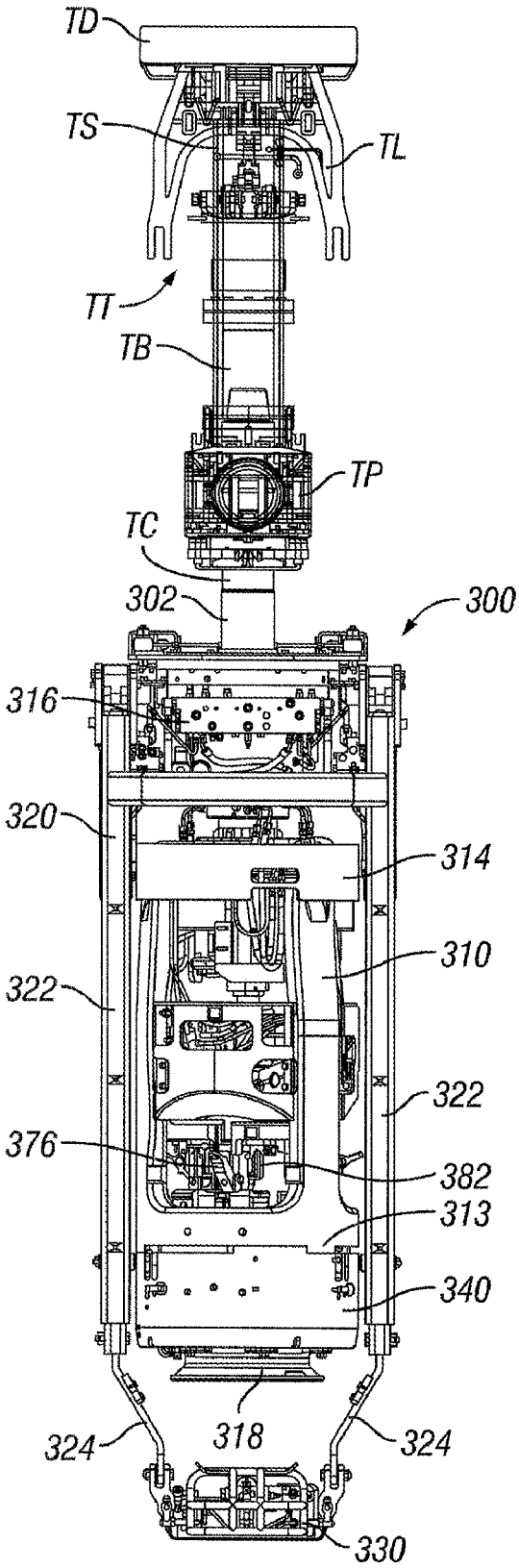
FIG. 14A is a front view of a system according to the present invention.
Figure 14B:
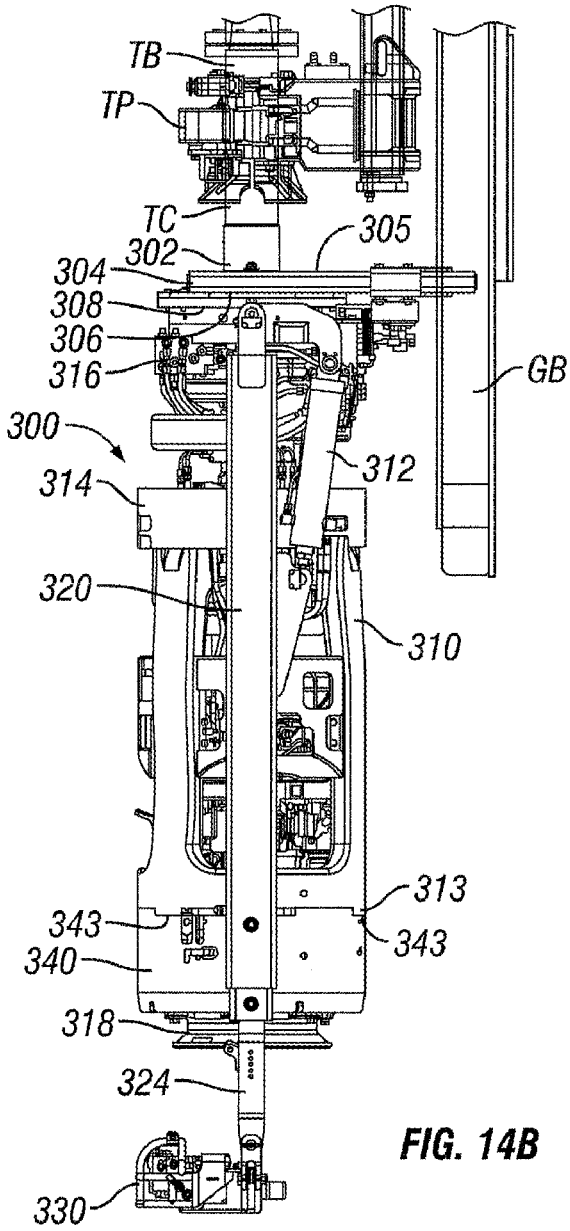
FIG. 14B is a side view of the system of FIG. 14A.
Figure 14C:
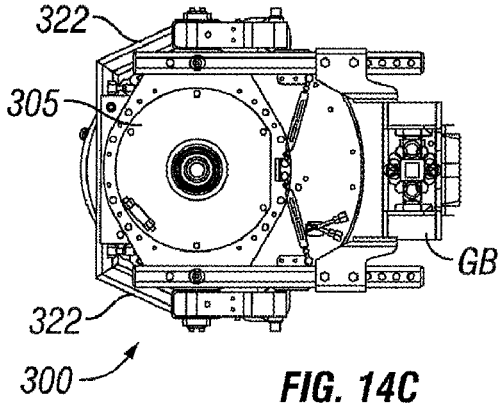
FIG. 14C is a top view of the system of FIG. 14A.
Figure 14E:
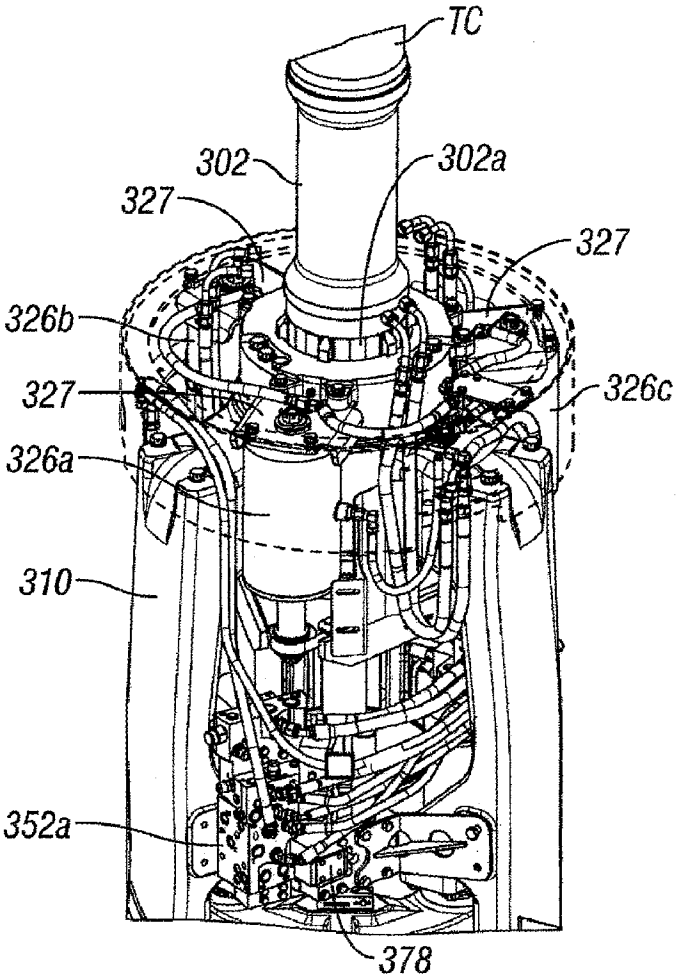
FIG. 14E is a partial perspective view of the system of FIG. 14A.
Figure 14D:
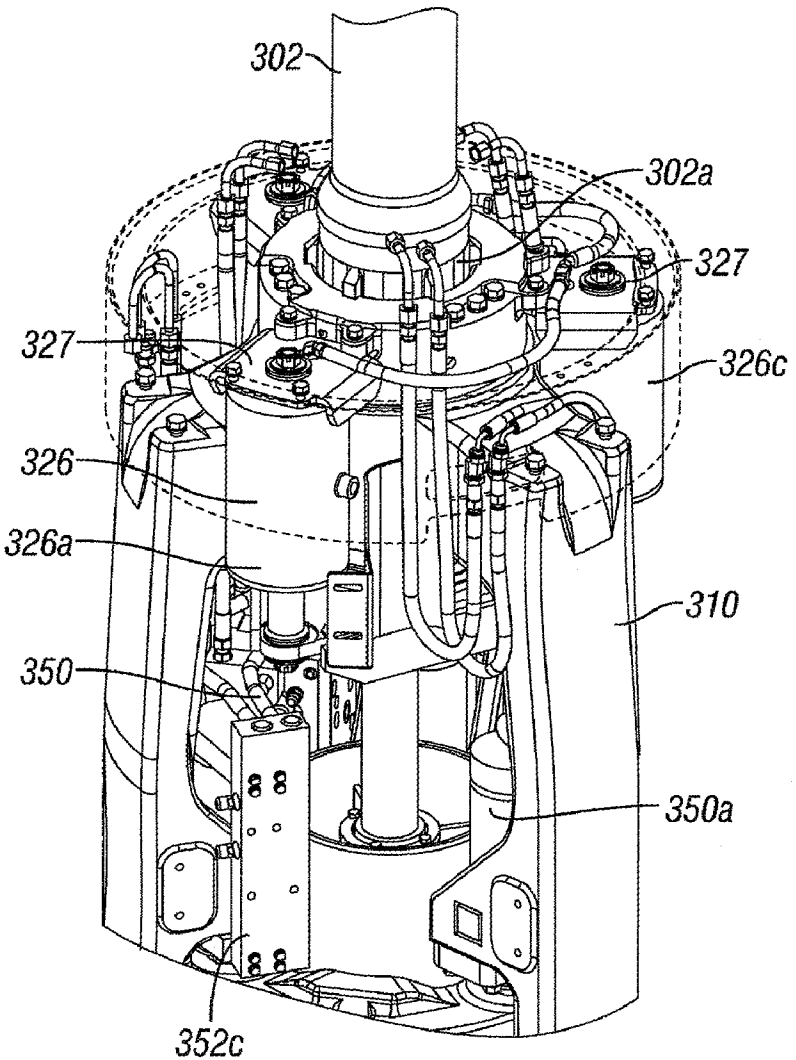
FIG. 14D is a partial perspective view of the system of FIG. 14A.
Figure 14G:
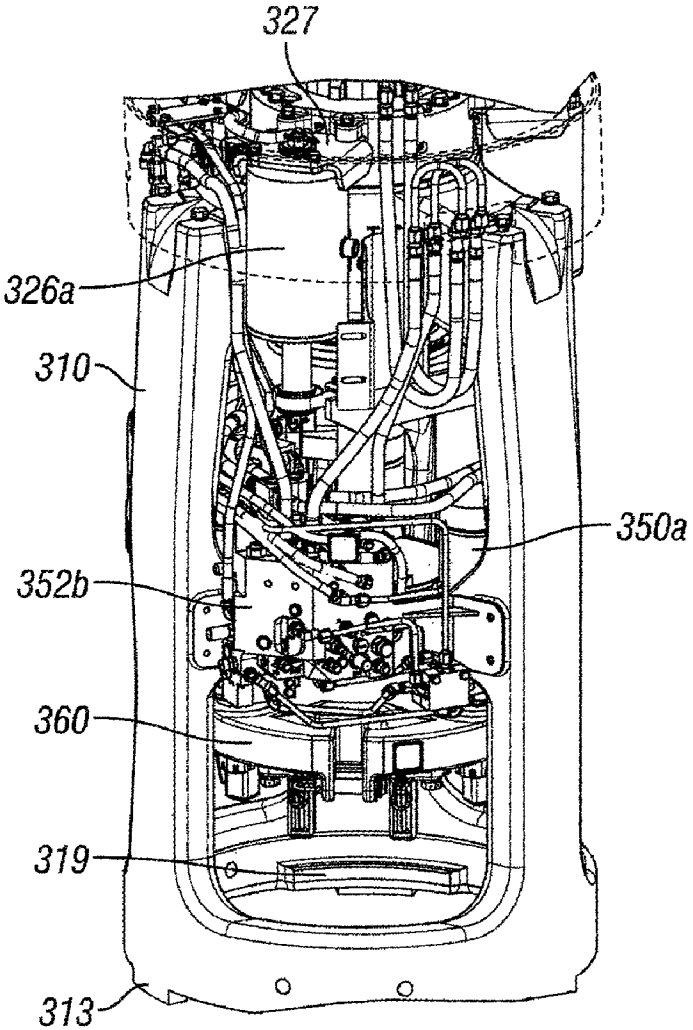
FIG. 14G is a partial perspective view of the system of FIG. 14A.
Figure 14F:
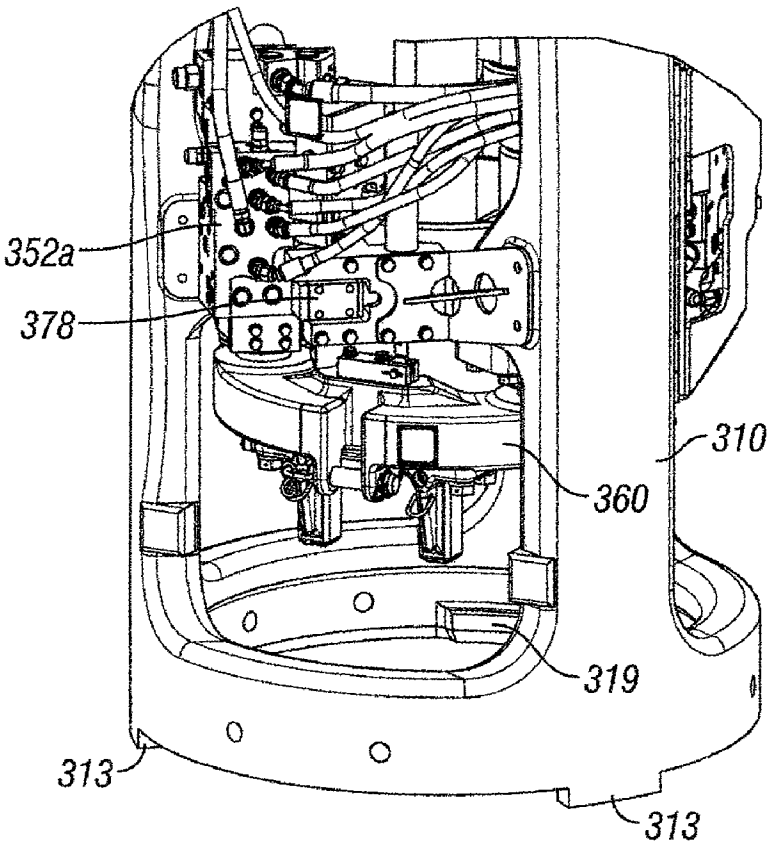
FIG. 14F is a partial perspective view of the system of FIG. 14A.
Figure 14H:
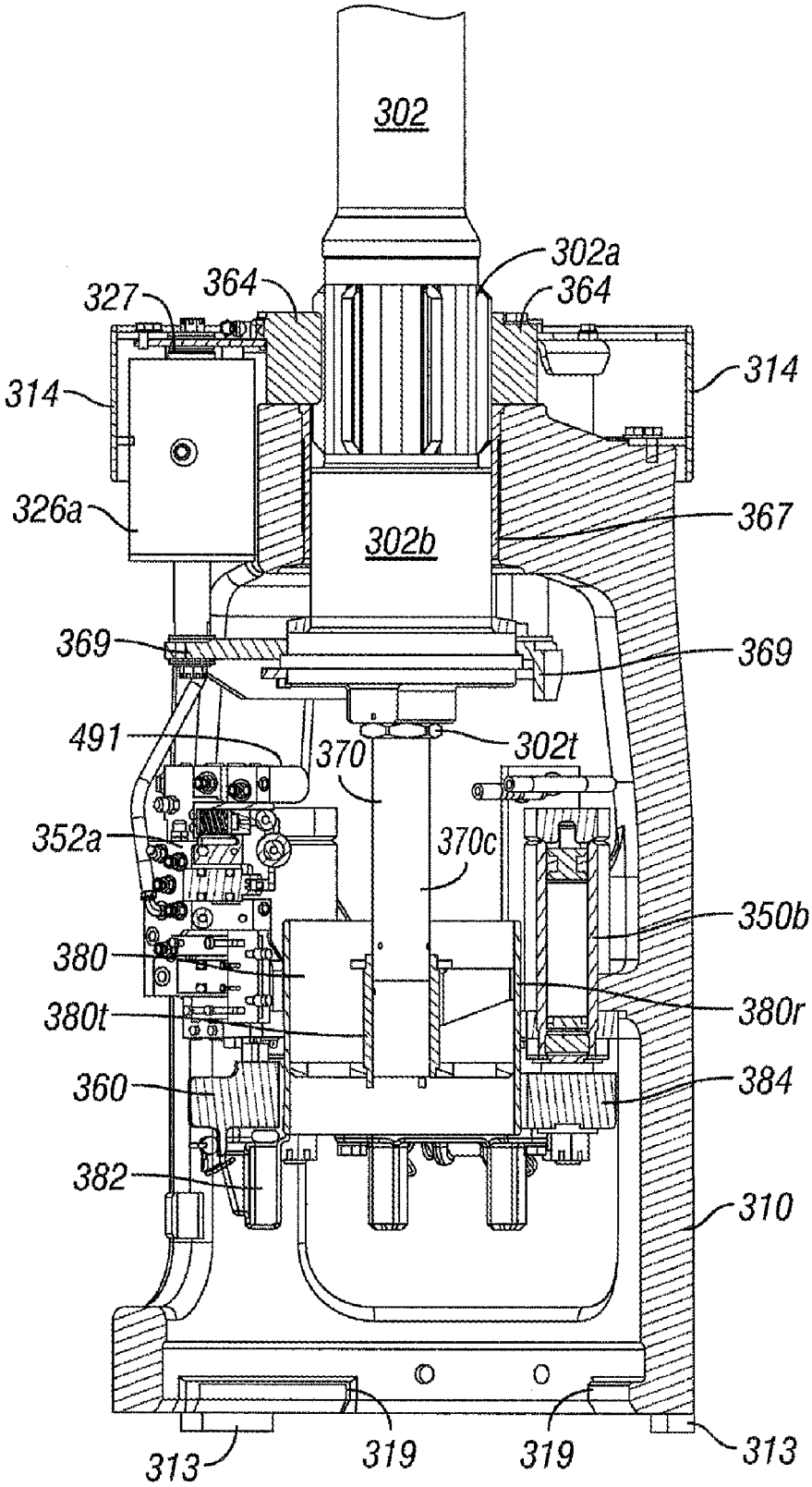
FIG. 14H is a partial cross-section view of the system of FIG. 14A.
Figure 14I:
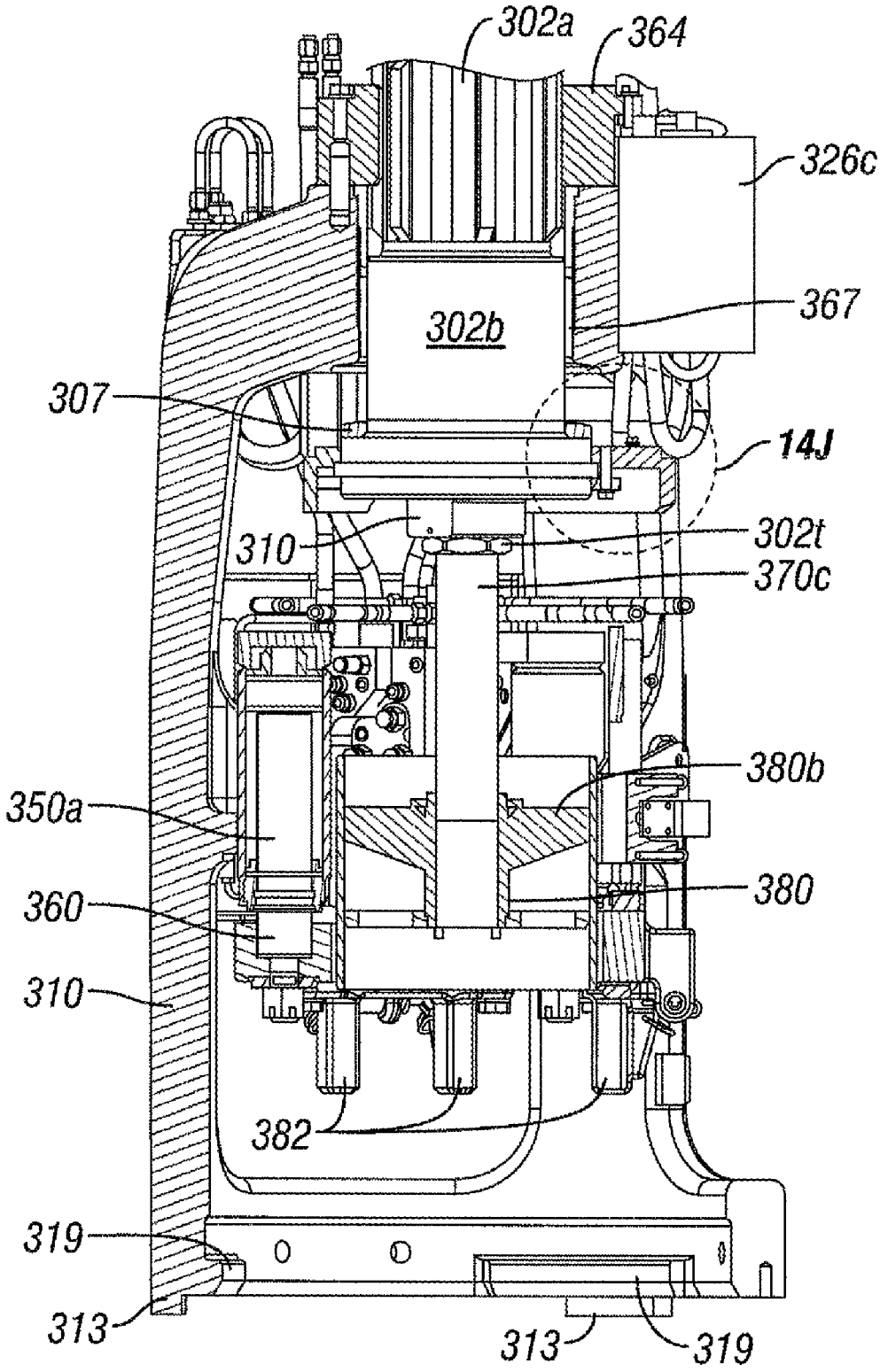
FIG. 14I is a partial cross-section view of the system of FIG. 14A.
Figure 14J:
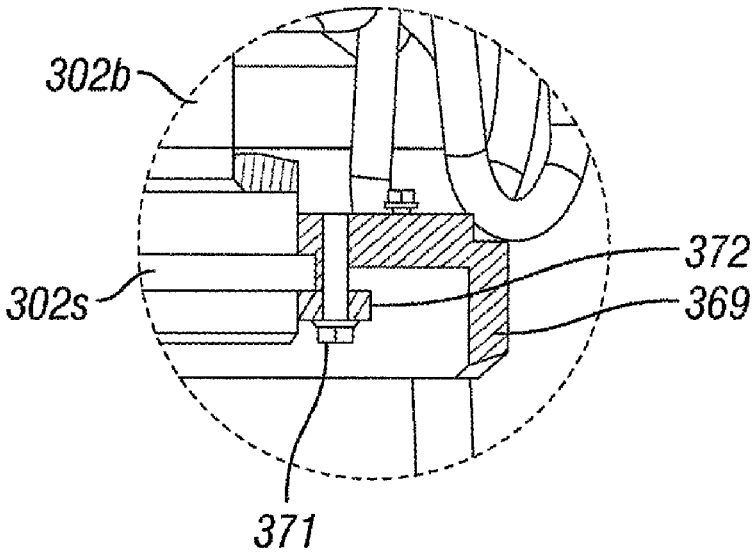
FIG. 14J is an enlargement of part of the system shown in FIG. 14I.
Figure 14K:
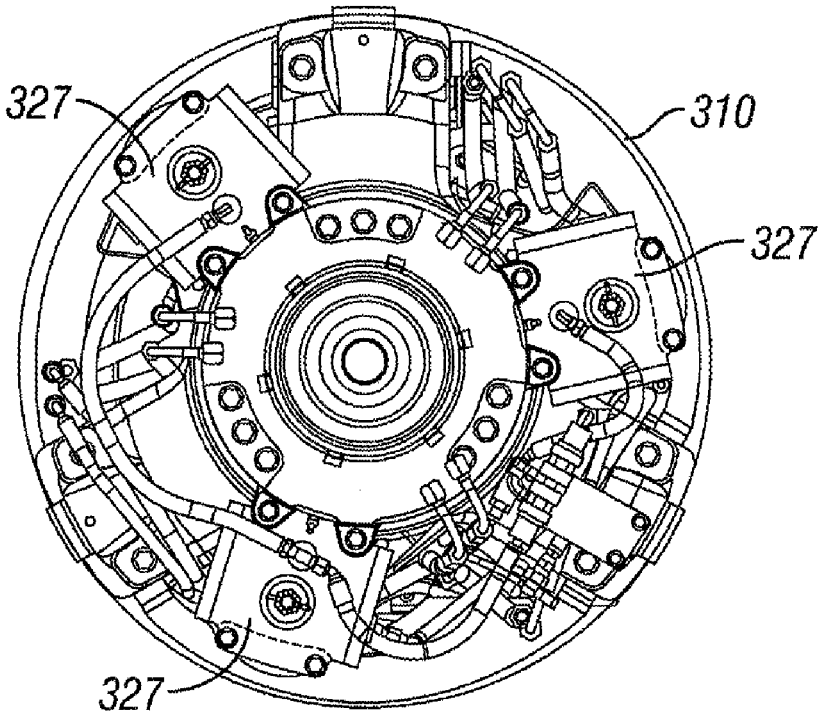
FIG. 14K is a top view of the system as shown in FIG. 14H.
Figure 14L:
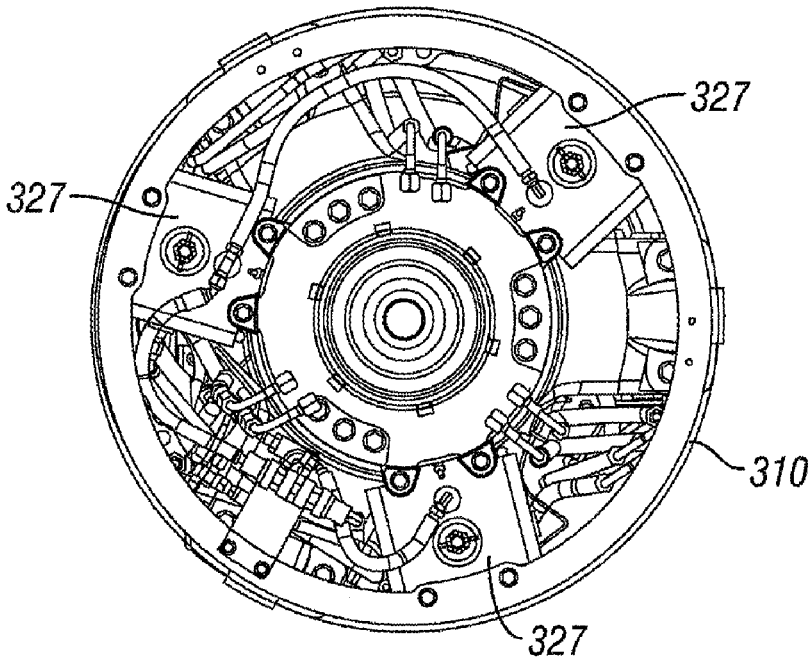
FIG. 14L is a top view of the system as shown in FIG. 14H.
Figure 14M:
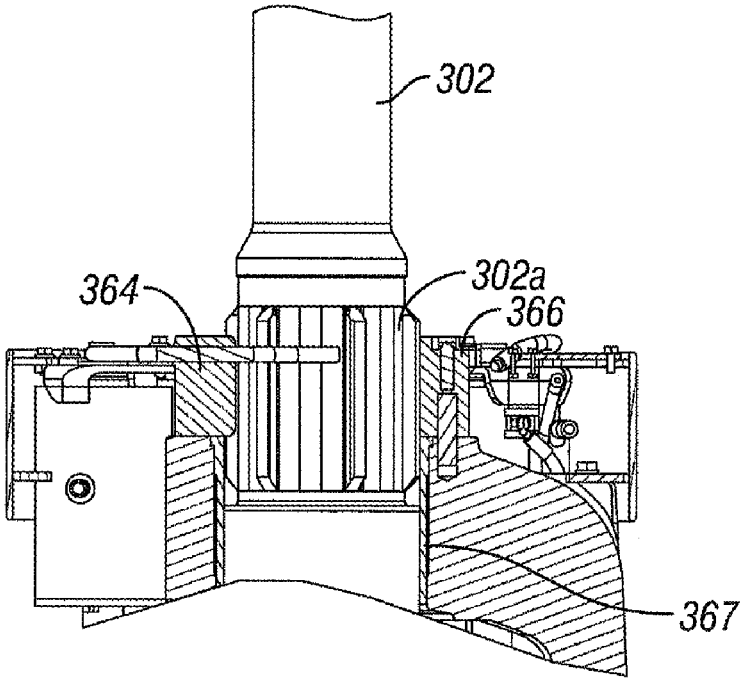
FIG. 14M is a partial cross-section view of the system as shown in FIG. 14H.
Figure 14N:
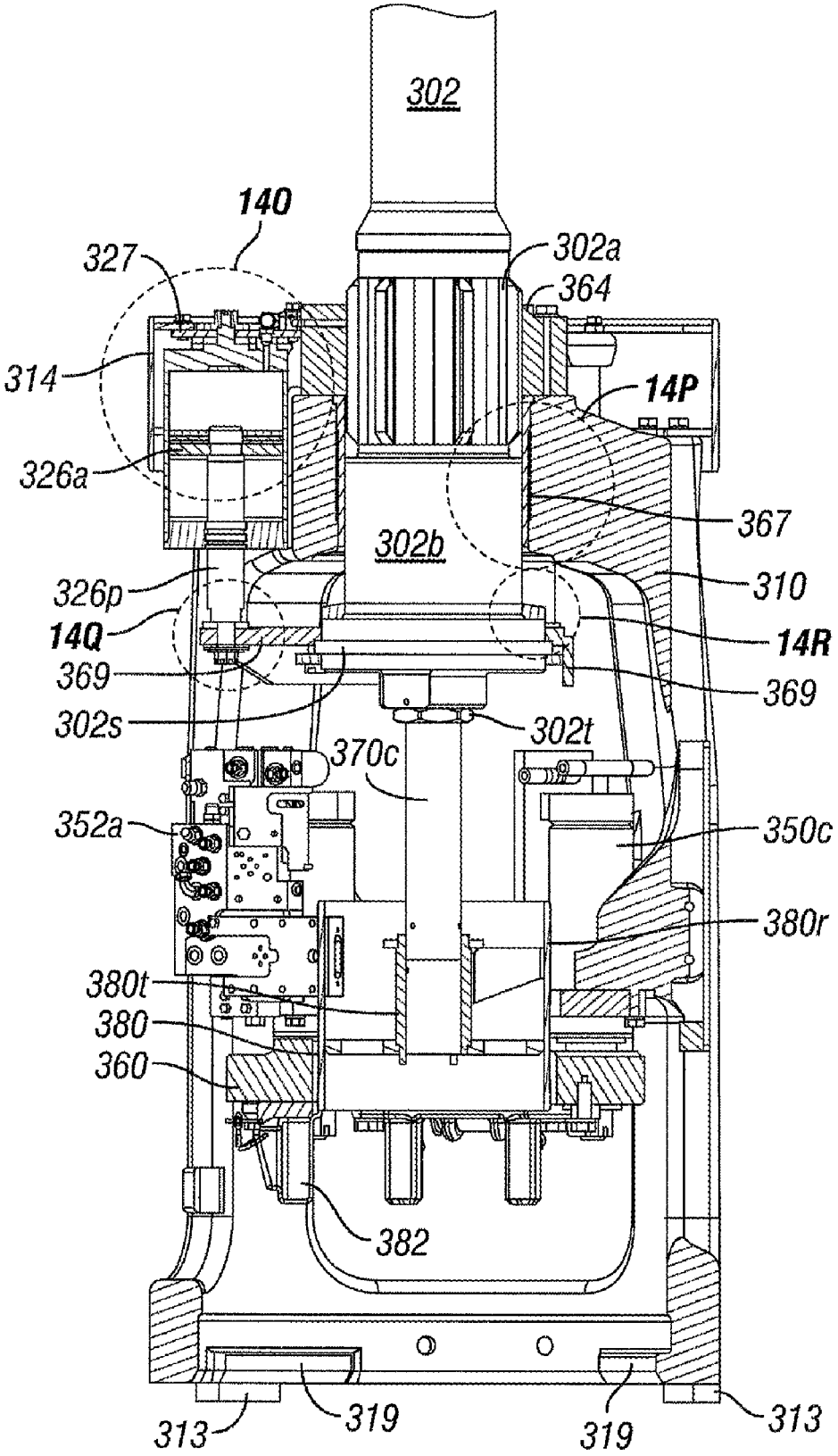
FIG. 14N is a partial cross-section view of the system of FIG. 14A.
Figure 14O:
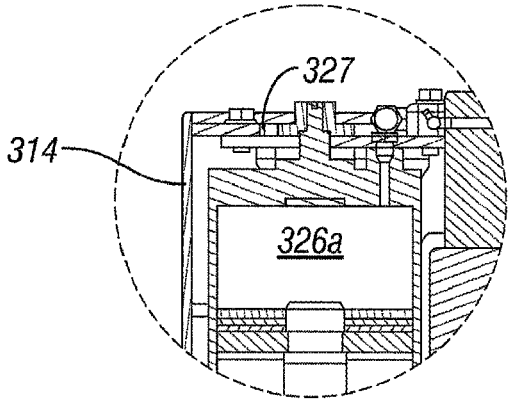
FIG. 14O is an enlargement of part of the system as shown in FIG. 14N.
Figure 14P:
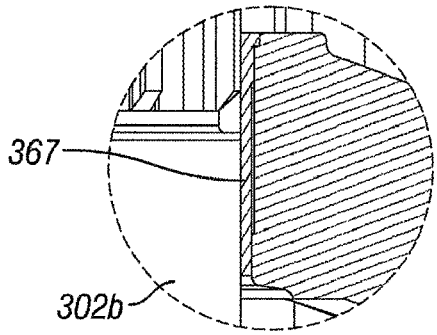
FIG. 14P is an enlargement of part of the system as shown in FIG. 14N.
Figure 14Q:
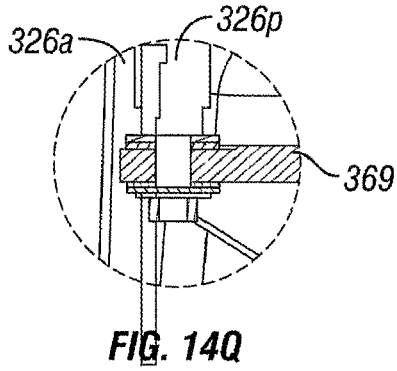
FIG. 14Q is an enlargement of part of the system as shown in FIG. 14N.
Figure 14R:
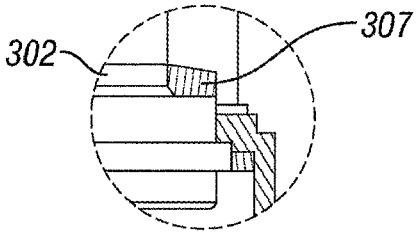
FIG. 14R is an enlargement of part of the system as shown in FIG. 14N.
Figure 14S:
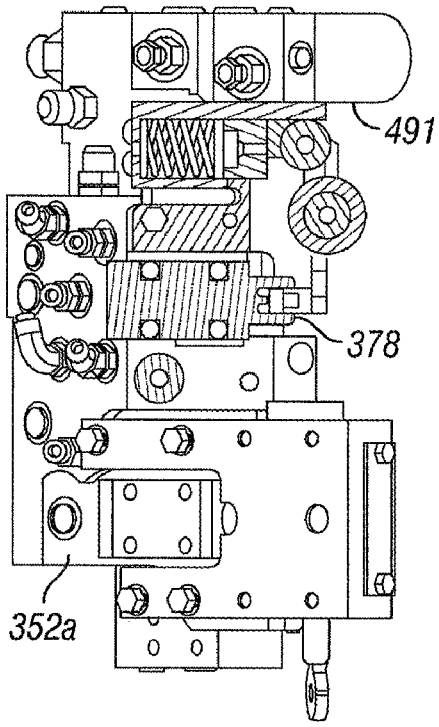
FIG. 14S is a side view partially in cross-section of the system of FIG. 14A.

FIGS. 14A-14R show a running tool system 300 which is similar to the system 100, FIG. 6. The system 300 has a main shaft 302 which is the main load supporting part of the system 300 and which is shown connected to a top drive system which includes a shaft TS, a lower internal blowout preventer TB, a pipe handler TP, a link tilt apparatus TL and a top drive TD (shown schematically). A crossover sub TC facilitates connection of the main shaft 302 to the lower internal blowout preventer TB.

The main shaft 302 has a load bearing shoulder 307 that transfers tubular weight (e.g. casing weight) from a slips system (described below) and a slip body 340 (described below) through the torque frame 310 to the main shaft 302. The main shaft 302 transmits torque from the top drive TD of the top drive system TT to the system 300. A torque backup assembly 305 with a cover 304 is connected to a stationary part 306 of a swivel assembly 308 preventing the stationary part of the swivel assembly 308 from rotating. The torque backup assembly 305 is also connected to a guide beam GB which is connected to a rig derrick (not shown).

A torque frame 310 transfers torque from the top drive system TT to tubulars (e.g. casing) engaged by a slip system (described below) of the system 300. This torque frame 310 also transmits hoisting loads to the main shaft 302 and transmits torque to the slips (described below).

A link tilt assembly 320 has arms 322 which support a single joint elevator 330. The single joint elevator 330 picks up a single tubular (e.g. a single joint of casing) from a rig's V-door and hoists the tubular to a vertical position for stabbing at wellcenter.

The tops of the arms 322 of the link tilt assembly 320 are pivotably connected to the swivel assembly 308 and are movable by powered cylinder apparatuses 312 connected to the arms 322 and to the swivel assembly 308. Each arm 322 includes a link 324 which transfers load from the elevator 330 to the arms 322 while allowing the elevator 330 to pivot with respect to lower portions of the system 300.

A guard 314 connected to brackets 327 connected to the torque frame 310 protects various cylinders, plumbing and pneumatic valves. A manifold 316 distributes power fluid for the apparatus 312, houses valves of the link tilt assembly 320, and provides a mounting location for various fittings of the link tilt assembly 320.

A receiver (or "bell guide") 318 facilitates entry of a tubular into the slip body 340. A bottom guide 377 (see FIG. 18A) is above the receiver 318.

As shown in FIGS. 14D and 14E, a compensator apparatus 326 with three compensator assemblies 326*a*, 326*b*, 326*c* connected to brackets 327 (connected to the torque frame 310 via a splined structure 364) and to the main shaft 302 at their lower ends. These compensator assemblies transfer the weight of the torque frame 310, the slip body 340, and a tubular gripped by the slips to the main shaft 302, reducing tubular thread damage during joint make-up by the system 300.

A slips cylinder assembly 350 has three powered slips cylinder apparatuses 350*a*, 350*b*, and 350*c* which move the slips 374 (described below) to grip and release a tubular. Each powered slips cylinder apparatus 350*a*, 350*b*, 350*c* has a corresponding manifold 352*a*, 352*b*, 352*c* which provides a plumbing bulkhead for hoses, valves, pressure test fittings and fittings for a particular power slips cylinder apparatus.

Each of the powered slips cylinder apparatuses 350*a*, 350*b*, 350*c* has one end connected to the torque frame 310 and another opposite end connected to a levelling beam 360. Slips 374 described below are connected to links 376 connected to the levelling beam 360. Upon activation, the three powered slip and cylinder apparatuses move in unison, thereby moving levelling beam 360 and the slips 374 to contact and clamp a tubular within the system 300 or to release it.

Bayonet mounts 319 on the torque frame 310 are used to releasably connect the slip body 340 to the torque frame 310. Projections 313 on the torque frame 310 corresponding to the recesses 343 on the slip body 340 insure proper positioning of the slip body 340. Vertical loads and torque are transmitted through the bayonet connection.

As shown in FIGS. 14D, 14E, 14H, 14I, 14M, and 14N, the main shaft 302 has a splined portion 302*a* which transmits torque from the main shaft 302 to the corresponding splined structure 364 of the torque frame 310. This torque is then transmitted to the slips 374. A bushing assembly 367 in which moves a portion 302*b* of the main shaft 302 maintains the main shaft 302 coaxial with the torque frame 310.

FIG. 14P is an enlargement of part of the system as shown in FIG. 14N and shows the interface between the main shaft 302*b* and the busing assembly 367.

FIG. 14Q is an enlargement of part of the system as shown in FIG. 14N illustrating the connection of a piston 326*p* of the compensator 326*a* to a retainer frame 369.

FIG. 14R is an enlargement of part of the system of FIG. 14N and shows the load shoulder 307 of the main shaft 302.

A bottom thread 302*t* of the main shaft 302 connects the main shaft 302 to a mandrel 370*c* which provides a connection for a fill-and-circulation tool 370. The fill-and-circulation tool 370 has a mud valve 372 that opens automatically upon the entry of tubular into the system to fill a tubular (e.g. casing) with drilling mud upon insertion of the tubular into the tool and closes automatically to block leakage of mud upon removal of the tubular.

A slips control system includes the levelling beam 360, a catch plate assembly 380, an actuation valve 378, the powered slips cylinder apparatuses 350*a*-350*c*, and the manifolds 352*a*-352*c*. Projections 382 project from part 384 of the levelling beam 360. The projections 382 move in unison and provide a "push-down" force to engage the slips 374 on a tubular with force from the slip cylinder apparatuses and allow the application of torque without slipping (or with minimal slipping) of the slips 374 on the tubular. The projections 382 are shown in contact with the tops of the slips 374 in FIG. 18C. The catch plate assembly 380 has a tubular structure with a concentric inner tube 380*t* that rides on the mandrel 370*c*. Gussets 380*b* locate the inner tube 380*t* with respect to an outer tube 380*r* and also support a bottom plate 380*a*. An actuator plate 380*p* (see, e.g., FIG. 18A) of the tool 370 attached to the bottom plate 380*a*.

FIGS. 15A-15F illustrate the link tilt assembly 320 and the swivel assembly 308 and various details of their parts and components. The torque backup assembly 305 includes a slide assembly 400 with slide members 402 each connected to a slide arm 404 connected to a stabilizer ring 406 which is bolted with bolts 408 to an adapter ring 412 of the link tilt assembly 320. The sliding members allow the accommodations of different guide beam placements in a derrick and allow adjustability to accommodate a variety of top drive torque reaction beams. The assembly 305 also holds the pivoting arms in a desired orientation and direction.

The adapter ring 412 is secured with bolts 422 on one side of a turntable bearing 412*a* and the other side is bolted to a link tilt frame 414. Turnbuckle apparatuses 416 secured to a mount 418 on the stabilizer ring 406 allow adjustment of the slide arms to the guide beam GB.

The slide members 402 move up and down on the guide beam GB (FIG. 14B). The manifold 316 is secured to the link tilt frame 414. A load holding manifold 424 is directly connected to the cylinder apparatuses 312 and prevents movement of the link tilt assembly 320 if a hose breaks. A load holding valve 424*a* (shown schematically) prevents hydraulic fluid flow out of the cylinder apparatuses unless a pilot signal is received by the valve 424*a*. A bracket 426 extends between the arms 322 which move in unison. The link tilt frame 414 supports a service loop bulkhead 430 and connections 446 for the service loop; and protects parts of the system, e.g. when the system is horizontal or on a flat surface.

Swivel fittings 438 allow pivoting motion of the cylinders apparatuses 312 without limitation by hoses between the manifold 316 and the apparatuses 312.

A link tilt swivel 440 which includes the body 414 allows a plurality of pressurized circuits (e.g. eight) to be in fluid communication between the link tilt assembly 320 and the rotating torque frame 310.

The link tilt swivel 440 includes an outer body 440*j*, a stem 440*a*, seals 440*b*, bearing 440*c*, retaining ring 440*d*, cover plate 440*e*, and dust shield 440*f*. The stem 440*a* is positioned on the main shaft 302 with a shoulder 440*g* and held in place, e.g. with a friction lock clamp 440*h* (FIG. 17C). The shoulder 440*g* and clamp 440*h* transfer vertical loads from the link tilt assembly 320 to the main shaft 302. Hydraulic pressure is reduced by valves 440*i* (FIG. 15A) in an inlet manifold 316*b* prior to the pressure passing through the swivel. This reduces the pressure on the seals and extends their life. The pressure is then increased with an hydraulic booster 491 (FIG. 14H) to the required working pressure to provide sufficient power for desired operations.

Hoist rings 442 are connected to the link tilt frame 414. A pressure filter 452 connected to the inlet manifold 316*b* receives pressurized fluid from the service loop and transmits it to the inlet manifold 316*b*. This filter 452 protects pressurized hydraulic circuits of the system from particle contamination. A filter regulator 454 controls air pressure supplied from the service loop to the pneumatic compensators 326*a*-326*c*. The inlet manifold 316*b* provides hydraulic oil distribution and various control functions to the hydraulic components in the system.

Figure 15A:
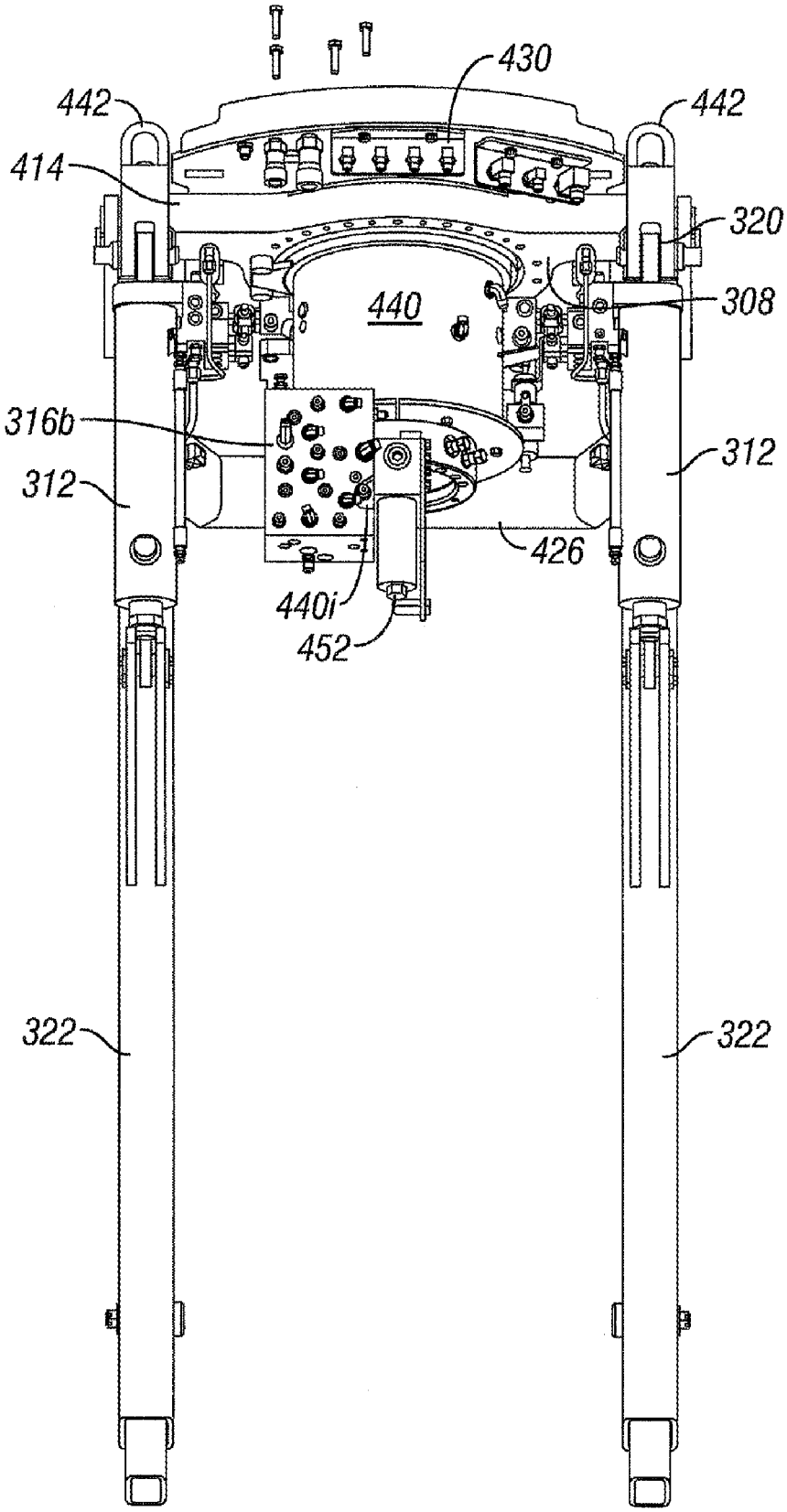
FIG. 15A is a perspective view of part of the system as shown in FIG. 14A.
Figure 15B:
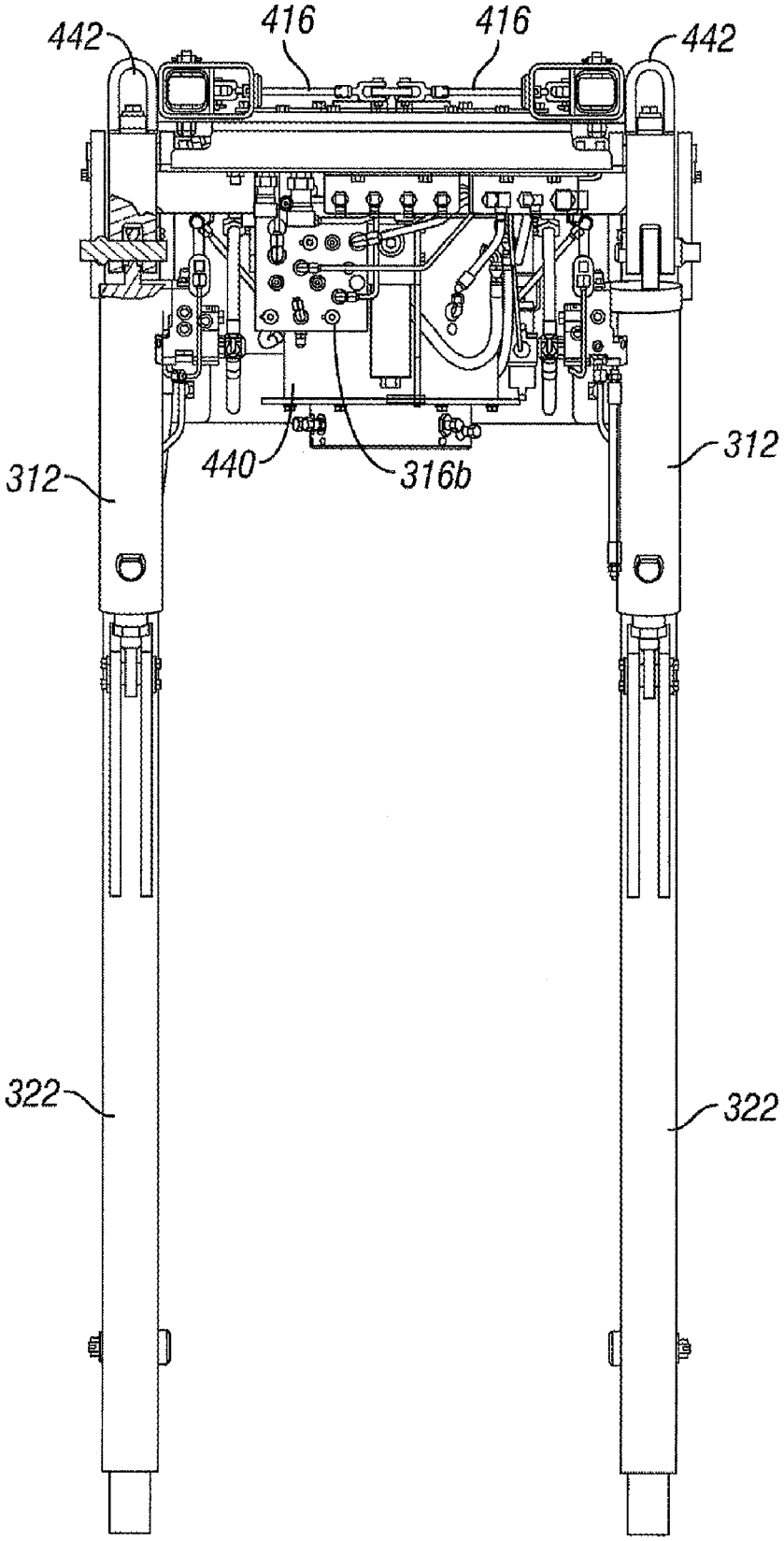
FIG. 15B is a perspective view of part of the system as shown in FIG. 14A.
Figure 15C:
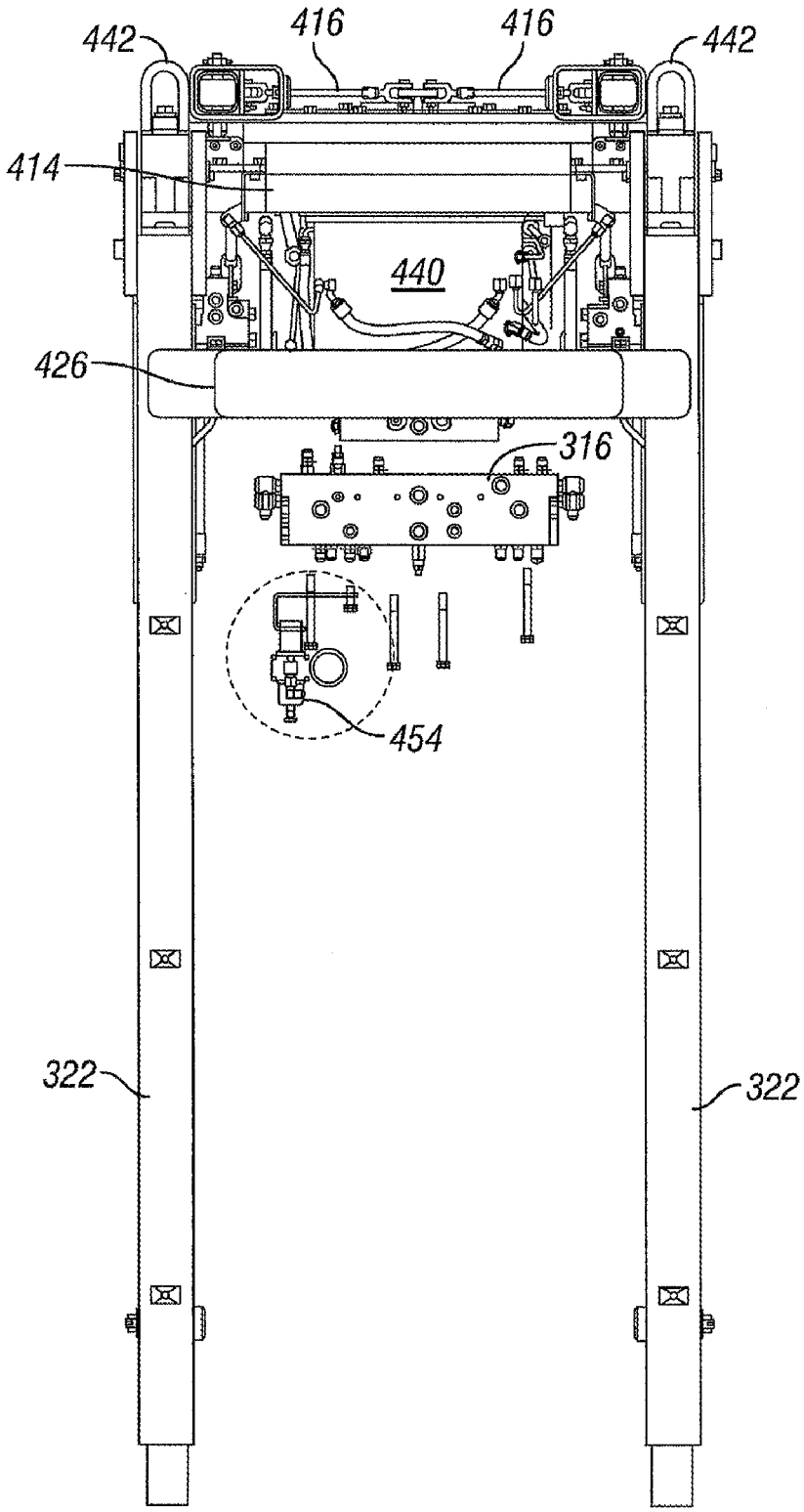
FIG. 15C is a perspective view of part of the system as shown in FIG. 14A.
Figure 15D:
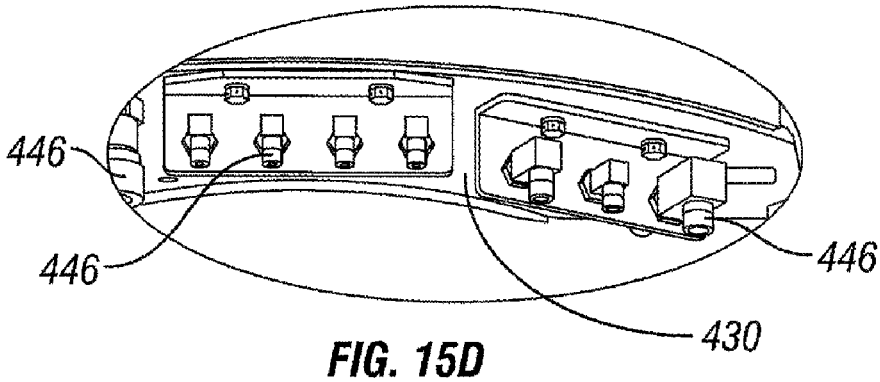
FIG. 15D is an enlargement of part of the system as shown in FIG. 15A.
Figure 15E:
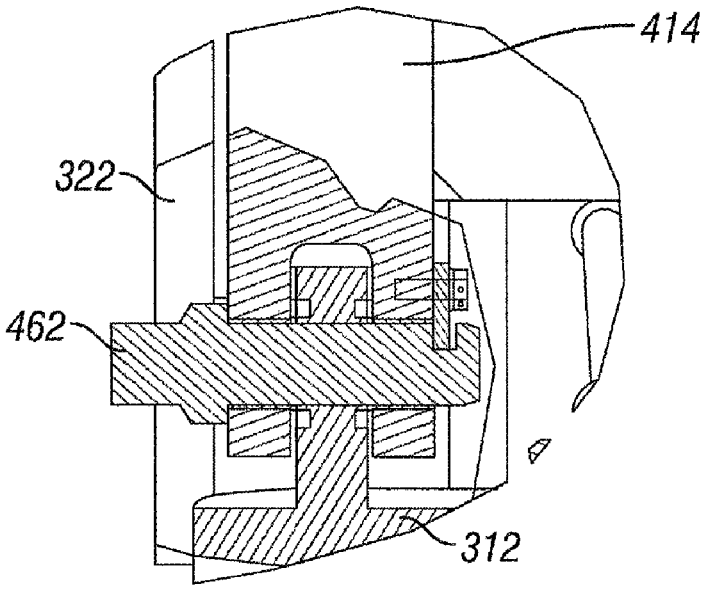
FIG. 15E is a cross-section view of the system as shown in FIG. 15A.
Figure 15F:
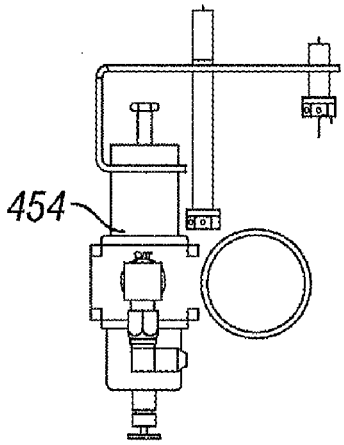
FIG. 15F is an enlargement of part of the system as shown in FIG. 15A.
Figure 15G:
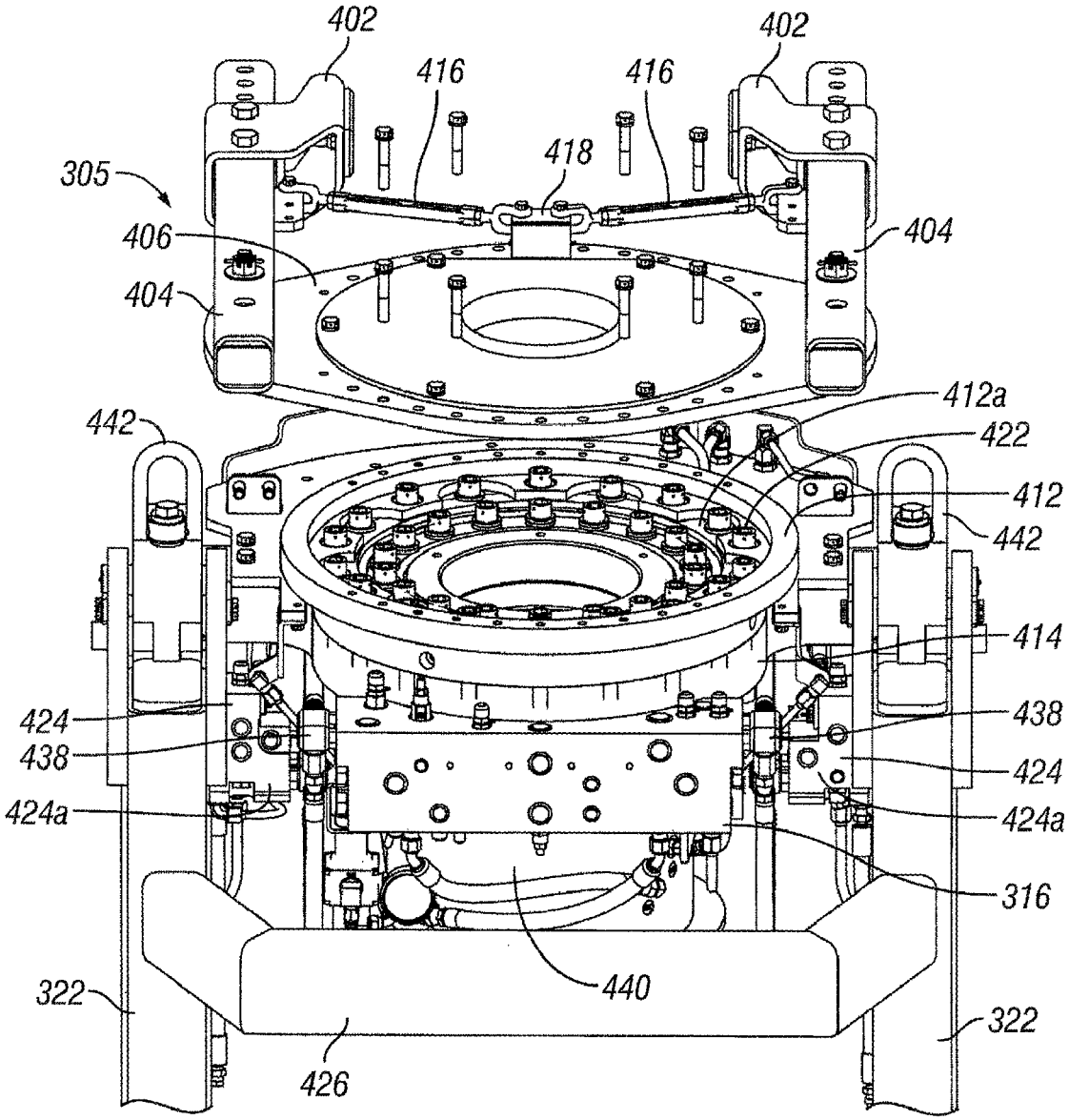
FIG. 15G is a perspective view, partially exploded, of part of the system as shown in FIG. 15A.

FIG. 15E shows the connection of a powered cylinder apparatus 312 to the link tilt frame 414. A pin 462 secures an end of the apparatus 312 to the frame 414.

Figure 16A:
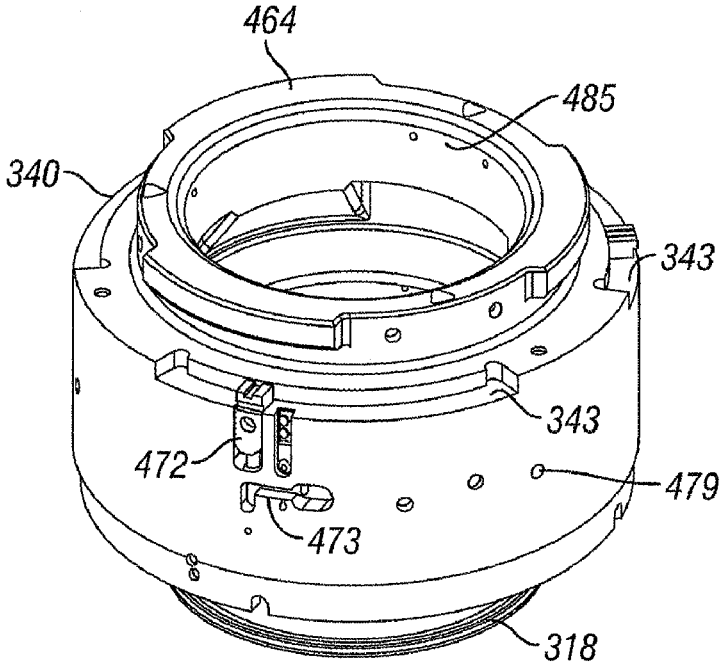
FIG. 16A is a; top perspective view of a slip body of the system of FIG. 14A.
Figure 16B:
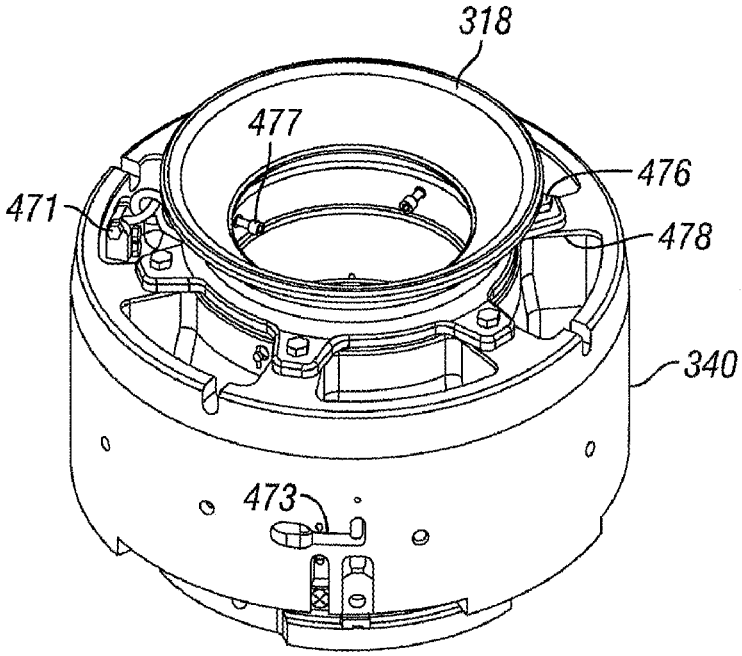
FIG. 16B is a bottom perspective view of the slip body of FIG. 16A.

FIG. 16A is a top view and FIG. 16B is a bottom view of the slip body 340. Bayonet mounts 464 on the body 340 act with the bayonet mounts of the torque frame 310 to secure the body 340 to the torque frame 310. Locks 472 are movable into engagement with projections 313 of the torque frame 310 to releasably hold the bayonet mounts secure during service.

Grease fittings 479 provide a lubrication port for greasing the slips 374. The receiver 318 (or "bell guide") is bolted to the body 340 with bolts 476. Bolts 477 bolt a bottom guide 377 to the body 340. The recesses 478 are optional casting voids for weight reduction.

Figure 16C:
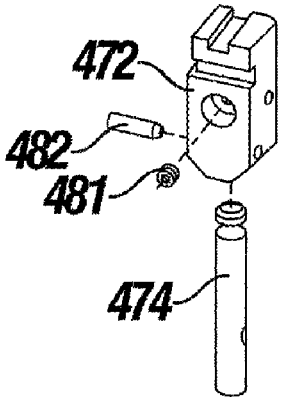
FIG. 16C is an enlargement of a lock of the slip body of FIG. 16A.

FIG. 16C shows a locking pin 474 for holding the lock 472 in position. A pin 482 holds the pin 474 in place. A grease fitting 481 is used for lubricating the lock 472. A pin 473 locks the lock 472 in engaged position.

Slips 374 as described below are located in an interior bowl channel 485 in the body 340.

Figure 18A:
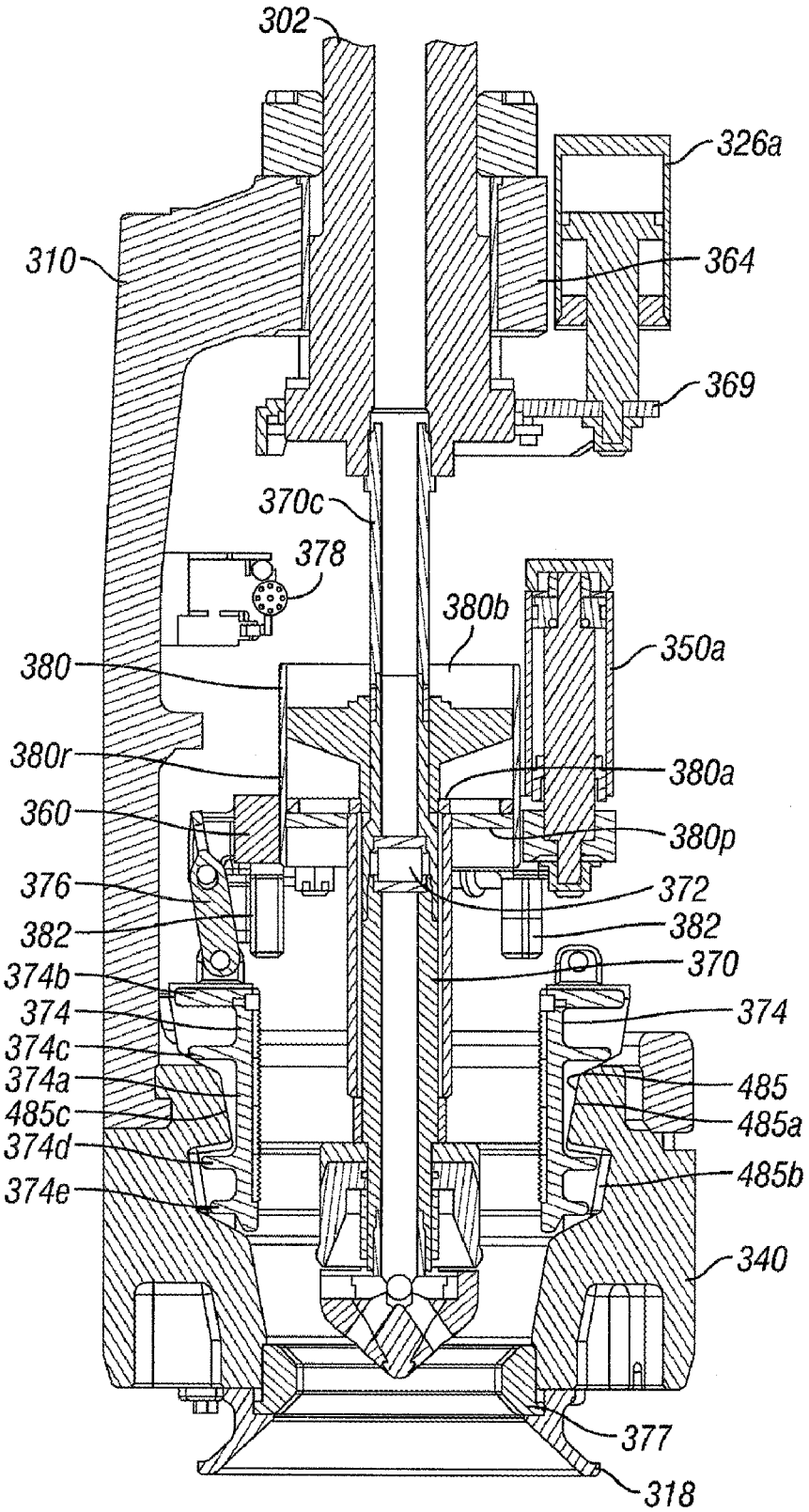
FIG. 18A is a cross-section view of part of the system of FIG. 14A.

FIG. 18A shows part of the system of FIG. 14A. The torque frame 310 houses a detection valve apparatus which has a valve 378 that is operated by contact with a catch plate assembly 380 when the catch plate assembly 380 is adjacent the detection valve apparatus 378. The catch plate assembly 380 is around a mandrel 370*c*. The valve 378 directs hydraulic power fluid to the apparatuses 350*a*-350*c* which are connected to the torque frame 310 (e.g. see the connection of the apparatuses 220, FIGS. 7A, 7B).

Figure 16D:
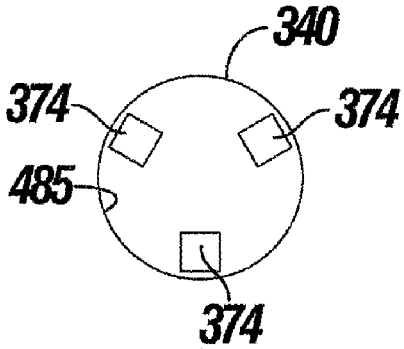
FIG. 16D is a top schematic view of the body 340 with slips 374.

Each of three slips 374 is spaced apart around the bowl 485 (as shown schematically in FIG. 16D). Each slip 374 is pivotably connected to a lower end of a link 376 (which may be like any link disclosed herein, including, but not limited to, links as in FIG. 7A, FIG. 8A and FIG. 8B). An upper end of each link 376 is pivotably connected to the levelling beam 360. For illustration purposes one slip 374 (the one to the right side in FIG. 18A) is shown without a link 376 in FIG. 18A.

The tool 370 includes a mud valve 372.

Figure 18D:
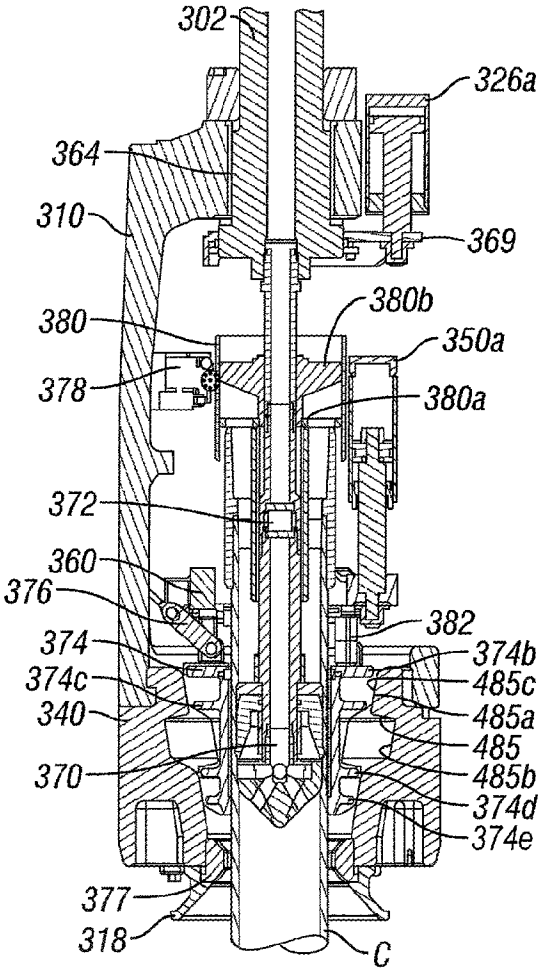
FIG. 18D is a cross-section view of part of the system of FIG. 14A showing a step in a method according to the present invention after the step of FIG. 18C.
Figure 18C:
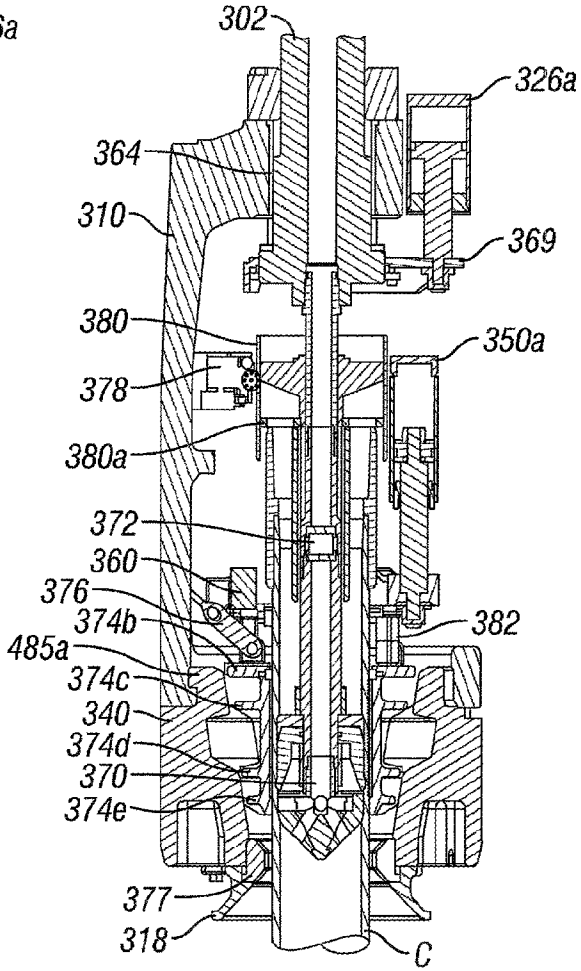
FIG. 18C is a cross-section view of part of the system of FIG. 14A showing a step in a method according to the present invention after the step of FIG. 18B.
Figure 18B:
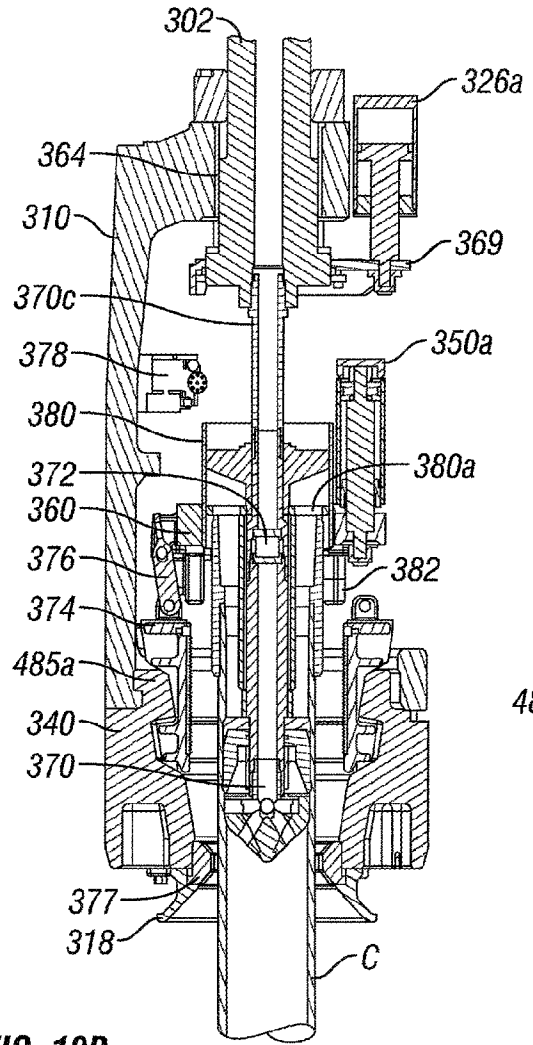
FIG. 18B is a cross-section view of part of the system of FIG. 14A showing a step in a method according to the present invention.

FIGS. 18B-18D illustrate steps in a method according to the present invention.

Figure 14T:
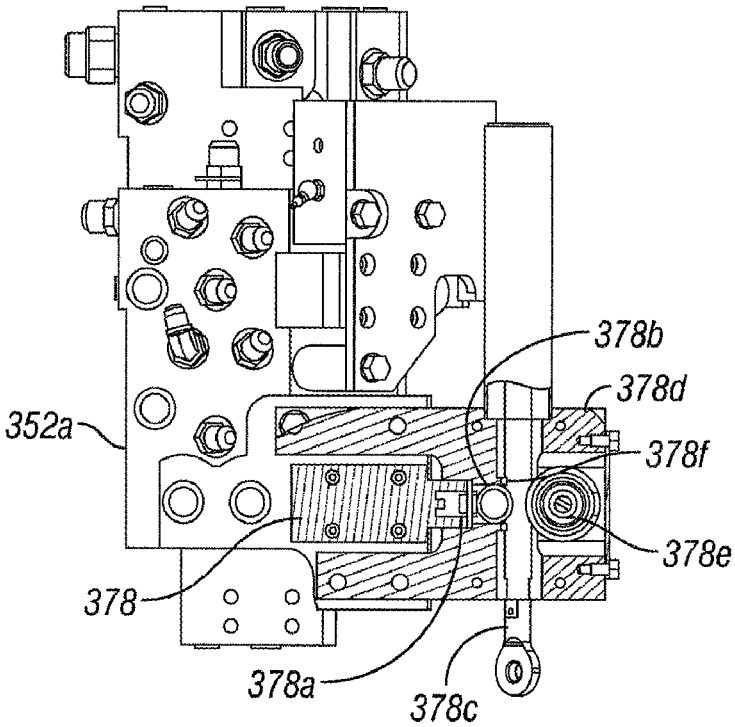
FIG. 14T is a partial view partially in cross-section of the part shown in FIG. 14S.

Setting of the slips 374 is performed automatically when a tubular enters the receiver or bell guide 318 at the bottom of the system 300 and continues traveling upward inside the slip body 340 and torque frame 310. When the tubular contacts the catch plate assembly 380 it begins pushing the catch plate assembly upward. The catch plate assembly 380 is guided by the mandrel 370*c* which not only guides the catch plate assembly 380 but also acts as an adapter to allow attachment of various makes of fill-and-circulation tools When utilizing the tool 370, the catch plate assembly 380 is bolted to a tool actuator plate (FIG. 18A) and thus opens the tool 370 (opens the mud valve 372) as the catch plate assembly 380 is moved upward. When the tubular is withdrawn from the system 300, the catch plate assembly 380 follows the tubular down and thus closes the tool 370 and prevents, or greatly reduces mud spillage. As the catch plate travels further, upward it contacts the detection valve apparatus (which, in one aspect, has a cam operated valve 378 actuatable by the catch plate 380*p* when the catch plate is pushed up far enough into the tool by the casing or other tubular) which then directs hydraulic fluid from the manifolds 352*a*-352*c* to the slip cylinder apparatuses 350*a*-350*c* which push the levelling beam 360 and the slips 374 down to contact the tubular. When the slips 374 have contacted the tubular, the projections 382 on the levelling beam 360 then contact the top of the slips 374 and force in the slip cylinder apparatuses is applied to the slips 374 to increase the grip force and allow the application of torque through the slips 374. A rod 378*c* (FIG. 14T) is attached to the levelling beam 360 with a clevis and the rod is held in a vertical position and guided by a roller 378*e* mounted in a bracket 378*d*. A ball 378*b* located in a hole in the bracket 378*d* is trapped between the rod 378*c* and a spring loaded actuator 378*a* on the cam valve 378. As the slips approach their final position, the levelling beam 360 has pulled down the rod 378*c* and the ball 378*b* is pushed into a depression 378*f* in the rod by the spring force in the valve actuator 378*a*. This allows the actuator 378*a* to shift the valve 378 directing pressurized fluid to the pressure booster 491 which boosts the pressure in the slip cylinder apparatuses 350 to further increase the grip force on the tubular. When the pressure reaches a pre-determined level in the slip cylinder apparatuses, it moves a piston to actuate a sequence valve which directs medium pressure (approximately 800 psi) fluid to the slips set feedback line connected to the slips set indicator 730*f* on the control panel 730. Thus the slips set indicator informs the operator that the two criteria for successful slip set have been met: 1) the slips are in their final set position and 2) the pressure in the slip cylinder apparatuses is at the required level to maximize grip force.

As shown in FIG. 18A, the system 300 is armed to close ("armed to close" occurs when the tool operator moves a control valve lever-on an operator panel (see FIG. 19) to a "slips set" position; and at this point the slips do not yet set; instead the valve 378 is "armed" such that when it is contacted by the catch plate assembly 380 it then directs hydraulic fluid to the slip cylinders to set the slips) and the compensators 326*a*-326*c* are in mid-stroke (the splined part of the shaft 102 is on the splined part 364 of the torque frame 310). The catch plate assembly 380 is below the detection valve apparatus and the mud valve 372 is closed to block flow from the center channel of the shaft 302 down to the bottom of the tool 370. The slips 374 are against the side of the bowl 485.

FIG. 18B illustrates a tubular, e.g. a piece of casing C, entering through the receiver or bell guide 318 and the bottom guide 377 (due to the lowering of the system around the casing) into the system. The bottom guide 377 is optional and is, in certain aspects, a circular piece with an interior channel therethrough with an inner diameter that closely matches the tubular being run. FIG. 18C shows the valve 378 of the detection valve apparatus detecting the catch plate assembly 380 which has moved adjacent the valve 378. The detection valve 378 is vertically positioned within the torque frame 310 so that when the catch plate assembly 380 activates the valve it causes the slips 374 to set in the proper vertical position on the tubular. This eliminates damage to the tubular, and to the tubular coupling, e.g. damage caused by manual setting of the slips in an incorrect location on the tubular.

The slip cylinder apparatuses 350*a*-350*c* are activated and move the levelling beam 360 down so that the projections 382 contact the tops of the slips 374 which have pivoted on the links 376 into position beneath the projections 382. Further downward motion moves the slips 374 to contact the exterior of the casing C. The compensators 326*a*-326*c* are still in mid-stroke (the shaft 302 has not moved with respect to the torque frame 302 on the splined part 364), the mud valve 372 is open, and the catch plate assembly 380, now detected by the detection valve apparatus, is in a "high" position.

As shown in FIG. 18D, the slips 374 are set on the casing C and the compensators 326*a*-326*c* have moved to the end of their stroke as the shaft 302 moves with respect to the torque frame 310, moving with the shaft 302, the tool 370 and the mud valve 372. Operations (e.g. stabbing, spin-in and torquing) can now commence with the casing C using the top drive to rotate the running tool system and the now-attached casing. Operations according to the present invention with a system according to the present invention are not limited to these functions and can include any operation involving hoisting and/or lowering the casing string (or other tubulars or tubular string) and/or rotating the casing string; e.g., vertically reciprocating a casing string and/or drilling with casing.

The slips 374 have a body 374*a* with four spaced-apart bars 374 *b, c, d, e*. The bowl 485 has a top ridge 485*a* which is initially received and held between the bars 374*c*, 374*d* and the bars 374*d*, 374*e* rest initially in a tapered recess 485*b* of the bowl 485. As shown in FIG. 18C, when the slips 384 are moved toward the casing C, the bars 374*b*, 374*c* move adjacent a tapered interior surface 485*c* of the ridge 485*a* and the bars 374*d*, 374*e* move adjacent the tapered interior of the recess 485*b* of the bowl 485 The tapered surfaces facilitate movement of the slips 374 to contact the casing C and abutment of the slips 374 against these surfaces maintains them in position when the slips 374 are set against the casing C.

Figure 19:
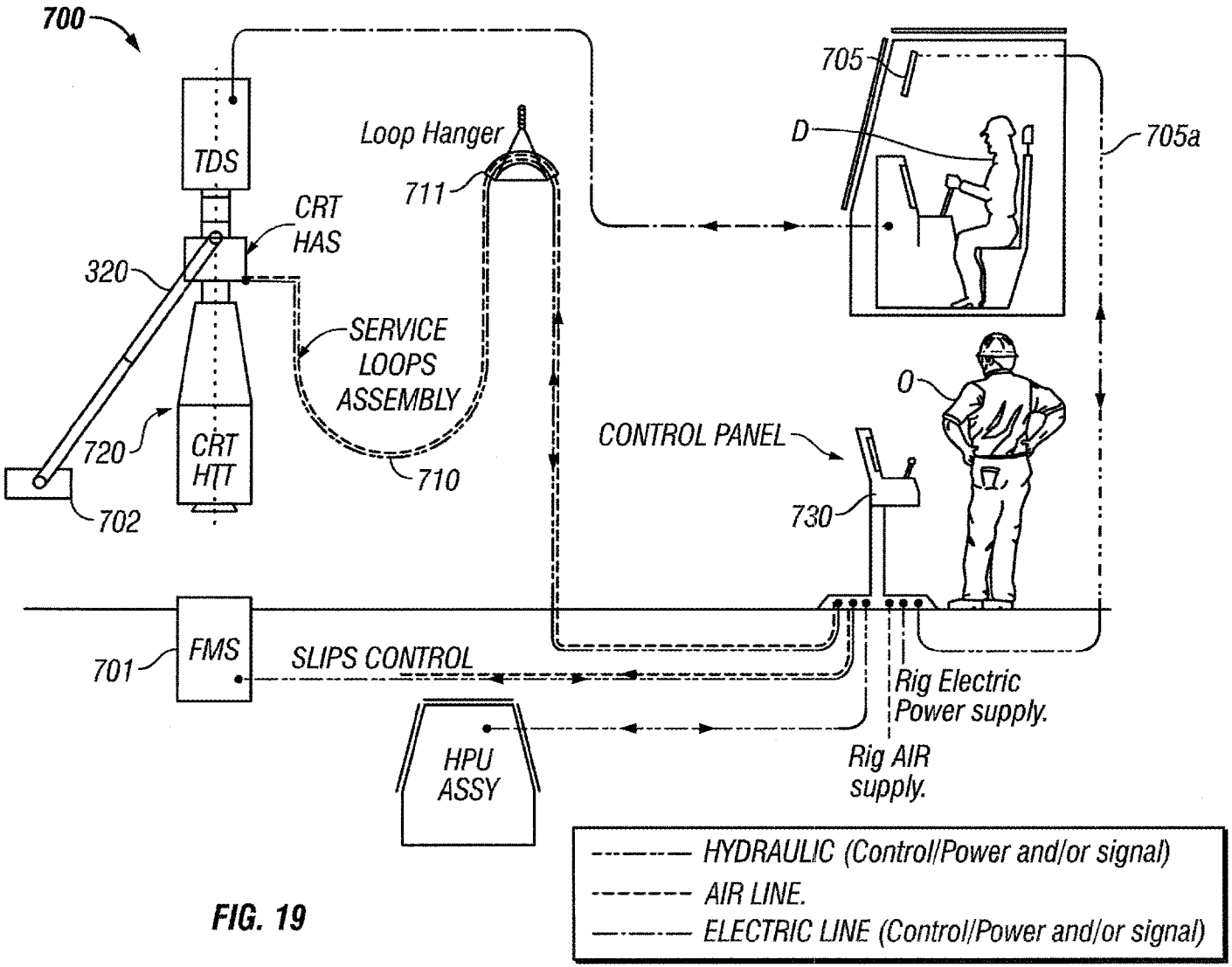
FIG. 19 is a schematic view of a system according to the present invention.
Figure 20A:
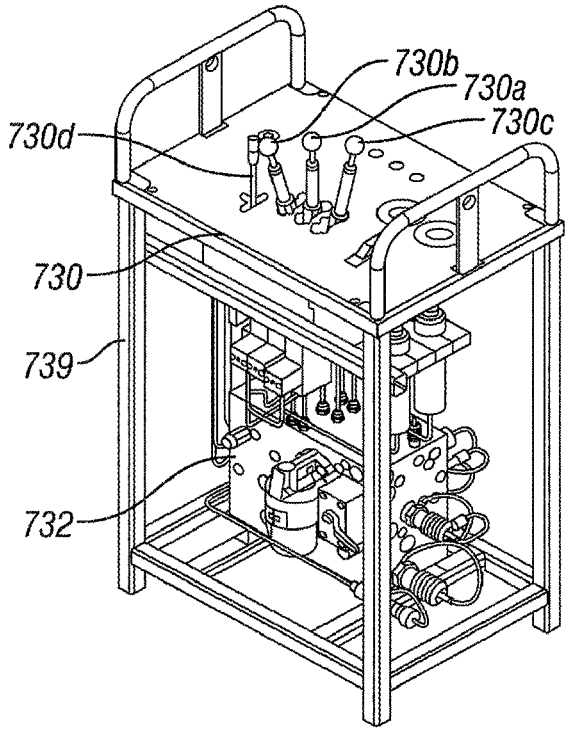
FIG. 20A is a perspective view of a control panel of the system of FIG. 19.
Figure 20B:
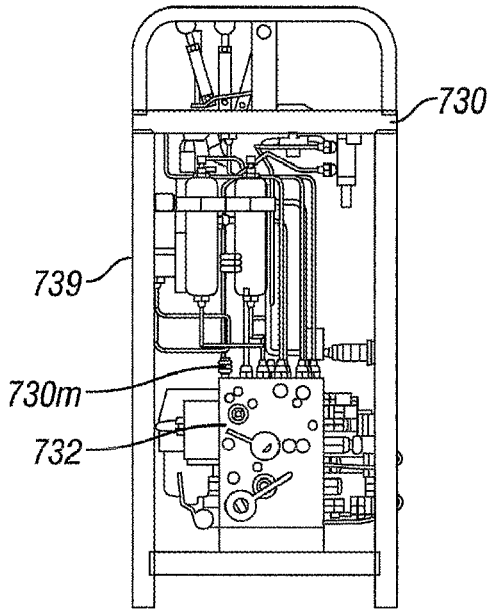
FIG. 20B is a side view of the control panel of FIG. 20A.
Figure 20C:
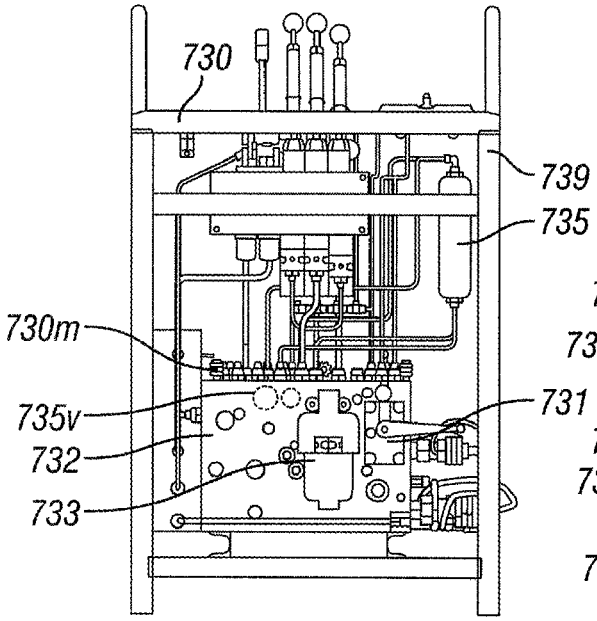
FIG. 20C is a front view of the control panel of FIG. 20A.
Figure 20D:
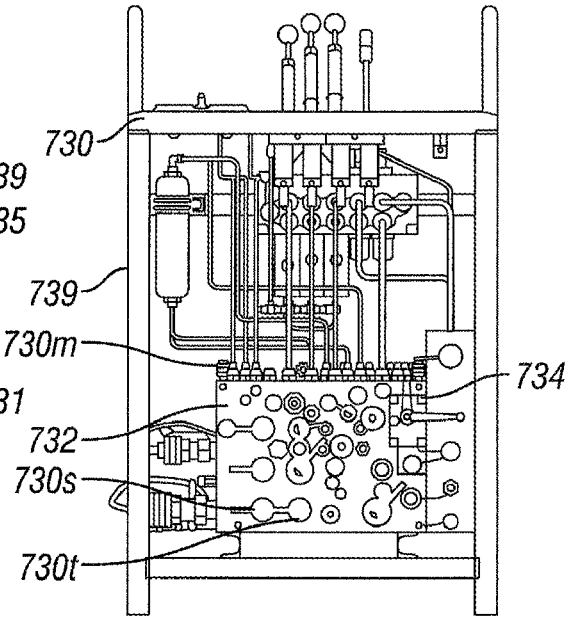
FIG. 20D is a rear view of the control panel of FIG. 20A.
Figure 21A:
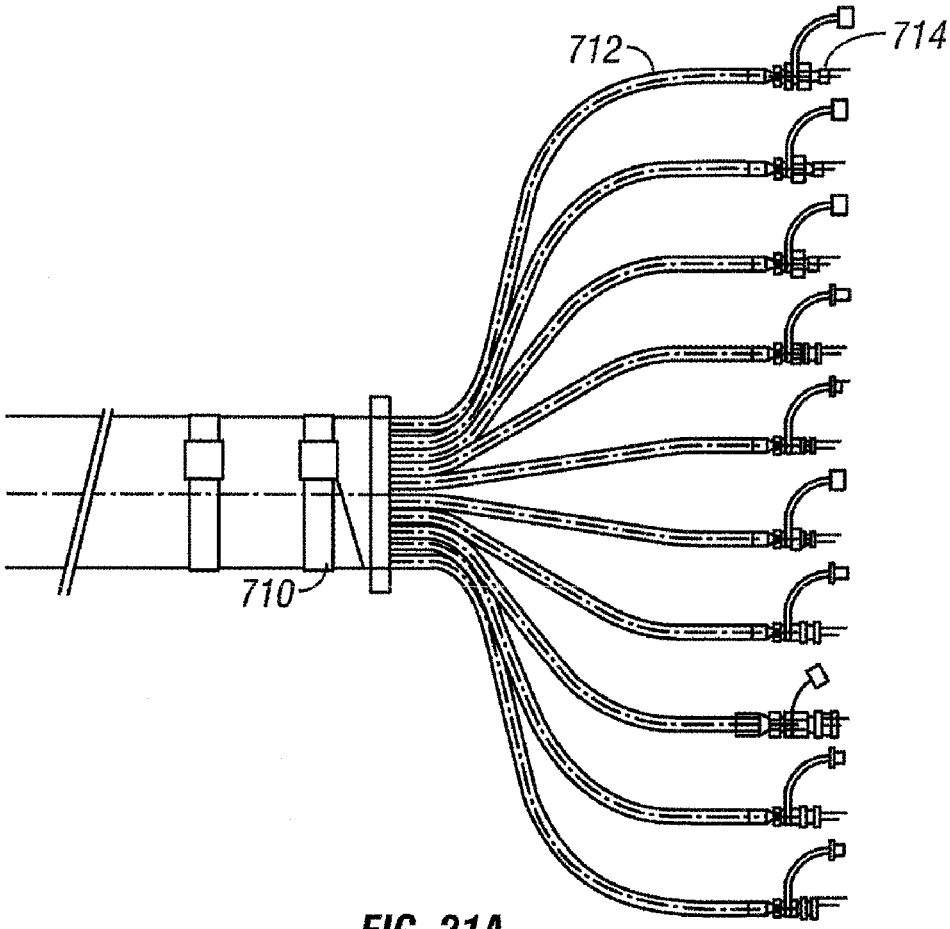
FIG. 21A is a top view of a cable bundle for systems according to the present invention.
Figure 21B:
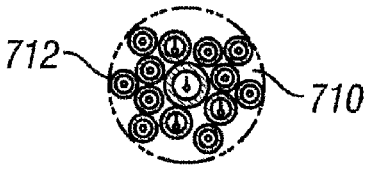
FIG. 21B is a cross-section view of the cable bundle of FIG. 21A.
Figure 21C:
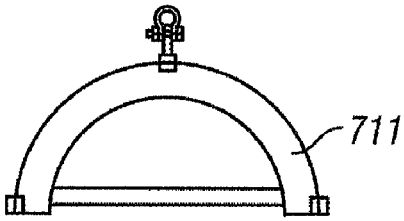
FIG. 21C is a side view of a service loop support according to the present invention.

In certain methods according to the present invention, a control system such as the control systems in FIGS. 1E, 3, and 19 uses operator input to control various functions. This operator input can be either electric or manual (hydraulic/pneumatic). In one version according to the present invention, an electric version, a control panel is used with components, switches, touch screens, etc. to provide an operator interface and is connected to a tool according to the present invention via an electric cable. A mechanical version according to the present invention utilizes a control panel containing hydraulic/pneumatic actuators, valves, and indicators and is connected to the tubular running tool via a multi-passage service loop. An auxiliary indicator panel (on-site or located remotely) can be utilized to provide indicator and feedback information to the driller (e.g. see FIG. 19 regarding a driller) or other interested party. The auxiliary panel can be operated by electrics, hydraulics, or pneumatics. An overview of such a system 700 is shown in FIG. 19.

A service loop 710 (see FIGS. 19 and 21A-21C) has a grouping of various diameter hydraulic and pneumatic hoses 712 arranged in a basically circular cross section and encased in a protective sleeve. For example, ten hoses may be grouped to make up a service loop. The service loop 710 can be of various lengths to accommodate various drilling rig applications and vertical travel requirements in the derrick. Each hose 712 in the service loop 710 carries fluid for a specific function or feedback signal between a tubular running tool 720 and a control panel 730. In one particular aspect, the ends of individual hoses 712 are terminated with quick disconnect fittings 714 which allow only one correct installation to the tubular running tool 720 on one end and the control panel 730 on the other end to prevent mis-connection of the hoses 712.

The service loop 710 utilizes one, two or more loop hangers 711 to position the service loop 710 in a derrick and to support the end of the service loop 710 at the tubular running tool 720. These hangers 711 are attached to a suitable support in the derrick and/or on a top drive to allow proper vertical travel in the derrick and to prevent entanglement with other rig equipment in the derrick. In one particular aspect the hangers 711 are made in a curved or "U" shape with an adequate radius to allow a 180 degree bend of the service loop 710 and to not damage the service loop 710 due to too small of a bend radius on the hoses 712.

The control panel 730 provides actuators and indicators to allow the operator to properly control the tubular running tool 720. The panel 730 is designed for ease of use in a rig environment with clear, legible markings and easy to use controls, even with gloved hands. The panel 730 provides the following operator functions and indicators and movable levers for accomplishing certain functions ("CRT" means tubular running tool or casing running tool):

- A lever 730*a* for CRT slips open and slips armed to close
- A lever 730*b* for a single joint elevator open and elevator armed to close
- A lever 730*c* for spider 701 open and spider closed
- A lever 730*d* for link tilt raise and lower, with a position hold feature. This lever 730*d* also actuates the link tilt 703 float function (in which the locking valves 424*a* on the link tilt cylinders 312 are opened) which allows the link tilt to follow a tubular vertically up or down depending upon the external loads imparted by the tubular
- A selector valve 730*e* to select the type of spider 701 being used (with or without feedback signal for slips closed)
- An indicator 730*f* for CRT slips closed
- An indicator 730*g* for spider slips closed
- An indicator 730*h* for single joint elevator closed
- An indicator 730*i* for "Stop Lowering" to tell the driller D to stop lowering the CRT over the tubular when the tubular has fully entered the CRT to the correct position
- A pressure gauge 730*j* to indicate pneumatic supply pressure
- A pressure gauge 730*k* to indicate hydraulic supply pressure
- An hydraulic supply shutoff and isolation valve 730*l*
- An hydraulic isolation valve 730*m* (optionally under a protective hinged cover PC) for pressure supply from the panel 730 to the CRT
- Pop-up buttons indicate to an operator "SIGNAL" and "NO SIGNAL"

Feedback signals from the running tool 720, spider 701, and single joint elevator 702 are used to operate the indicators. The indicators in certain aspects have a simple spring offset cylinder that extends or retracts when pressure is applied and reverts to the original position by spring force when the pressure is removed, or a "bubble" indicator that rotates and shows a different color upon pressure application, or an electrical light turns on or off via a pressure switch or other sensing device upon application and release of pressure.

The panel 730 is mounted in a framework 739 to position the panel 730 at a convenient working height for an operator O. The framework 739 also encloses and protects the components and provides a mounting and connection point for the service loop 710 and hydraulic and pneumatic supply connections. The panel 730 may be mounted in various ways to interface with a drilling rig; i.e., attached to a wall, supported by an articulated arm, free standing on a rig floor, etc.

The running tool 720, spider 701, and single joint elevator 702 control levers, in one aspect, have a spring loaded locking mechanism to lock the levers in each of the their operating positions. The lock is disengaged by pulling locking pins out of corresponding slots to move the levers. This prevents inadvertent operation due to bumping the panel, dropping a foreign object on the panel, etc.

The running tool 720, spider 701, and single joint elevator 702 control levers also incorporate a "gate" feature to interlock the levers with one another and prevent inadvertent operation of the tools and possibly dropping a tubular or a tubular string. The levers are directly connected to one end of spools of control valves such that pushing and pulling the lever imparts an axial movement to the spool. The spool movement opens and closes the working ports of the valve directing fluid flow to an appropriate function. At the opposite end of the spool is mounted a locking sleeve which moves axially with the spool. The locking sleeve has shaped openings in it to accommodate a locking pin. The locking pin is mounted perpendicular to the locking sleeve and passes through the locking sleeve openings. The locking pin is positioned in its bore with springs and pistons allowing it to engage and disengage with the locking sleeve. When the locking pin is moved in one direction a protrusion on the locking pin engages a matching recess in the locking sleeve thus preventing the locking sleeve and spool from moving axially. This effectively blocks activation of the valve and prevents actuation of the function the valve controls. When the locking pin is moved the opposite direction the protrusion on the locking pin disengages from the recess in the locking sleeve and allows the locking sleeve and spool to travel axially unimpeded. This allows the valve to actuate and direct fluid to the selected function.

The locking pin movement is controlled by applying fluid pressure to the pistons at each end of the locking pin. The unpressurized position of the locking pins is controlled by springs. By appropriately directing fluid pressure from the actuating ports of the valves to the appropriate piston, the valve spool can be locked in a specific position and prevented from moving, thus preventing operation of the function that spool controls. The various functions can thus be "gated" to prevent operation unless another function is in a specific state.

FIGS. 23A-23F illustrate a valve system 600 according to the present invention with a valve body 601, a gate assembly 603, and a lever 602 (or control handle) which is directly connected to one end of a spool 604 so that pushing and pulling the lever 602 imparts an axial movement to the spool 604. The lever 602 moves in a control handle body 605. The spool movement opens and closes working ports 606 of the valve system 600 directing fluid flow to an appropriate function. At the opposite end of the spool 602 is mounted a locking sleeve 608 which moves axially with the spool 604. The locking sleeve 608 has shaped openings 612, 614 in it to accommodate a locking pin 610. The locking pin 610 is mounted perpendicular to the locking sleeve 608 and passes through the locking sleeve openings 612, 614. The locking pin 610 is positioned with springs 616, 618 and pistons 622, 624 allowing it to engage and disengage with the locking sleeve 608. When the locking pin 610 is moved in one direction, a protrusion or cup 620 on the locking pin 610 engages a matching recess 626 in the locking sleeve 608 thus preventing the locking sleeve 608 and spool 604 from moving axially. This effectively blocks activation of the valve system 600 and prevents actuation of the function the valve controls. When the locking pin 610 is moved the opposite direction, the cup 620 on the locking pin 610 disengages from the recess 626 in the locking sleeve 608 and allows the locking sleeve 608 and spool 604 to travel axially unimpeded. This allows the valve to actuate and direct fluid to the selected function.

Figure 23A:
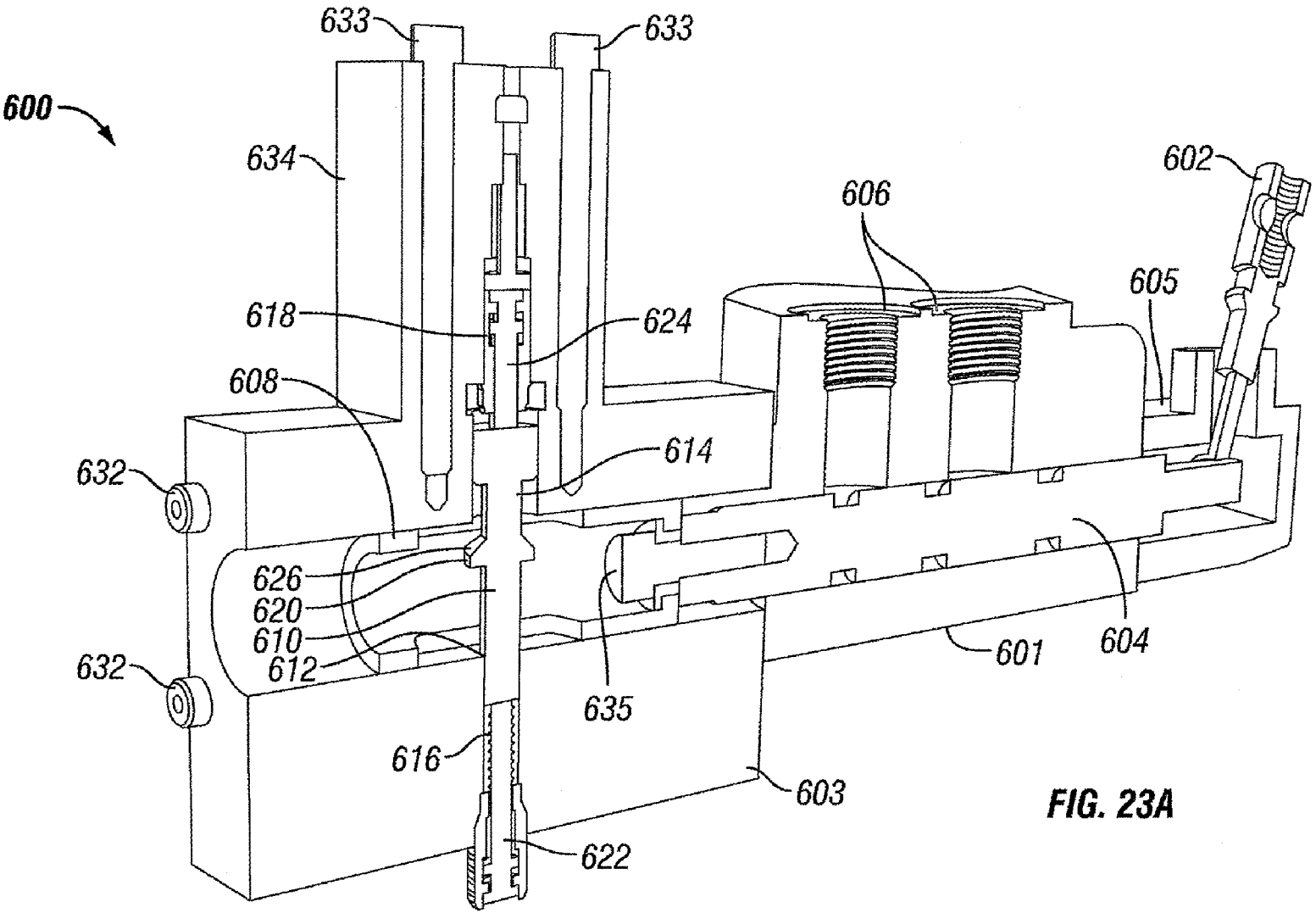
FIG. 23A is a perspective cross-section view of a valve assembly according to the present invention.
Figure 23B:
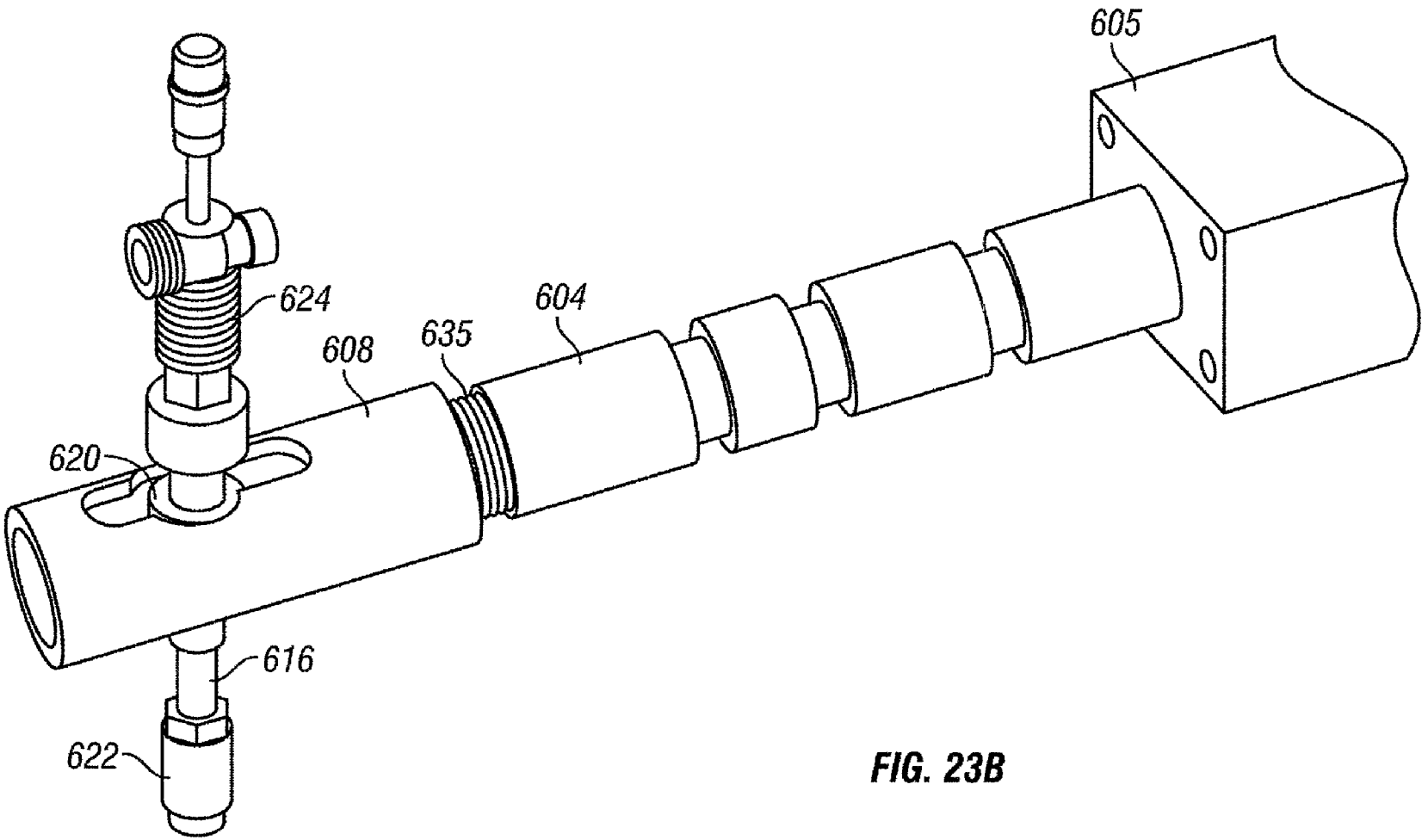
FIG. 23B is a partial view of parts of the assembly of FIG. 23A.
Figure 23C:
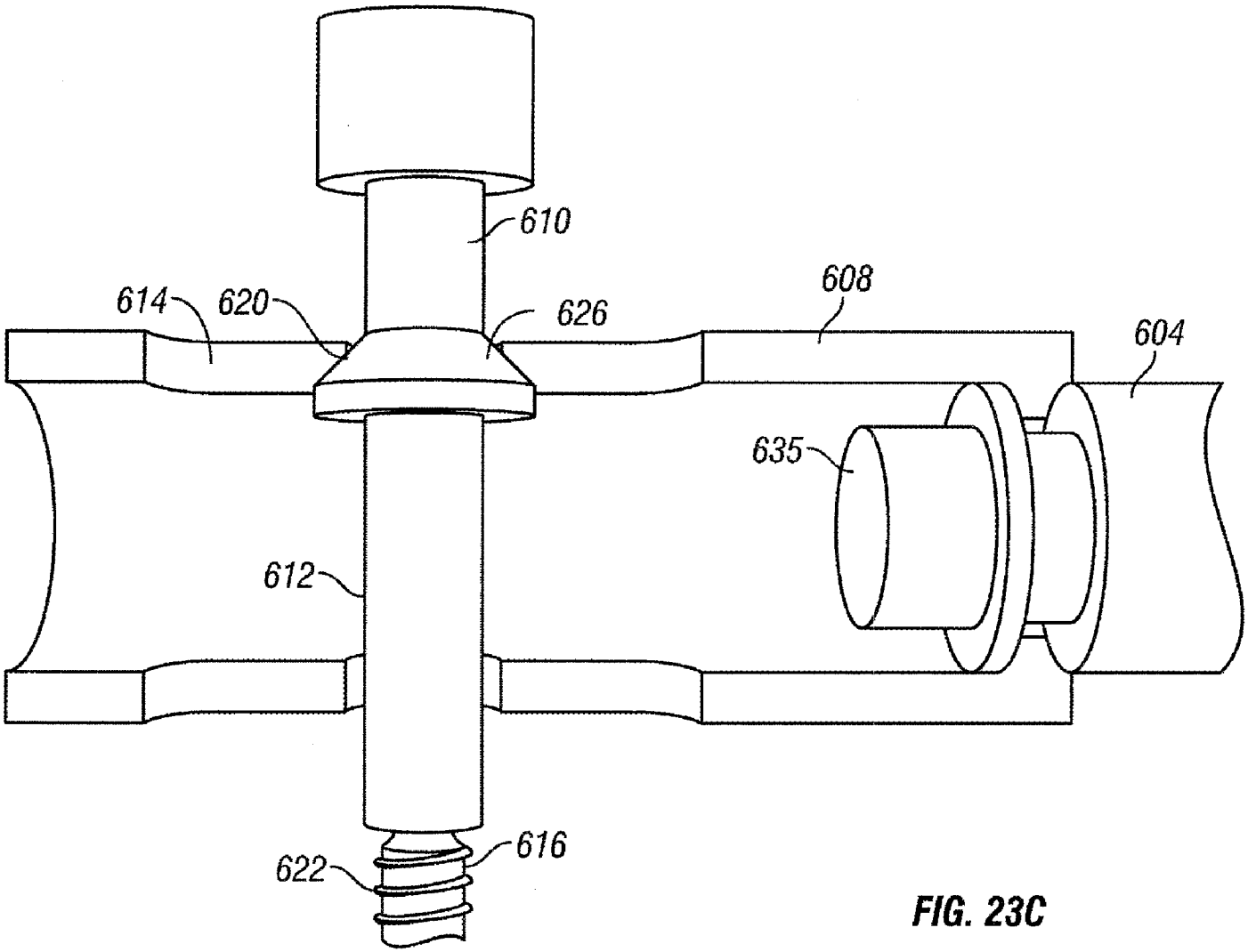
FIG. 23C is a cross-section view of part of the assembly of FIG. 23A.
Figure 23D:
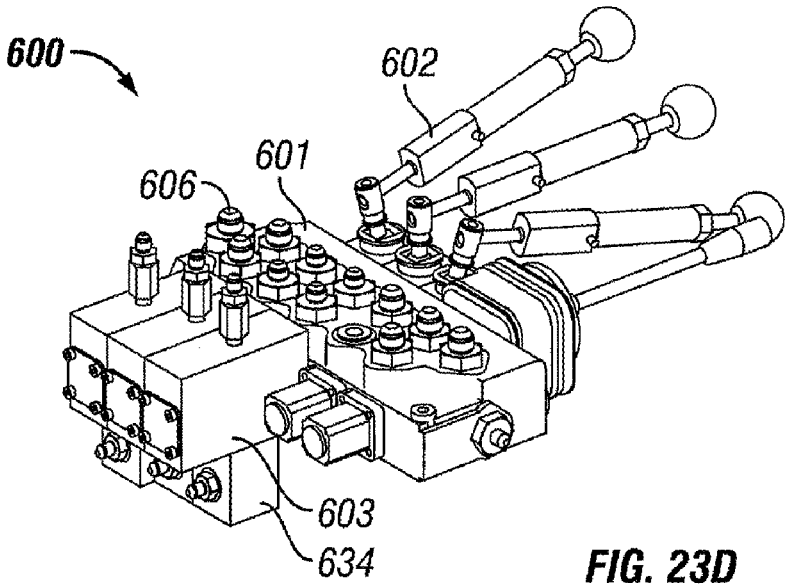
FIG. 23D is a perspective view of part of a control panel according to the present invention with valve assemblies as in FIG. 23A.
Figure 23E:
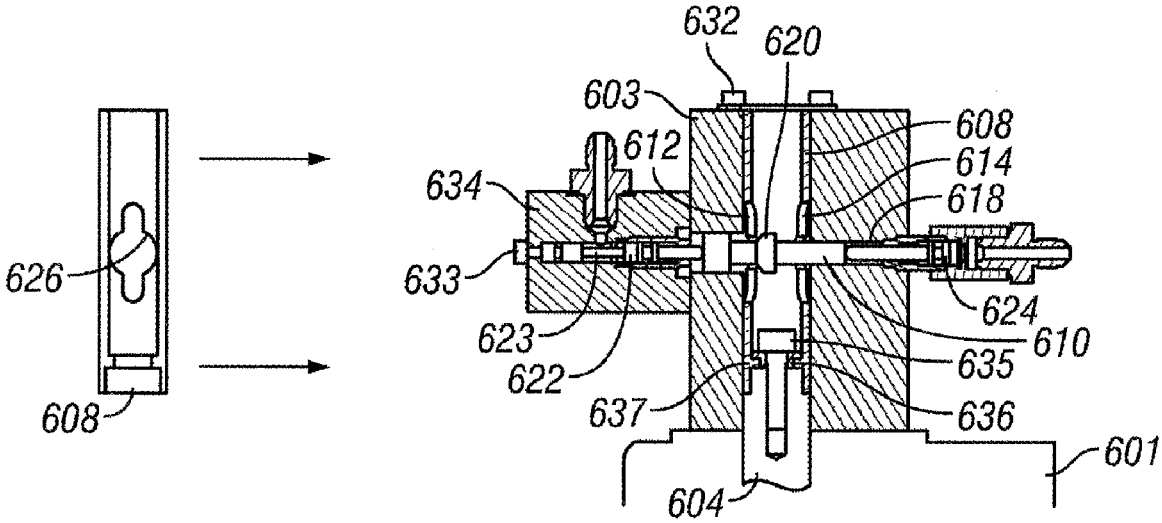
FIG. 23E is a side cross-section view of the part of the assembly of FIG. 23D.
Figure 23F:
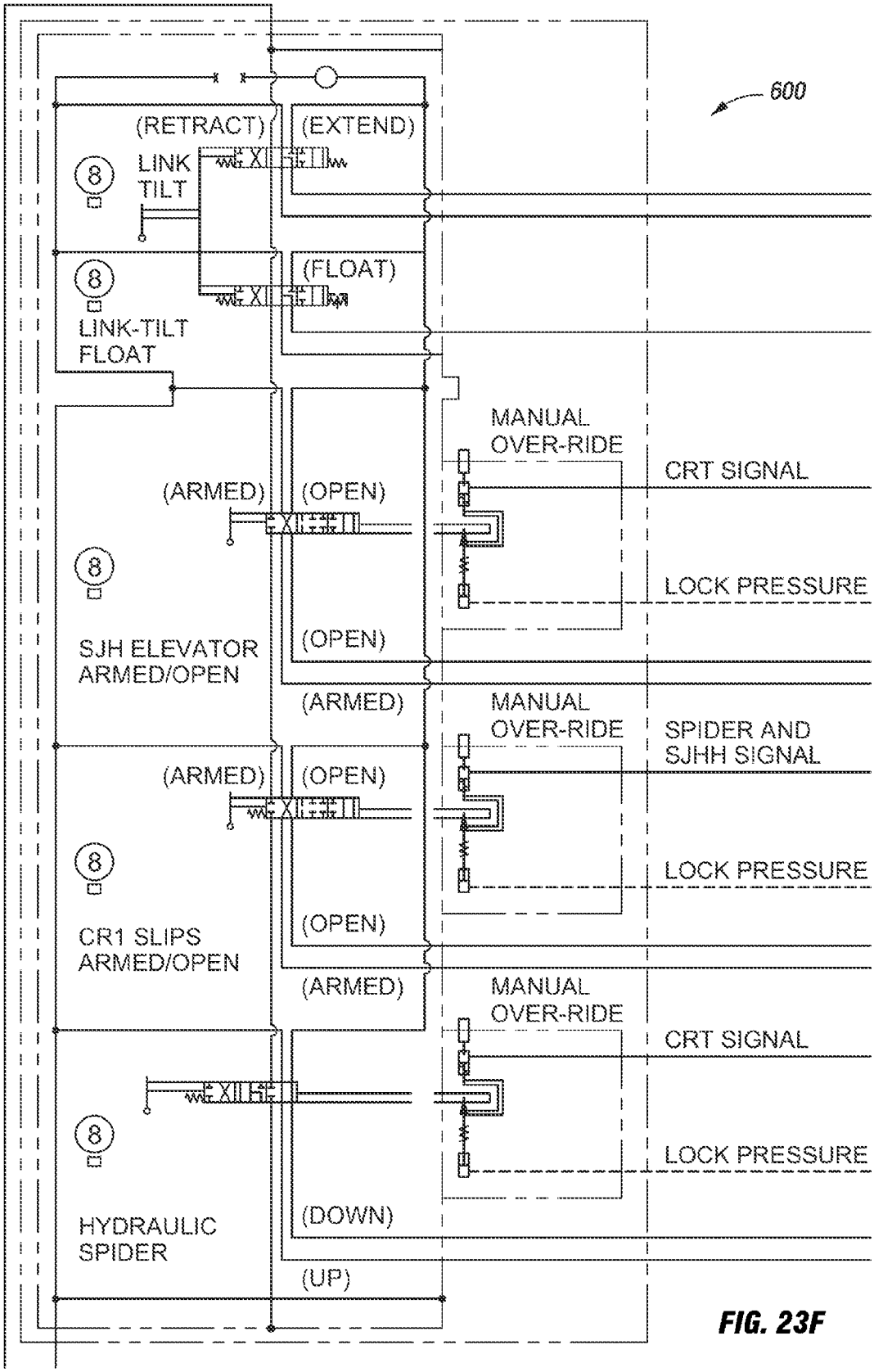
FIG. 23F is a schematic for the assembly of FIG. 23A.

The movement of the locking pin 610 is controlled by applying fluid pressure to the pistons 622, 624 at each end of the locking pin 610. The unpressurized position of the locking pins is controlled by the springs 616, 618. By appropriately directing fluid pressure from the actuating ports of the valves (via plumbing connections with appropriate tubing and hoses) to the appropriate piston 622, 624, the valve spool 604 can be locked in a specific position and prevented from moving, thus preventing operation of the function that the spool 604 controls. When the spool locking features are utilized with multiple valves as in the control panel 730, the spools can be "gated" (or interlocked) with respect to each other. A spool will be locked from moving, preventing actuation of the function it controls, unless other spools are in a specific position. Bolts 632 attach the gate assembly 603 to the valve. Bolts 633 secure a locking pin housing 634 to the gate assembly 603. A bolt 635 secures the locking sleeve 608 to the spool 604. FIG. 23C shows the cup 620 engaging the edge of the recess 626.

Figure 24:
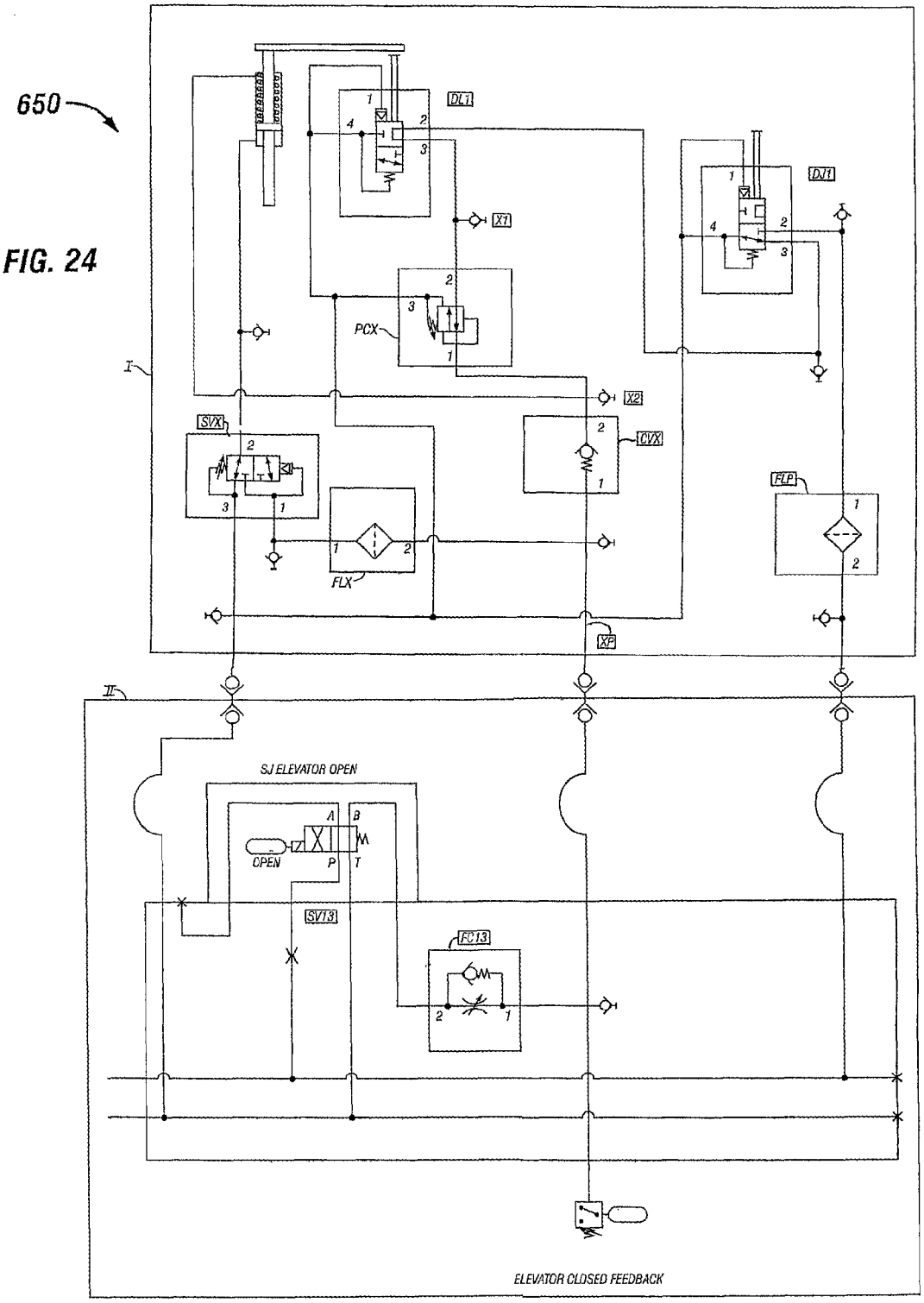
FIG. 24 is a schematic view of an hydraulic circuit related to an elevator in a system according to the present invention.
Figure 25:
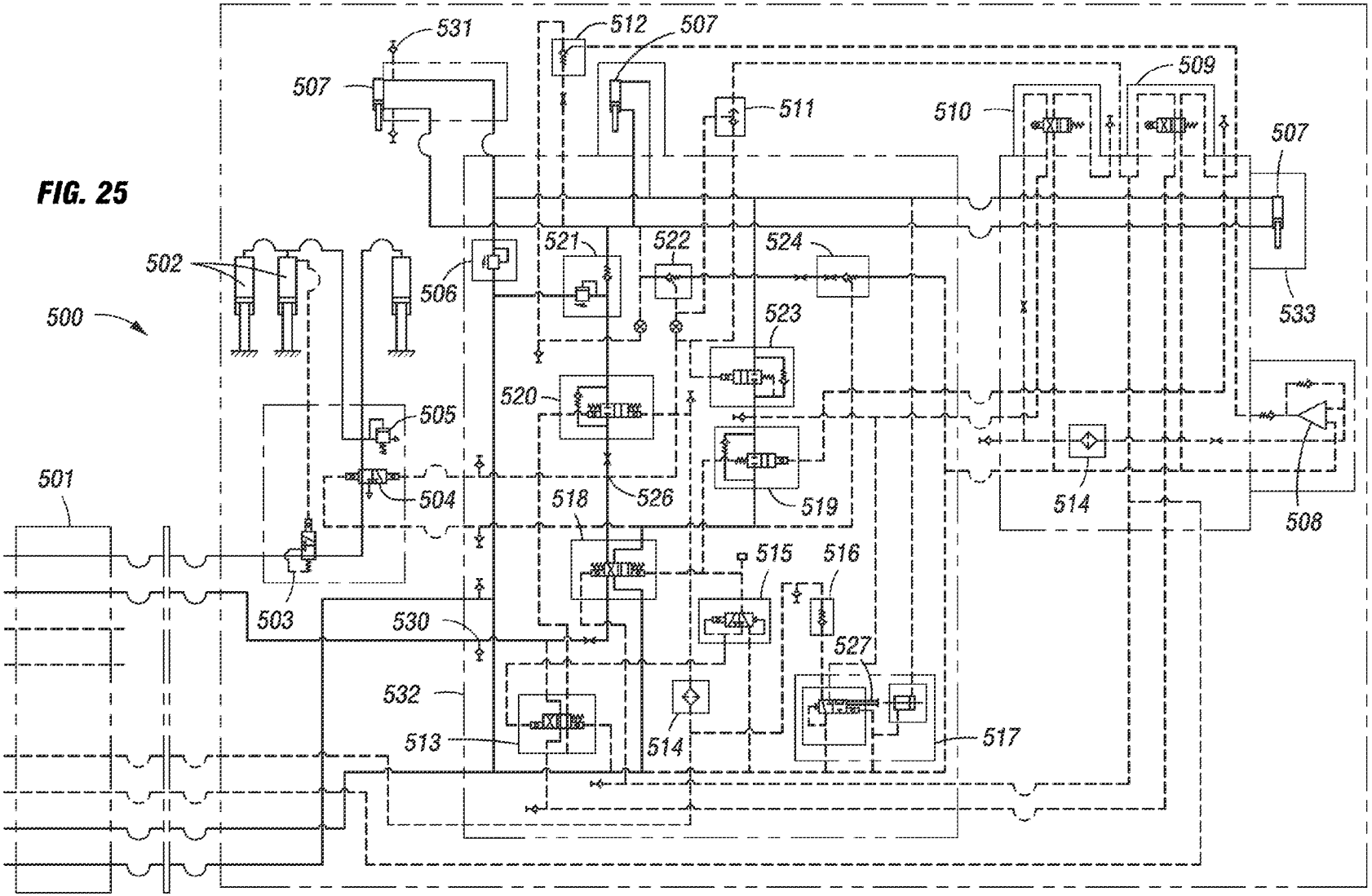
FIG. 25 is a schematic view of an hydraulic circuit for systems according to the present invention.
Figure 25A:
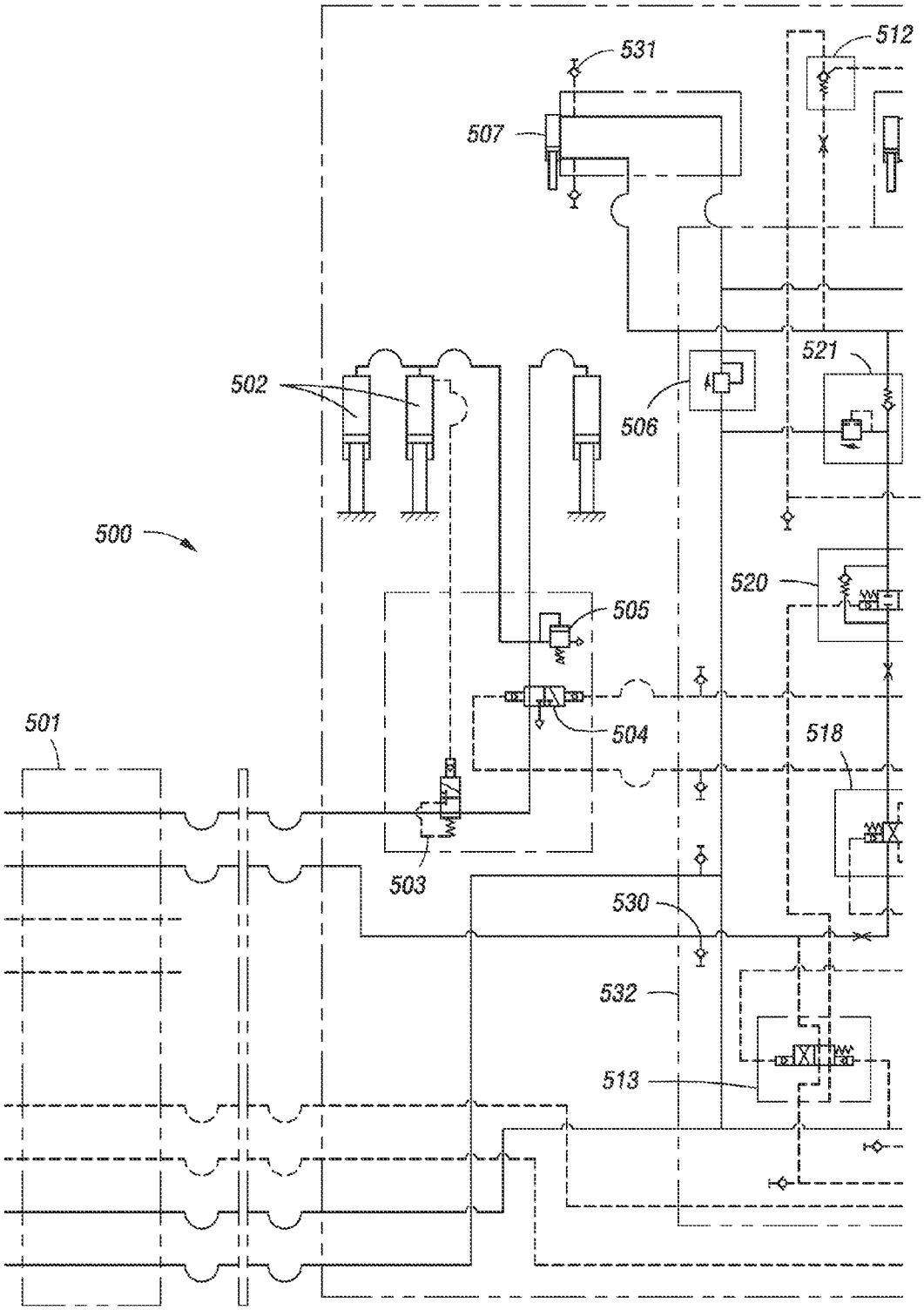
FIG. 25A is an enlargement of part of the circuit of FIG. 25.
Figure 25B:
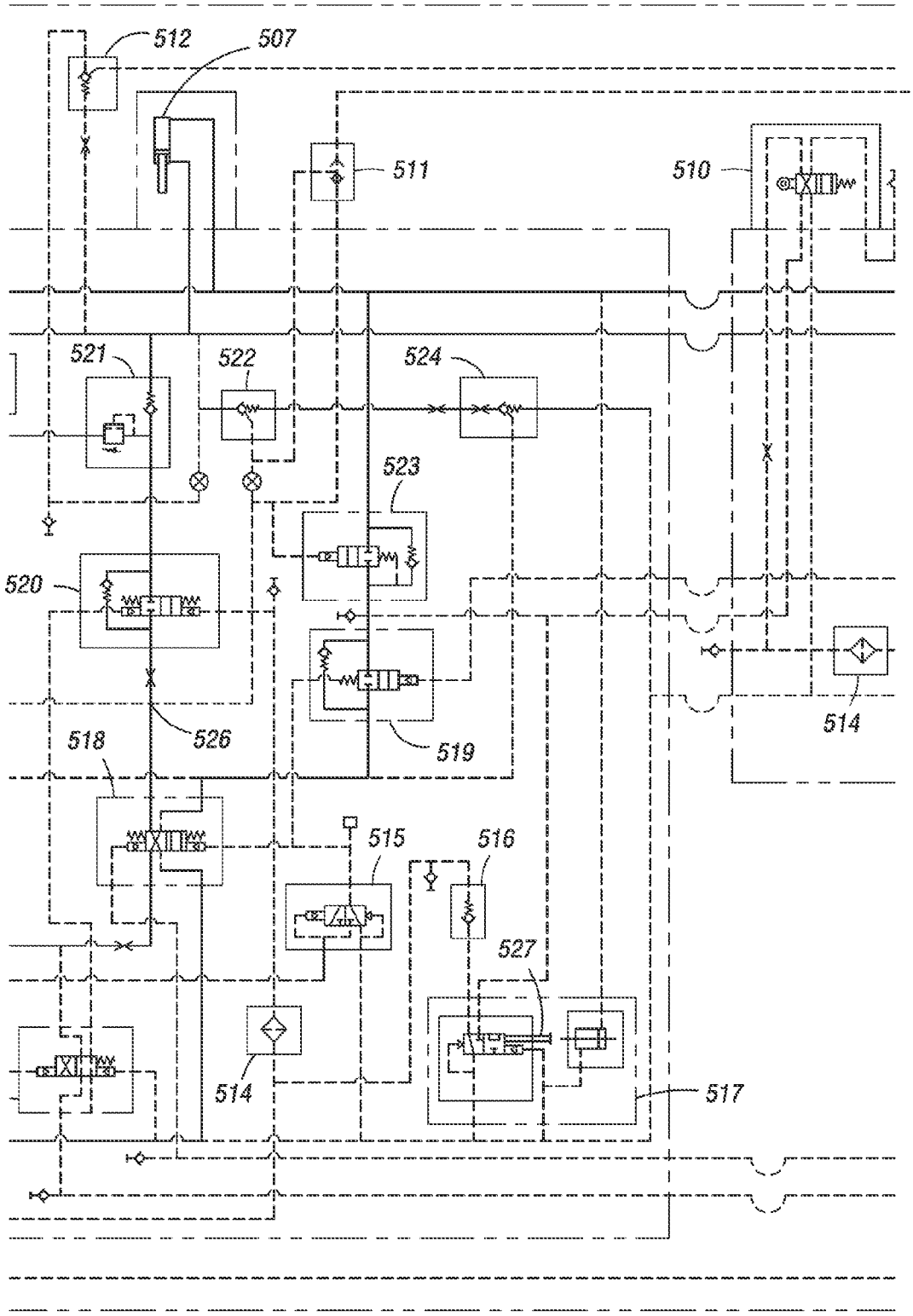
FIG. 25B is an enlargement of part of the circuit of FIG. 25.
Figure 25C:
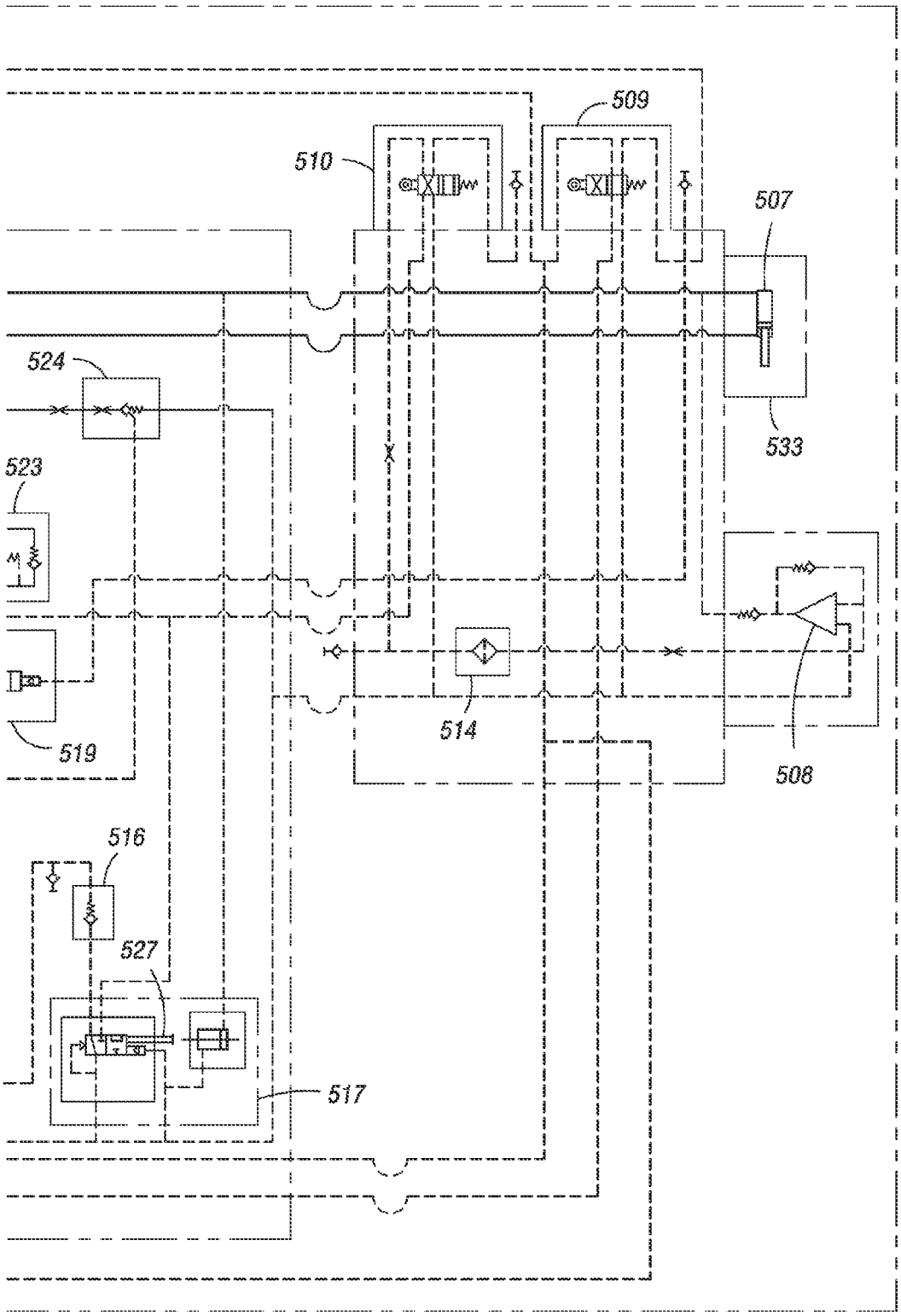
FIG. 25C is an enlargement of part of the circuit of FIG. 25.

FIG. 24 illustrates one circuit system 650 according to the present invention for use with a single joint elevator of a system according to the present invention (e.g. the elevators 1, 60, 330, 702) which provides feedback to a system control system (e.g. any control system disclosed herein) and/or to a system control panel (e.g. a control panel 730 or 730*a* or any disclosed herein). The valves and items in a box I are parts of an elevator according to the present invention and the valves and items in a box II are part of the control system for a tubular running system according to the present invention. The elevator has a latch movable by a latch cylinder and jaws.

In one aspect, the latch cylinder is spring-biased to a home (closed) position and is a balanced area activator. The valves in box I are as follows:

- DL1: a 3-way valve which can be mechanically shifted by a control panel level to effect closing of the elevator latch and which produces a signal indicating the latch is in the closed position.
- DJ1: a 3-way valve which can be mechanically shifted by a control panel lever to effect movement of elevator jaws.
- PCX: a reducing/relieving valve (e.g. set at a 750 psi setting) that limits the elevator closed feedback signal from the valve DL1 in the line XP.
- X2: a check valve.
- XP: a check valve.
- X1: a check valve.
- T: a check valve.
- SVX: a 3-way sequence valve; when pressure in the line XP is high (e.g. 1500 psi), this valve will operate the latch to a latch-open position, a position in which the jaws of the elevator are free to move.
- CVX: a check valve that blocks high pressure in the line XP and divides the elevator open circuit from the elevator closed section.

Filter FLP protects the valve DJ1. Filter FLX protects the valve SVX.

In one aspect, the elevator 60 (e.g. as shown in FIG. 1A) and the other elevators shown in the other systems according to the present invention described above, may be a known prior art elevator 60*a* as shown in FIGS. 1G-1K. The elevator 60*a* (FIGS. 1G-1N) with a body 60*x* has a latch 60*b* movable by a latch cylinder 60*c* and a pair of jaws 60*d* which pivot between an open and a closed position. The jaws 60*d* are held in either an open or closed position by spring force from a pair of jaw positioners 60*e*. When the jaws are closed, the latch 60*b* is positioned by spring force to block jaw rotation thus preventing the jaws 60*d* from opening. The elevator is supplied with hydraulic pressure P and return T connections (see FIG. 24) and a single control line connection (see FIG. 24). In one aspect the control line XP connects to a control valve 730*b* located in an operator control panel 730. In another aspect the control line XP is connected to an electrically operated control valve (SV13 in box II) with the operator located at a remote location operating the control valve SV13 via electrical signals.

The jaw positioners 60*e* are attached to the elevator body with hinge pins 60*f* allowing the jaw positioners 60*e* to rotate as the jaws 60*d* rotate. One of the jaw positioners 60*e* hinge pin 60*f* is extended to provide an attachment point for a jaw positioner lever 60*g*. The lever 60*g* is attached to the pivot pin 60*f* so that the lever 60*g* rotates with the jaw positioner 60*e*. When the jaws 60*d* reach a closed position, the rotation of the jaw positioner lever 60*g* causes it to contact a trigger plunger 60*h* which manually actuates a directional valve DJ1 (see FIG. 24). The directional valve DJ1 then passes pressurized fluid to a directional valve DL1 (see FIG. 24).

The latch 60*b* and latch cylinder 60*c* are mechanically connected with a hinge bolt to latch trigger lever 60*k* such that axial movement of the latch cylinder 60*c* causes pivoting motion of the latch trigger 60*k*. When the latch 60*b* and latch cylinder 60*c* are in the spring biased home (closed) position the latch trigger 60*b* manually actuates the directional valve DL1. The directional valve DL1 then passes pressurized fluid received from the directional valve DJ1 into the control line XP. A pressure reducing relieving valve PCX (see FIG. 24), located in the control line XP, reduces the fluid pressure to a medium level, approximately 750 psi. The medium pressure in the control line XP is connected to the extend side of the latch cylinder 60*c* producing additional force to hold the latch in the home (closed) position preventing inadvertent opening of the jaws. The medium pressure in control line XP is also directed to the operator control panel 730 where, in one aspect, it actuates an indicator 730*h* which informs the operator the elevator jaws are closed. In another aspect the pressure in control line XP actuates an electric pressure switch to provide indication to a remote location via electrical signals.

In one aspect the control panel 730 contains a flow control valve FC13 (see FIG. 24) which is connected to the control line XP on one side and to the hydraulic return line T on the other side (through the control valve 730*b*, or SV13 in box II, FIG. 24). Due to the nature of its construction the flow control valve FC13 produces a pressure drop from the fluid flowing through it which maintains the medium pressure in control line XP.

When the operator shifts the control valve 730*b* (or SV13 in box II) to the "open" position fluid at high pressure (approximately 2000 psi) is directed into control line XP. At the elevator this fluid is blocked by a check valve CVX (see FIG. 24) and passes to sequence valve SVX (see FIG. 24). Sequence valve SVX has an actuation pressure setting (1500 psi) well above the medium pressure level (750 psi) such that the high pressure fluid (2000 psi) actuates the valve SVX which directs the high pressure fluid to the retract side of the latch cylinder 60*c*. The pressurized fluid acts to retract latch cylinder 60*c* overcoming the latch spring force of springs 60*m* and overcoming the medium pressure fluid on the extend side of the latch cylinder 60*c* and retracting the latch 60*b* behind the jaws 60*d*. This frees the jaws 60*d* to rotate to the open position as the elevator 60*a* is removed from the tubular. The retraction movement of the latch cylinder 60*c* moves the latch trigger lever 60*k* which releases the mechanical force on the directional valve DL1 allowing the valve DL1 to shift which relieves the pressure on the extend side of the latch cylinder 60*c* to hydraulic return T. The rotation of the jaws as the elevator is removed from the tubular rotates the jaw positioner 60*e* and the jaw positioner lever 60*g* about hinge pin 60*f* which removes the mechanical force on trigger plunger 60*h* and allows the directional valve DJ1 to shift which blocks incoming pressurized fluid from the hydraulic pressure P.

When control valve 730*b* is shifted to the "armed" position it directs the fluid in control line XP to the hydraulic return T which reduces the pressure in control line XP to zero psi (or a very low pressure). This reduction in pressure allows the sequence valve SVX to shift which directs the return side of latch cylinder 60*c* to hydraulic return T relieving pressure in the latch cylinder 60*c*. The latch spring 60*t* now forces the latch 60*b* and latch cylinder 60*c* to extend behind the jaws 60*d* holding the jaws 60*d* in the open position. The valves and jaw position are now "armed" ready to repeat the closing cycle when the elevator is pushed onto a tubular.

Filter screens FLP, FLX remove fluid contaminants to protect the valves and hydraulic components in the elevator.

Figure 1H:
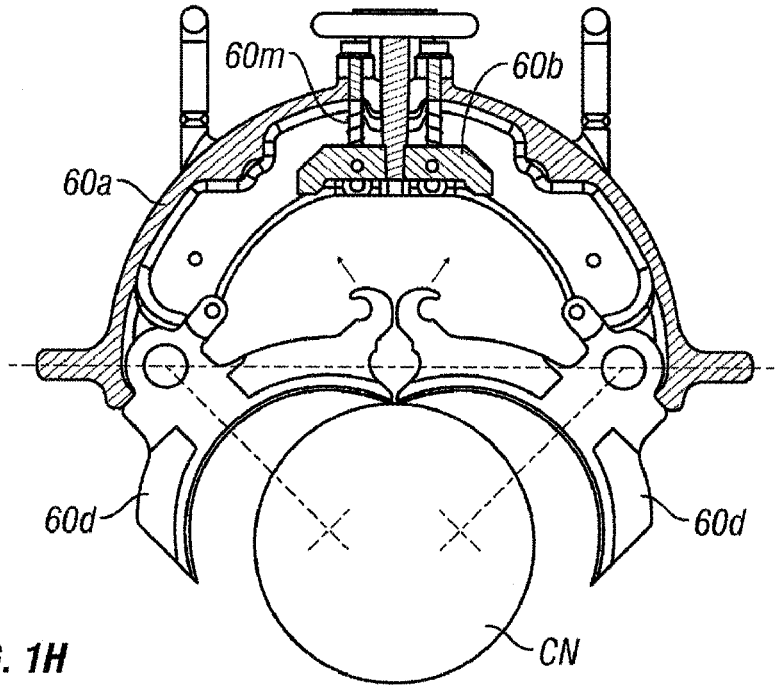
FIG. 1H (Prior Art)
FIG. 1H is a top cutaway view of the elevator of FIG. 1G.
Figure 1I:
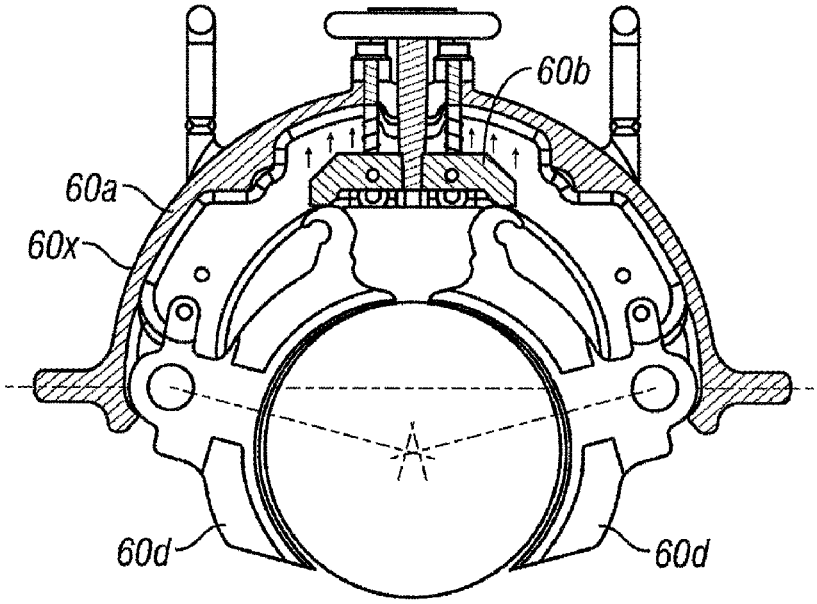
FIG. 1I (Prior Art)
FIG. 1I is a top cutaway view of the elevator of FIG. 1G.
Figure 1J:
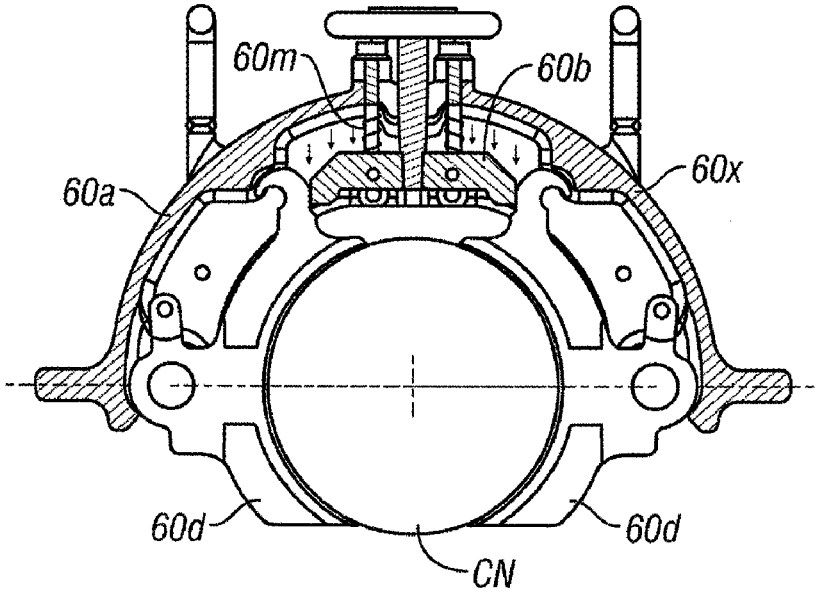
FIG. 1J (Prior Art)
FIG. 1J is a top cutaway view of the elevator of FIG. 1G.
Figure 1K:
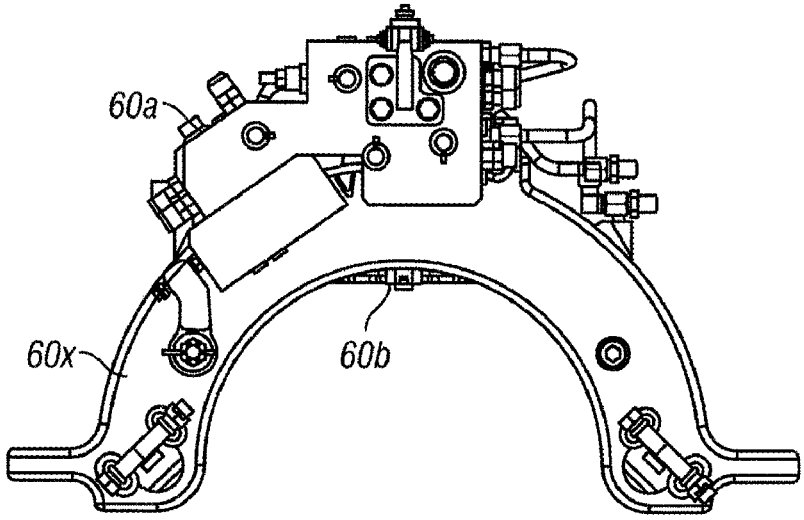
FIG. 1K (Prior Art)
FIG. 1K is a top view of the elevator of FIG. 1G.
Figure 1L:
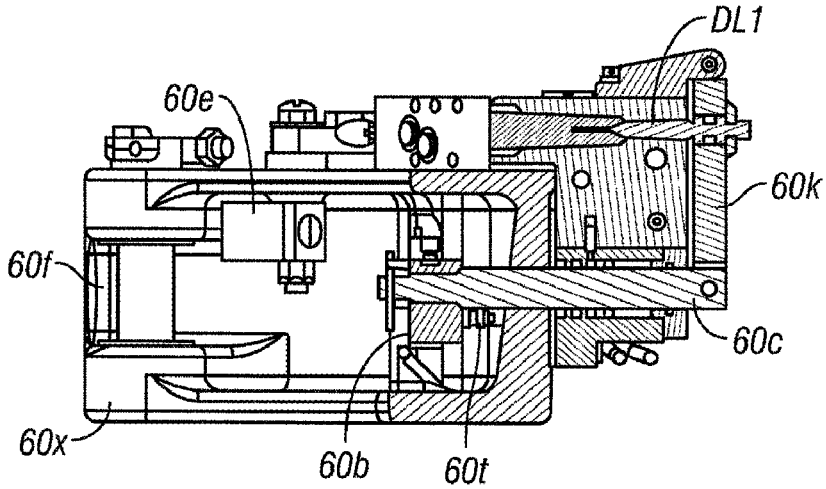
FIG. 1L is a cross-section view of part of the elevator of FIG. 1G.
Figure 1M:
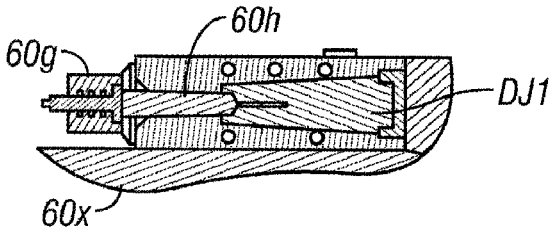
FIG. 1M is a cross-section view of part of the elevator of FIG. 1G.
Figure 1N:
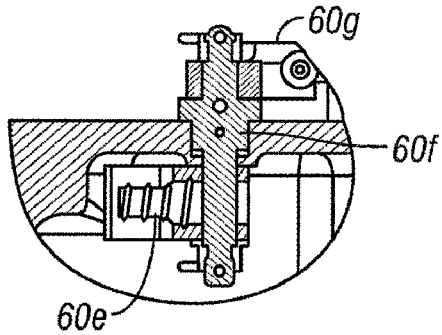
FIG. 1N is a cross-section view of part of the elevator of FIG. 1G.

FIG. 1H shows the jaws 60*d* initially contacting casing CN. FIG. 1I shows the jaws 60*d* in position around the casing CN. FIG. 1J shows the jaws 60*d* clamped on the casing CN and held in place by the latch 60*b*.

Typically the desired gate functions are ("SJE" means single joint elevator):

Open CRT only when spider is closed and SJE is closed

Open spider only when CRT is closed

Open SJE only when CRT is closed

Any suitable combinations of gates may be utilized. Also, the springs that move the locking pins to the unpressurized position can be sized or positioned to provide a specific locked or unlocked state when the pistons are unpressurized.

In one aspect a push button switch on the control panel allows overriding of the gates if required. The switch is covered by a hinged door to prevent accidental actuation. Actuating the switch overrides all gates simultaneously.

The CRT and SJE may use an hydraulic circuit that reduces the number of lines required to actuate the slips in the CRT or close the SJE. This circuit uses three different pressures to actuate the slips or elevator function and to provide a closed feedback signal. Thus only one service loop hose is used when normally two hoses would be required. High pressure opens the slips or elevator, low or zero pressure is present when the slips or elevator are "armed to close" and medium pressure is used to provide the closed feedback signal to the indicator. The indicator distinguishes between medium pressure (slips or elevator closed) and high pressure (slips or elevator open).

One system according to the present invention has a control panel 730 with an hydraulic circuit that provides accurate feedback signals for the various slip positions. A timing cylinder 735 is used to provide an actuation signal to a control valve 734 which separates the feedback signal service loop hose from the feedback indicator. When the control valve 734 is shifted from OPEN to ARMED the residual pressure in the service loop hose would normally actuate an indicator 730*f* or 730*h* and give a false indication of slips or elevator closed for a few seconds. The timing cylinder 735 and the isolation control valve 734 prevent this from happening by isolating the indicators from the pressure source in the hose. Once the timing cylinder 735 has moved through its full stroke, the actuation signal to the isolation control valve 734 goes away allowing the valve 734 to shift which connects the service loop hose directly with the indicators. The indicators can now read the medium pressure which is present in the service loop hose when the slips are set or the elevator is closed and the indicators produce the correct indication. The timing cylinder speed is controlled by adjusting the fluid flow rate into and out of the cylinder 735 with control valves 735*v* located in the panel manifold.

The control panel 730 uses a manifold 732 to reduce plumbing lines and connections and to provide a mounting location for service loop connections 730*s* and hydraulic and pneumatic supply connections 730*t*. A pressure filter 733 is mounted to the manifold 732 to remove particulate contamination from the incoming hydraulic fluid. A selector valve 731 is mounted on the manifold 732 to shutoff the incoming hydraulic pressure when required. Also, the isolation control valve 734 is used to isolate hydraulic pressure from the service loop 710 and the CRT 720 and SJE 702. The manifold 732 also provides mounting locations 730*m* for various test fittings to allow connection of pressure gauges and test equipment for troubleshooting purposes.

As shown in FIG. 19, the driller D controls the speed and torque of a top drive TDS and a "dashboard" monitor 705 provides an indication of the status of the tubular running tool 720. The driller D can control the hoisting, lowering, spinning (rotation) and torque of the tubular running tool 720. The driller D receives feedback from the tubular running tool (from the line 705*a* from the control panel 730 to the remote monitor 705) regarding: running tool stop signal (stop lowering); slips set; elevator closed (start hoisting); elevator vertical (can be visual-ready for stabbing into a tubular, e.g. casing; and from the spider (or rotary) for slips set.

The tubular running tool operator O controls: elevator tilt out; elevator opening and arming; running tool slips; and rotary and/or spider slips. The operator O receives feedback from the running tool regarding: running tool stop signal (stop lowering; slips set; elevator closed (start hoisting); and rotary or spider slips set.

An hydraulic power unit "HPU ASSY" provides hydraulic power fluid for the various functions of the system that are hydraulically powered. A Rig AIR supply provides air under pressure for the various functions that are pneumatically powered. In certain aspects, when electrically-powered items are used for the indicators on the control panel 730 or for the remoter monitor 705, electrical power is provided from a rig's generators or main electrical supply.

FIGS. 25 and 25A-25C show schematically a system 500 according to the present invention which includes various items and hydraulic circuitry that may be used in and with the systems according to the present invention described above.

Figure 17B:
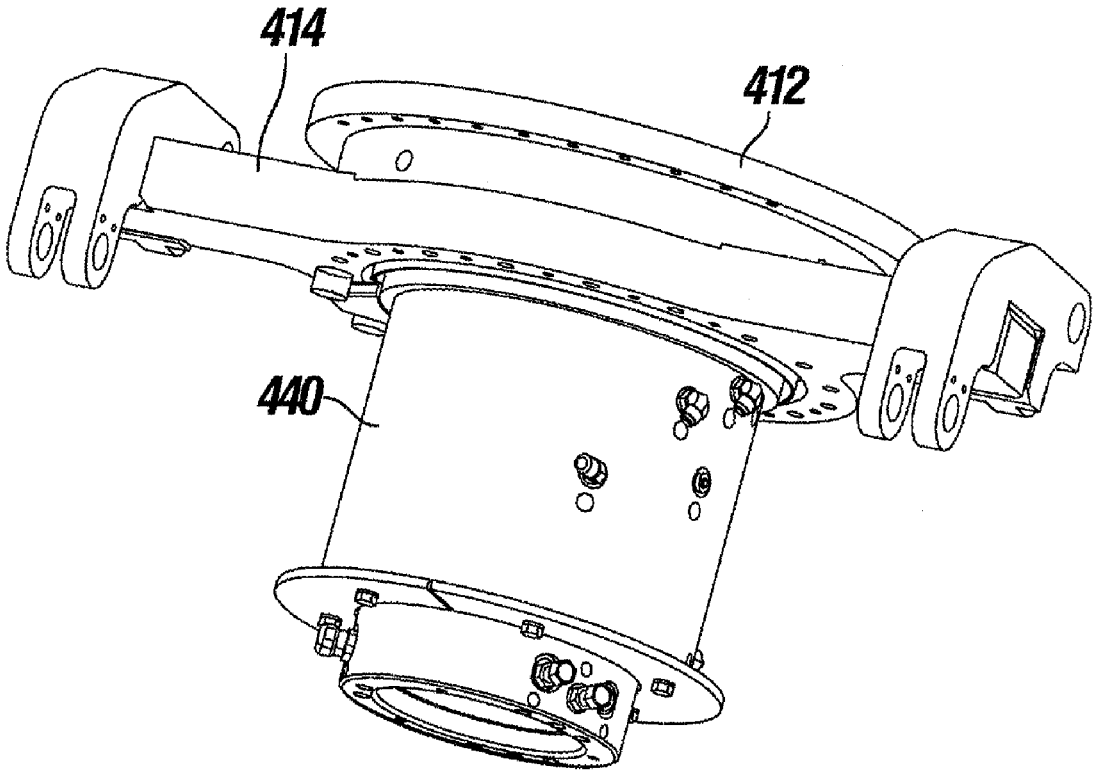
FIG. 17B is a view of part of the swivel assembly of FIG. 17A.
Figure 17A:
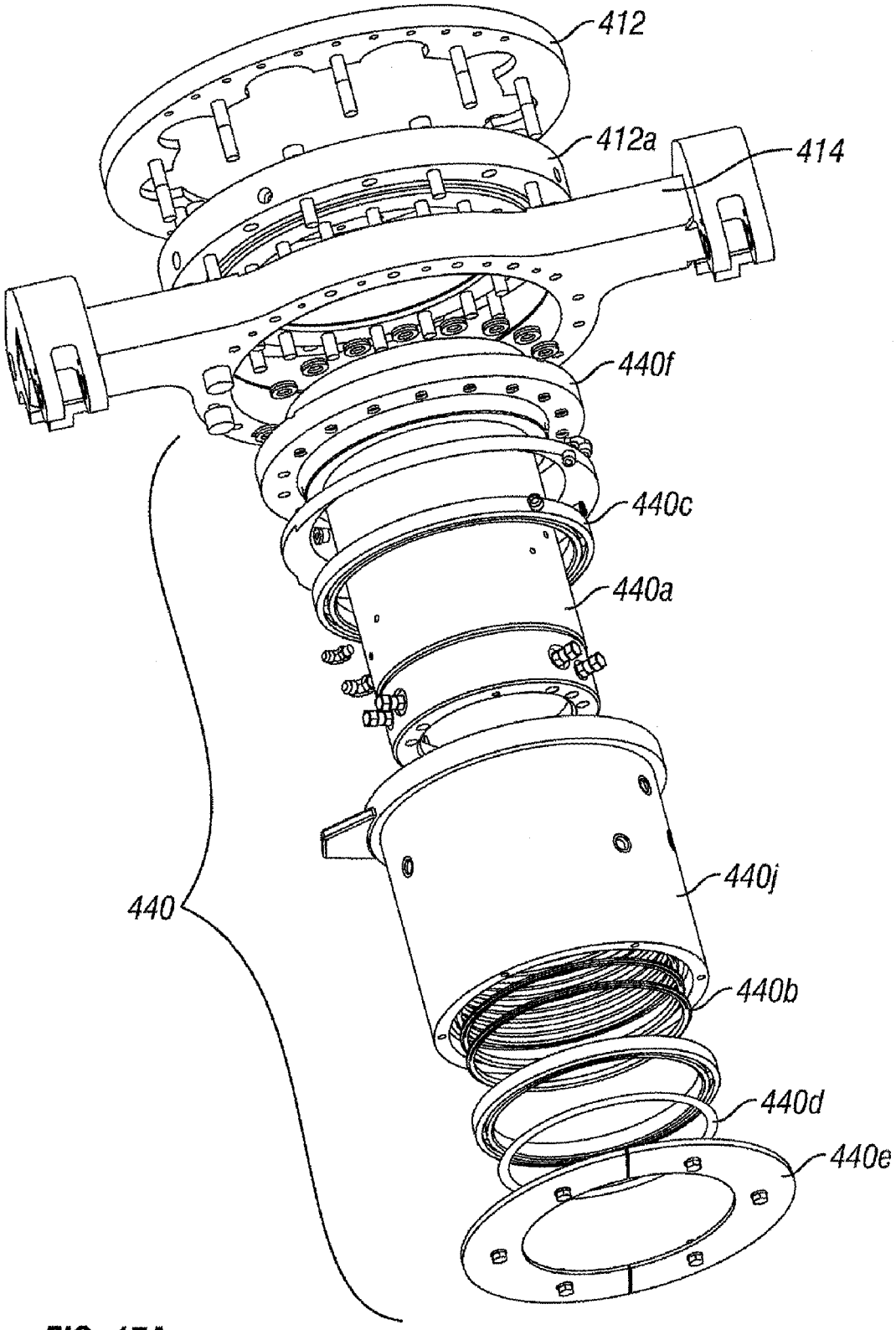
FIG. 17A is an exploded perspective view of a swivel assembly of the system of FIG. 14A.
Figure 17C:
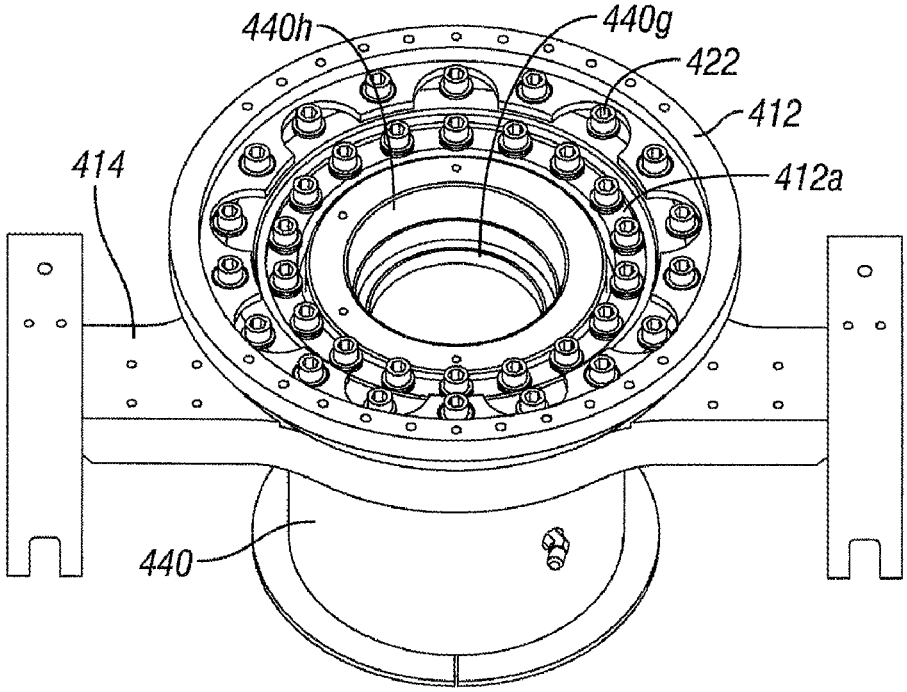
FIG. 17C is a top view of the part of FIG. 17B.
Figure 17D:
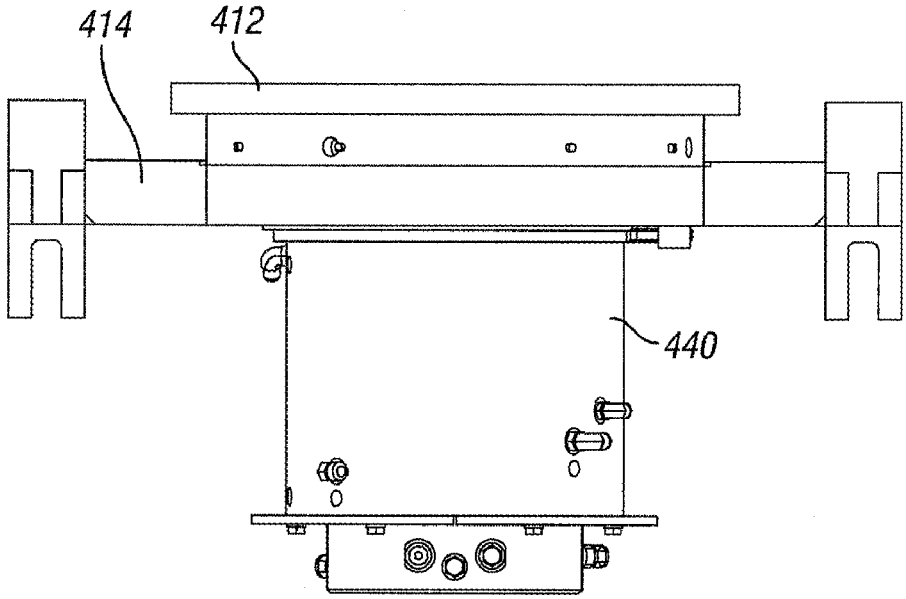
FIG. 17D is a side view of the part of FIG. 17B.

An hydraulic pneumatic swivel (e.g. like the swivel assembly 155, the swivel assembly 308, and the swivel assembly 440, FIG. 17A described above) provides fluid passages from stationary to rotating parts of the system. Compensator assemblies 502 (like the compensators 326*a*-326*c* described above) transfer weight of the tool and tubular to a main shaft to reduce load on threads of the tubular during connection makeup and breakout. An air-operated pilot directional valve 503 selectively shuts off air supply to the compensator assemblies 502 when their strokes reach a mid-stroke position, holding the system in a "start" position.

An air directional valve 504 with an hydraulic pilot directs air flow to and from the compensator assemblies 502 based on slips "open" or slips "armed to close" command from an operator.

An air relief valve 505 limits air pressure in the compensator assemblies 502 due to externally applied loads. A relief valve 506 limits hydraulic pressure in slip cylinder assemblies 507 for safety. The slip cylinder assemblies 507 (e.g. three assemblies 507, e.g. like the cylinder assemblies 350*a*-350*c* described above) provide vertical movement of the slips (e.g. any slips in any embodiment described above) to grip and release a tubular.

An hydraulic pressure booster 508 (e.g. like the booster 491 described above) boosts a lowered pressure through the swivel 501 up to a pressure required to fully set the slips. A cam-operated directional valve 509 (e.g. like the valve 378 described above), when contacted by a fill-and-circulation tool's catch plate starts a slip set sequence and sends a "stop lowering" signal to a control panel (e.g. like the control panel 730 described above). A cam-operated directional valve 510 starts the booster 508 to build full slip set pressure when the slips are fully set.

A shuttle valve 511 engages and disengages a regenerative mode for the slips set function. A regenerative mode uses waste fluid from the cylinders 507 to speed up cylinder activation. A pilot-to-open check valve 512 prevents downward drifting of the slips during certain conditions when the system is subjected to adverse pressure transients (e.g. when an HPU cycles on and off).

A spring-offset 2-position valve 513 enables or disables the valve 509 based on operator input from the control panel (selecting "open" or "armed to close"). A filter screen 514 protects the booster 508 and the valves in the slip set feedback circuit from contamination. A 2-position 3-way sequence valve 515 discriminates between high pressure for a slips open command and medium pressure for a slips set feedback signal.

A check valve 516 blocks a high pressure slips open command from entering the medium pressure slips set feedback circuit. A 2-position 3-way sequence valve 517 controls the slips set feedback signal and is activated by a mechanical plunger with an area ratio that creates movement at a predetermined slips set pressure. A 2-position detented directional valve 518 determines "armed to close" mode or "open" mode based on tubular contact with the valve 509 or an operator "open" command from the control panel.

A 2-position hydraulic pilot load control valve 519 controls fluid flow to the down side of the slip cylinder assemblies 507 and, when piloted by the valve 509, allows fluid to flow to the cylinders and set the slips. A 2-position hydraulic pilot load control valve 520 controls fluid flow to the upside of the slip cylinder assemblies 507 and, when flow piloted by a slips open command from the control panel, allows fluid to the cylinders to open the slip.

A relief valve 521 provides a redundant safety relief feature with slips open and prevents excessive pressure build up on the up side slip cylinder assemblies 507. A pilot-to-close check valve 522 works in conjunction with the shuttle valve 511 to direct waste fluid from the up side of the slip cylinders 507 to the down side (regeneration) to speed up the slips set function. A 2-position hydraulic pilot load control valve 523 holds high pressure on the slips down side of the slip cylinders when slips are set and is opened with a slips open command, releasing pressure from the slip cylinders. A pilot-to-close check valve 524 relieves pressure on the downside of the slip cylinders if main hydraulic power is lost preventing the trapping of pressure in the system and thereby preventing the tool from being locked onto a tubular.

An orifice 526 controls fluid flow for slips up movement. A piston actuator 527 moves and activates a sequence valve 517 to direct the medium pressure slip set feedback signal to the indicator in the control panel when high pressure builds up in the slip cylinder apparatuses.

Test fittings 530 provide connection points for test gauges and other test equipment.

Manifolds 531, 532, 533 (e.g. like the manifolds 352*a*-352*c* described above) provide hydraulic plumbing connections and mounting for various valves, cylinders and fittings.

Figure 26:
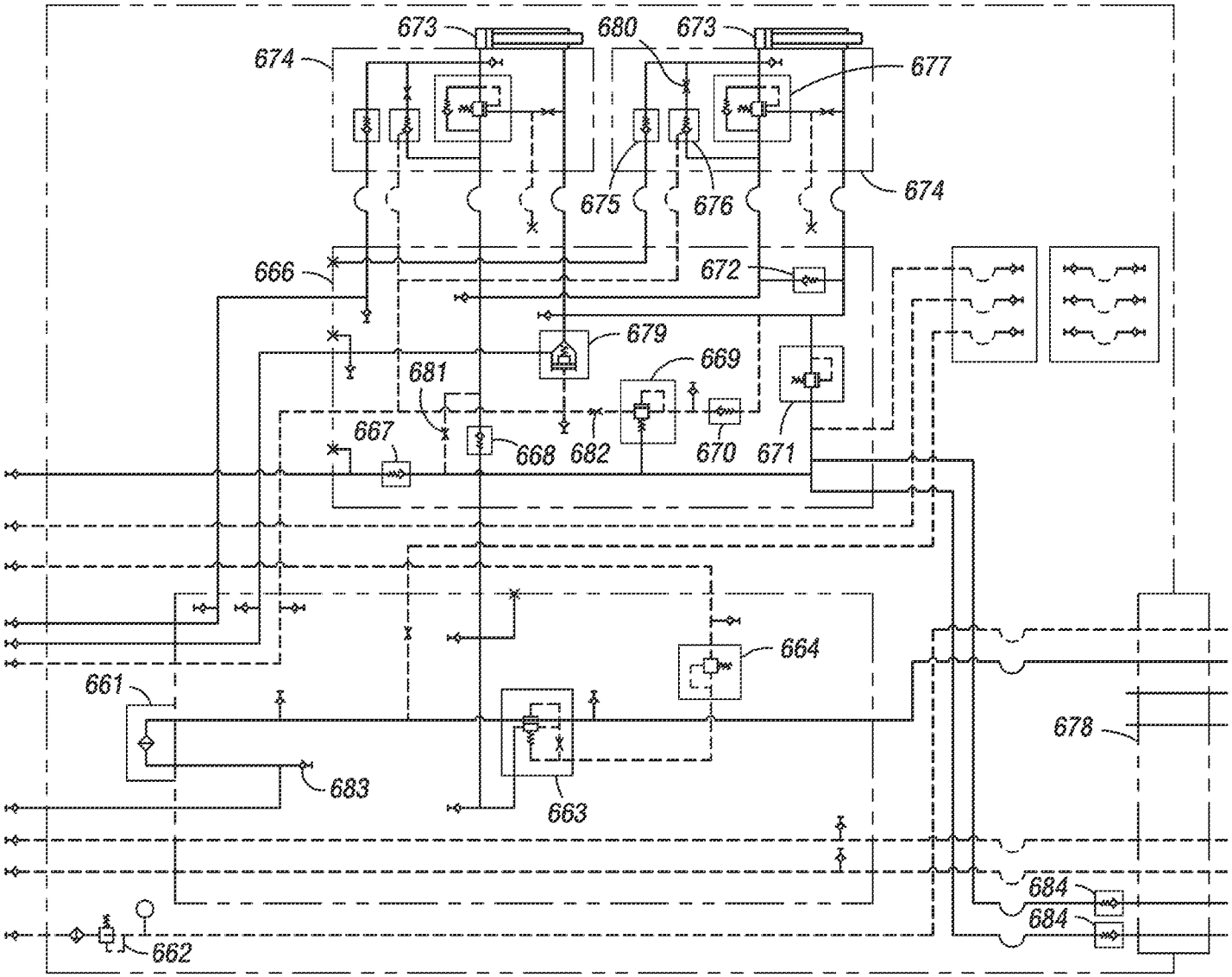
FIG. 26 is a schematic view of an hydraulic circuit for systems according to the present invention.
Figure 26A:
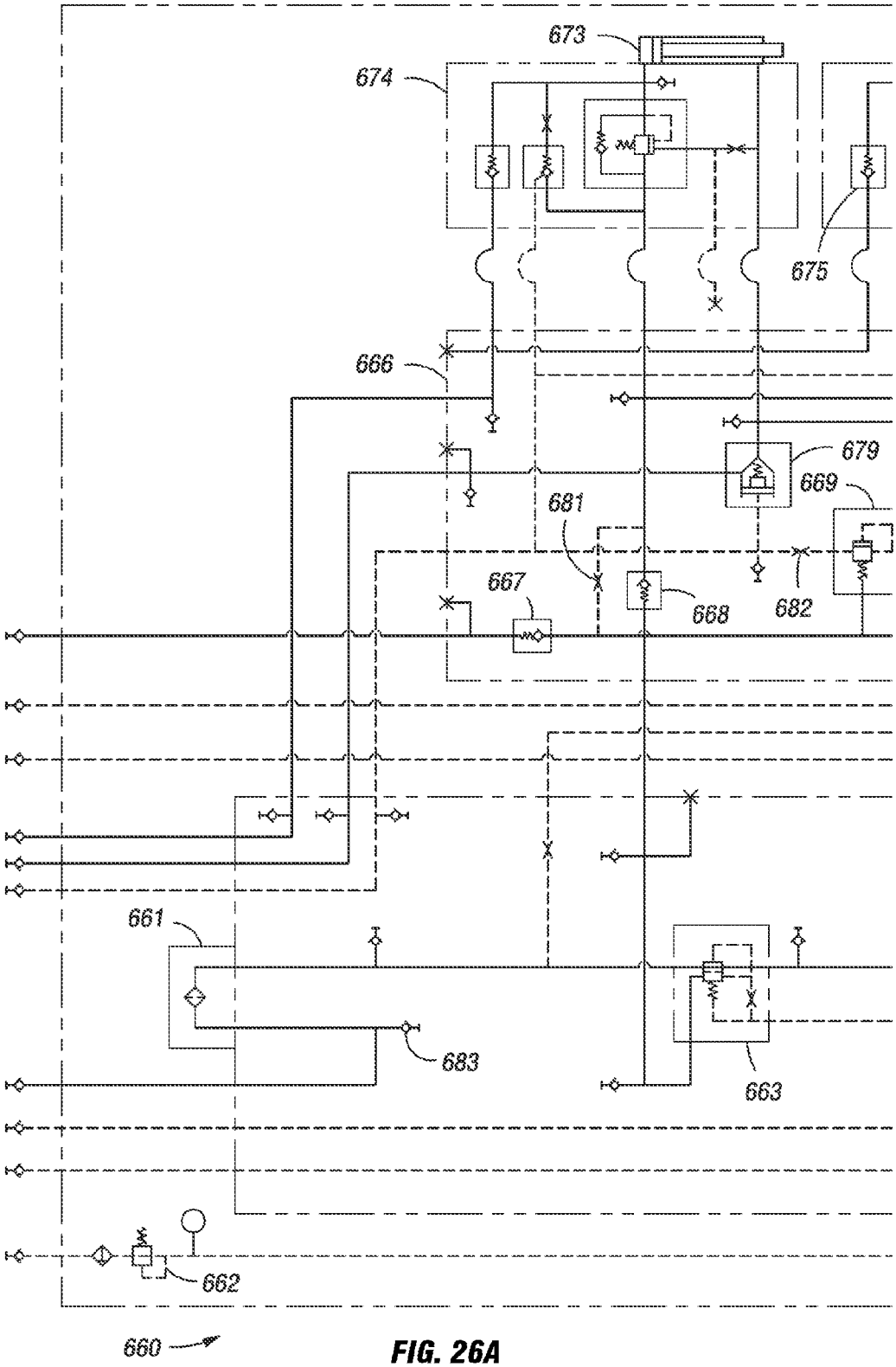
FIG. 26A is an enlargement of part of the circuit of FIG. 26.
Figure 26B:
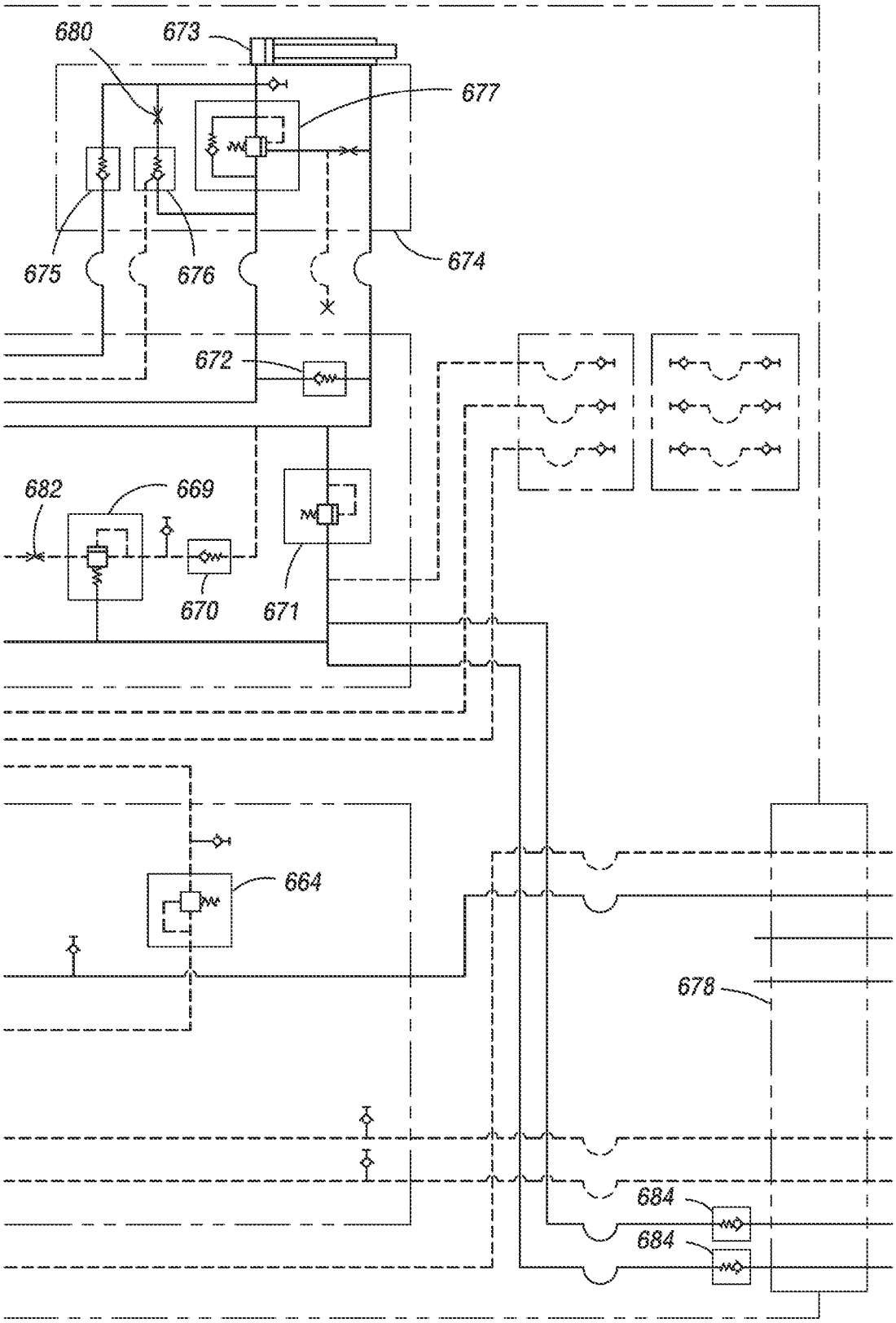
FIG. 26B is an enlargement of part of the circuit of FIG. 26.

FIGS. 26 and 26A-26B show schematically a system 660 according to the present invention which includes items and hydraulic circuitry that may be used in and with the systems according to the present invention described above.

A pressure filter 661 (like the filter 452, FIG. 15A) removes contamination from the hydraulic fluid. An air filter regulator 662 (like the regulator 454, FIG. 15C) controls air pressure to the compensator assemblies. An hydraulic pressure reducing valve 663 (like the valve 440*i*, FIG. 15A) reduces the hydraulic pressure of fluid flowing through the swivel assembly to extend seal life. A pressure relief valve 664 works in combination with the valve 663 to provide a high pressure setting when the tool is in the "OPEN" state and a low pressure setting when the tool is in the "ARMED" state.

An inlet manifold 665 (like the manifold 316*b*, FIGS. 15A and 15B) contains the filter 661, the regulator 662, and the valve 663 A distribution manifold 666 (like the manifold 316, FIG. 15C) contains items 667, 668, 669, 670, 671, 672 and 679 described below. The manifold 666 gathers and distributes hydraulic fluid to and from various functions.

A check valve 667 prevents hydraulic fluid from draining out of the manifolds and lines due to elevation changes of the system. A check valve 668 produces a higher pressure zone in the manifold 666 to insure that the link tilt cylinders remain full of fluid when retracting. A pressure reducing valve 669 reduces the hydraulic pressure to control the link tilt float application. A check valve 670 allows hydraulic fluid flow in one direction only. A pressure relief valve 671 limits pressure on the retract side of the link tilt cylinders caused by external loads. A check valve 672 allows fluid flow from a blind end to a rod end of the link tilt cylinders to keep them full of fluid when in float mode.

A powered cylinder apparatus 673 (like the apparatus 312, FIG. 15) extends and retracts the link tilt arms.

A load holding manifold 674 contains valves and fittings to control hydraulic fluid flowing to and from the apparatus 673.

A check valve 675 allows hydraulic fluid flow in one direction only. A pilot-operated check valve 676 allows controlled release of fluid from the link tilt cylinders to "float" the link tilt arms. A load holding valve 677 (like the valve 424*a* described above) holds the apparatus 673 in position and prevents the link tilt arms from falling if a cylinder control hose breaks and limits pressure in the blind end of the cylinder caused by external loads.

An hydraulic/pneumatic swivel 678 (like the swivels and swivel assemblies 155, 308 and 440 described above) provides fluid passages from stationary to rotating parts of the system.

A normally open logic cartridge 679 controls fluid flow to and from the rod side of the link tilt cylinders to control differing requirements between normal extend/retract function and float function.

An orifice 680 controls fluid velocity out of the link tilt cylinders to control descent speed of the link tilt arms in float mode. An orifice 681 provides a fluid bleed path to prevent the trapping of pressure in the link tilt cylinder extend line which could prevent the cylinder from fully retracting. An orifice 682 limits fluid flow out of the float signal line.

Test fittings 683 provide connections for test gauges and other test equipment (not shown).

A check valve 684 prevents pressure surges (e.g. tank pressure surges) from entering the rotating parts circuits.

Figure 22:
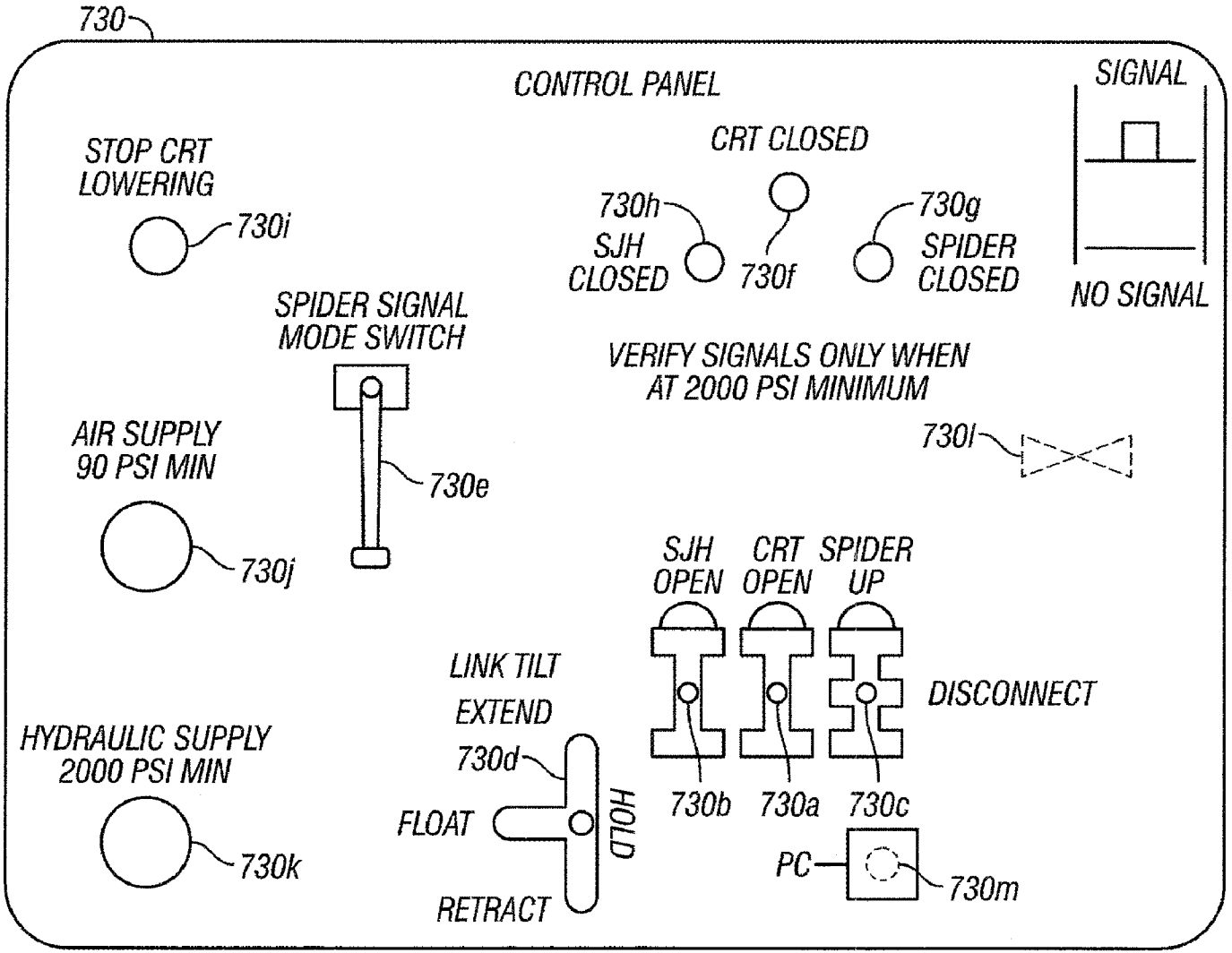
FIG. 22 is a schematic view of a control panel according to the present invention.
Figure 22A:
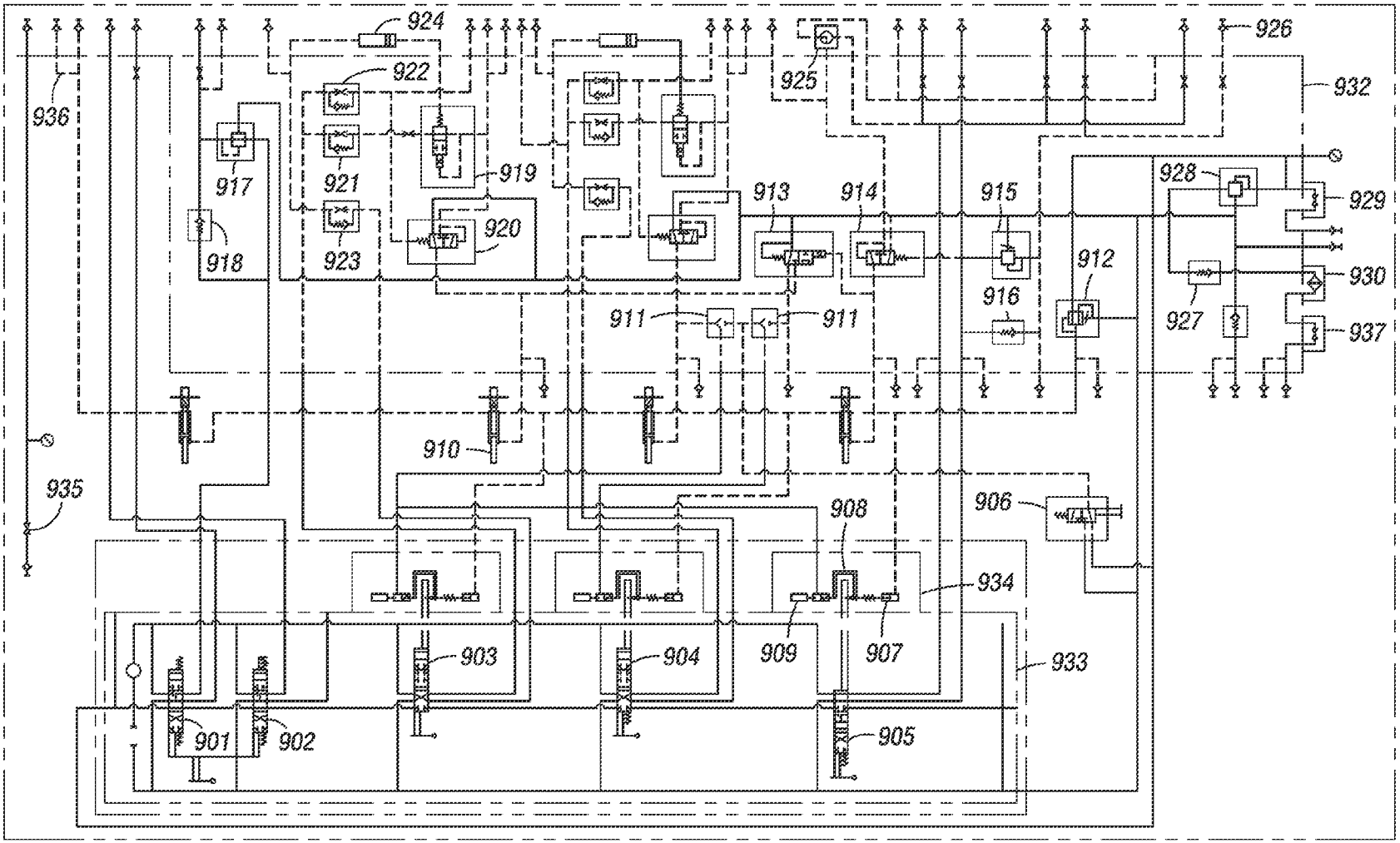
FIG. 22A is a schematic view of an hydraulic circuit for systems according to the present invention.
Figure 22B:
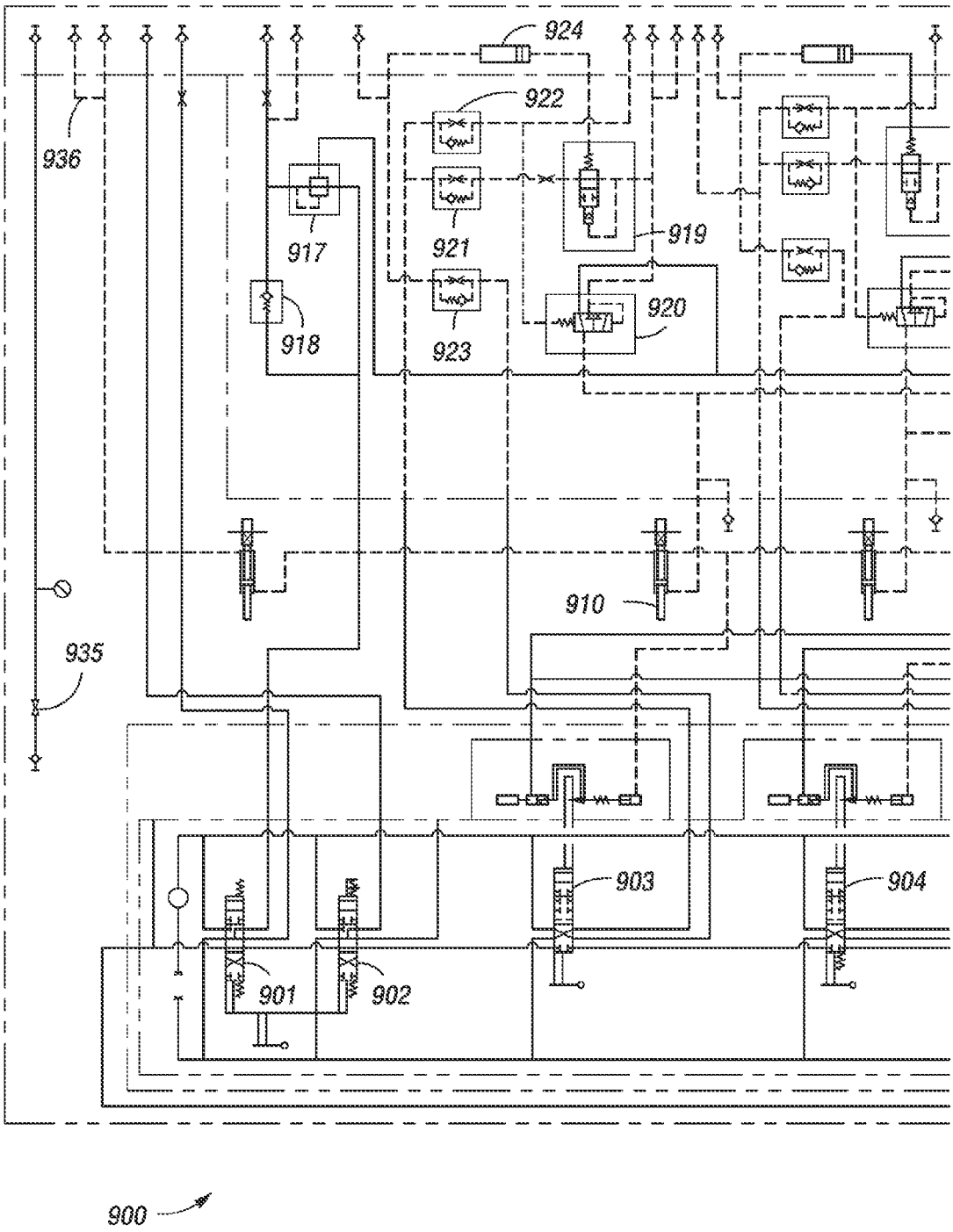
FIG. 22B is an enlargement of part of the circuit of FIG. 22A.
Figure 22C:
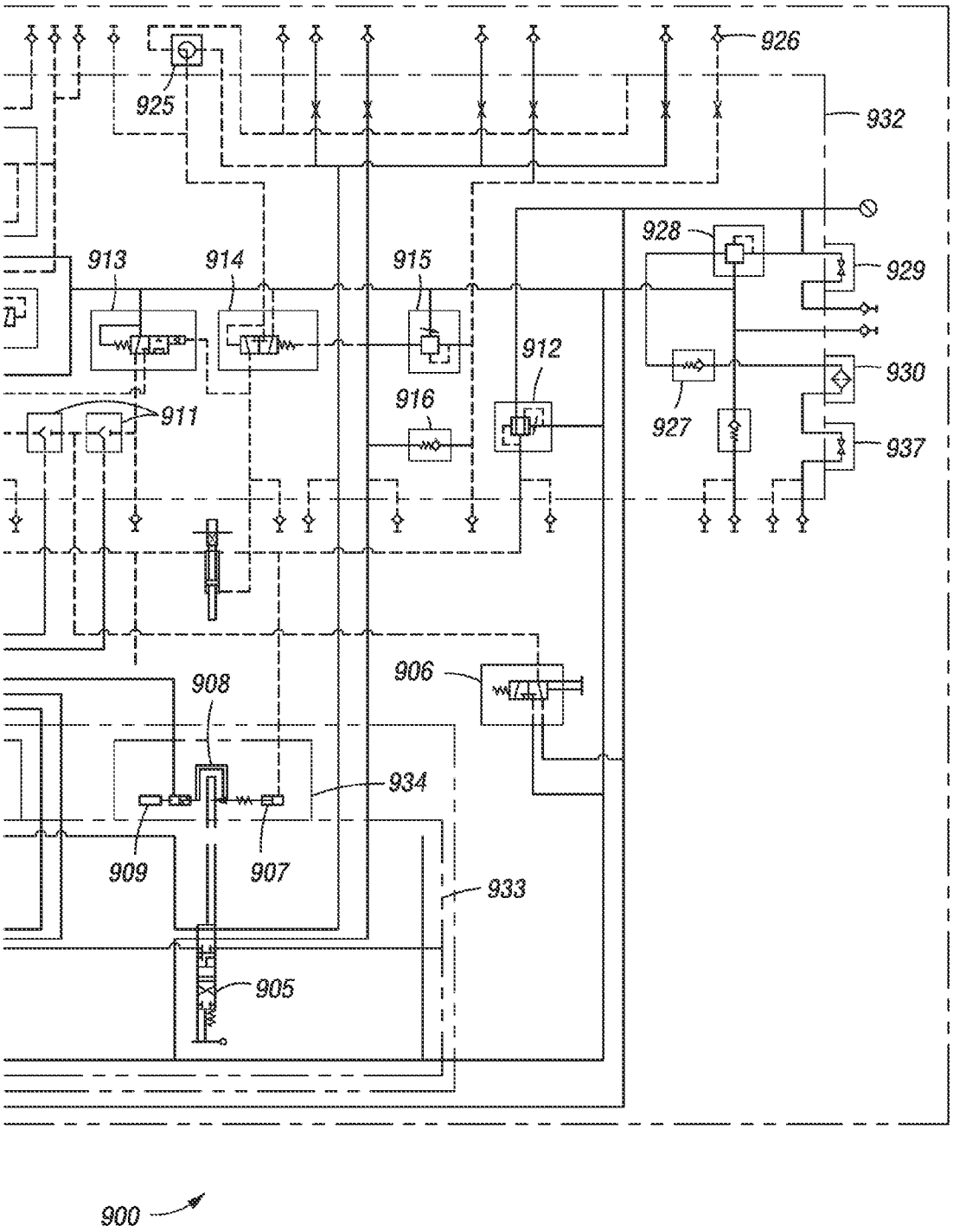
FIG. 22C is an enlargement of part of the circuit of FIG. 22A.
Figure 22D:
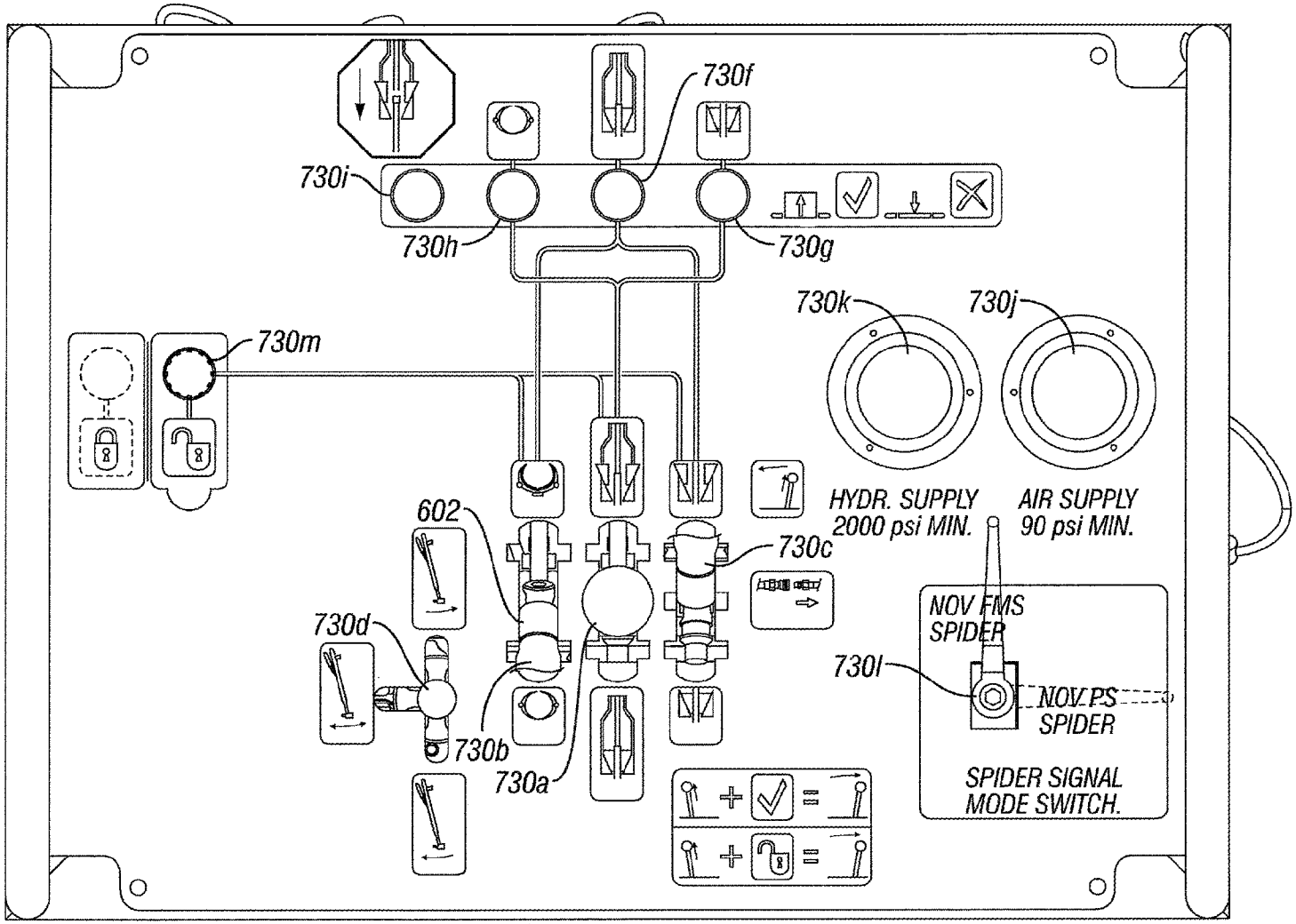
FIG. 22D is a schematic view of a control panel according to the present invention.

FIGS. 22A, 22B and 22C show schematically a system 900 according to the present invention which may be used in and with the systems described above according to the present invention.

A control valve 901 (like the valve 730*d*, FIG. 22) controls the "EXTEND" and "RETRACT" functions of the link tilt arm of a tubular running system according to the present invention or "CRT" system according to the present invention. A control valve 902 (like the valve 730*d*, FIG. 22) controls the "FLOAT" function of the link tilt arms. A control valve 903 (like the valve 730*h*, FIG. 22) controls the SJH elevator "ARMED" and "OPEN" functions. A control valve 904 (like the valve 730*f*, FIG. 22) controls the slips "ARMED" and "OPEN" functions. A control valve 905 (like the valve 730*g*, FIG. 22) controls the "SPIDER" function, "SLIPS-UP," and "SLIPS-DOWN". A control valve ("override valve") 906 (like the valve 730*m*, FIG. 22) is a manual valve that provides an "OVERRIDE" function ("OPEN") to a gate assembly 934 via valves 911 pressurizing a gate piston 907. The valves 901-906 may be manually operated.

The gate piston 907 (like the piston 622 described above) are pistons in the gate assemblies used to lock the locking sleeve and the valve spools, e.g. in a "CLOSED" position. Pistons 908 (like the piston 624 described above) are pistons in the gate assemblies used to release the locking sleeve and, thereby, the valve spools, e.g. allowing the valve spools to be moved to the "OPEN" position.

A manual operator 909 is manually operable to open a gate assembly, e.g. for repair or trouble shooting. In one aspect, the operator 909 has a connection to the opening piston 908 which is pressurized from the override valve 906 (manual operation) to open all the gates and release the locks on all functions.

A panel indicator cylinder 910 indicates that the single joint elevator is closed from a feedback signal produced at the elevator. A shuttle valve 911 provides an "OR" function between an "OVERRIDE" function (from the valve 906) and a spider slips closed function obtained from the feedback signal devices.

A pressure control valve 912 determines a pressure threshold for pressure feedback signals from CRT and SJH functions.

A 2-position 4-way sequence valve 913 provides an "AND" function for SJH and spider pressurized feedback signals into the gate assemblies 934.

A 2-position 4-way sequence valve 914 determines a pressure threshold for the spider closed pressure feedback signal and is disabled ("CLOSED") when the spider is controlled "UP".

A pressure control valve 915 limits output pressure for certain spider "SLIPS UPS" outputs. A check valve 916 provides a return path for fluid flow when spider "SLIPS DOWN" is active.

A pressure control valve 917 limits output pressure for the "LINK TILT EXTENDED" function. A check valve 918 provides a return path for fluid flow when "LINK TILT RETRACT" is active.

A pilot flow fuse 919 works in conjunction with an orifice 921 and closes when feedback pressure from the CRT/SJH function is active and is piloted "OPEN" when the SJH "OPEN" commanded is active.

A 2-position 4-way sequence valve 920 enables indicators 910 when a feedback signal "CLOSED" from a function is present and disables the indicators until the timing function from a timer cylinder 924 (described below) is complete.

The orifice 921 with a free reverse check works in conjunction with the fuse 919 to provide pressure build up when feedback fluid flow is present, enabling the fuse 919 to close and provides free fluid flow for an "OPEN" command.

An orifice 922 with a free reverse check works in conjunction with an orifice 923 and a timer cylinder 924 (like the timer cylinder 735, FIG. 22) to provide a timed "OPEN" pilot signal for the fuse 919 to provide service loop decompression when switching from a high pressure "OPEN" command to a near zero pressure "ARMED TO CLOSE" state.

A 3-way manually operated valve 925 (like the valve 730*e*, FIG. 22) provides an "OR" logic function for a CRT operator to adjust a CRT control panel so it can accept different spider closed feedback systems.

Spider outputs 926 are a variety of outlets matched regarding the specifications of multiple (e.g. three) recommended spider types (e.g., but not limited to National Oilwell Varco spiders PS 21, FMS 275, and FMS 375).

A check valve 927 prevents return fluid flow upon hydraulics shutdown. A pressure control valve 928 limits input pressure for the system. A shut-off valve 929 enables isolation of CRT and SJH man pressure input.

A filter 930 provides protection against contamination for the entire hydraulic system.

A shut-off valve 931 enables isolation of main fluid flow from an hydraulic power source for the entire system.

A manifold block 932 provides hydraulic plumbing connections and mounting for various valves, cylinders, and fittings. An assembly 933 contains valves 901-905 and provides mounting interfaces for the gate assemblies 934.

The gate assemblies 934 provide locking and unlocking of the operator handles on the assembly 933 dependent on the state of various functions of the system.

A manually operated air shut-off valve 935 enables isolation of main air flow from an air power source to the compensator assemblies of the system. Test fillings 936 provide connection points for test gauges and other test equipment (now shown).

FIGS. 27A-27F illustrate a tubular running system 1000 according to the present invention which includes an electric version 1002 of a tubular running tool which has a slips system and slips setting system 1004 like any of the systems described above The system 1000 includes a top drive 1006; a top drive electric control system 1008; an electric operator panel 1010; hydraulic and pneumatic hoses 1012; and electric cables 1014, 1016, 1018, and 1020. A link tilt mechanism 1040 has arms 1042.

Figure 27A:
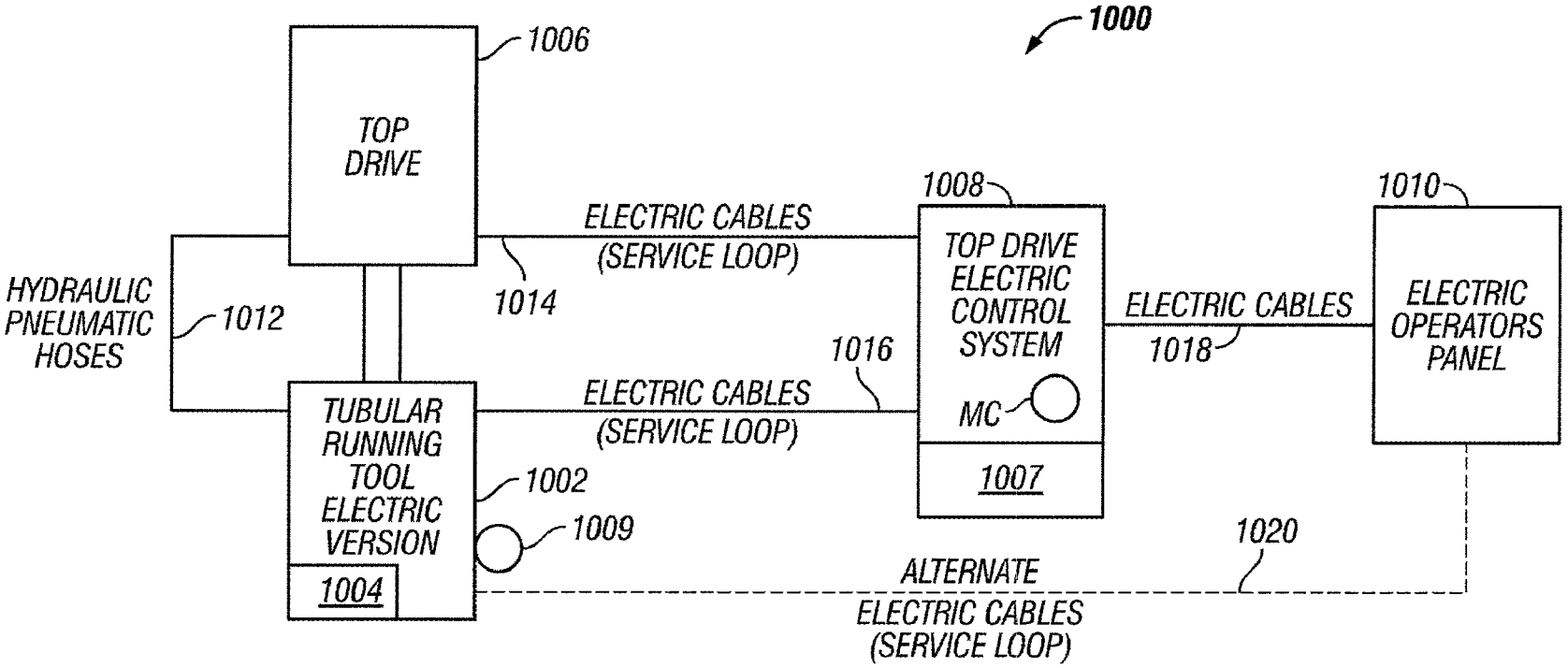
FIG. 27A is a schematic view of a system according to the present invention.
Figure 27B:
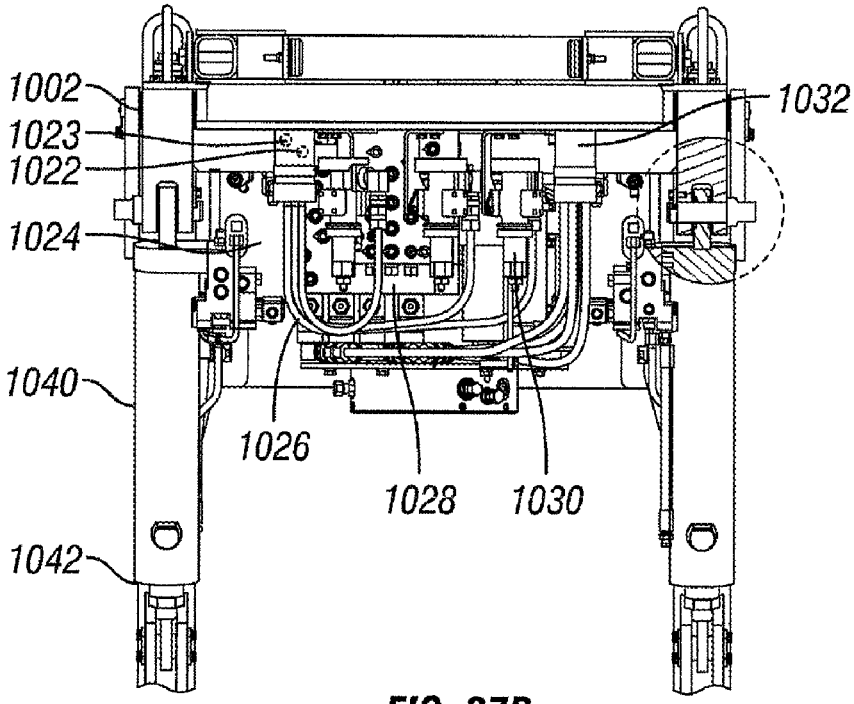
FIG. 27B is a side view of part of the system of FIG. 27A.
Figure 27C:
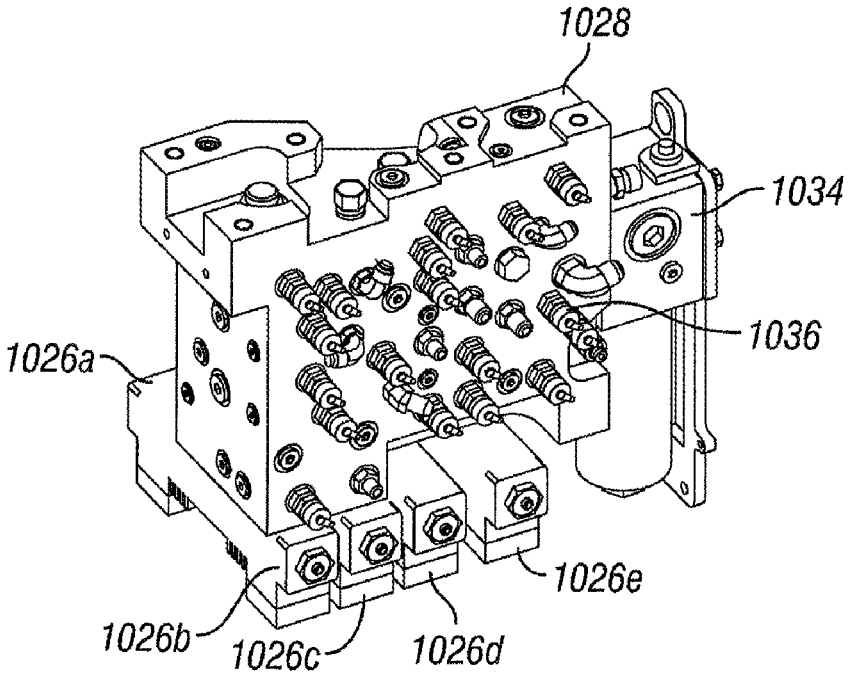
FIG. 27C is a perspective view of a manifold of the system of FIG. 27B.

As shown in FIGS. 27B and 27C, the tool 1002 has a swivel 1024 with multi-pin connectors 1022 for pressure switches; solenoids 1026; a manifold assembly 1028; pressure switches 1030 (e.g. multiple ones; e.g. in one aspect, three); multi-pin connectors 1032 for the solenoids 1026; a pressure filter 1034 (e.g. like the filter 452 described above) and test fittings and plumbing connections 1036.

The solenoids 1026 include solenoids as follows:

1026*a*: link tilt extend solenoid

1026*b*: link tilt retract solenoid

1026*c*: link tilt float solenoid

1026*d*: SJH elevator open solenoid

1026*e*: CRT slips open solenoid

Figure 27D:
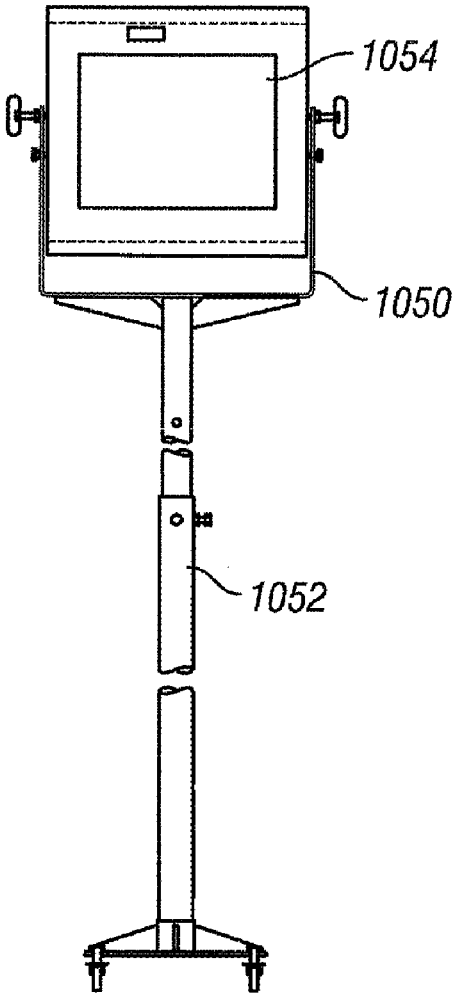
FIG. 27D is a side view of a touch screen system of the system of FIG. 27A.
Figure 27E:
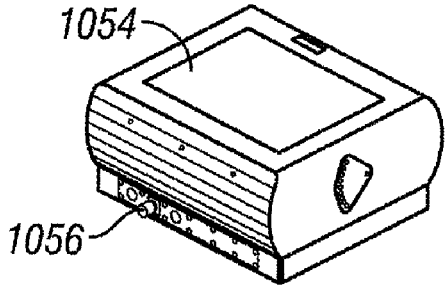
FIG. 27E is a perspective view of a touch screen apparatus of the system of FIG. 27D.
Figure 27F:
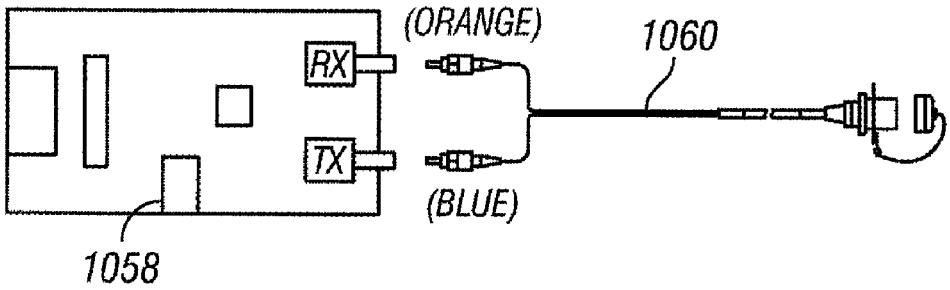
FIG. 27F shows schematically parts of the apparatus of FIG. 27E.

FIG. 27D shows a touch screen system 1050 panel useful with the system 1000 with a base 1052 and a screen system 1054 with connections 1056. FIG. 27F shows the system 1054 schematically with a network card 1058 and a cable 1060.

The electrical version of a tool 1002 functions and performs as does the mechanical versions described previously. The electrical version eliminates the hydraulic control panel (e.g. 730) of the mechanical version by placing most of the hydraulic functions of the control panel on the tool by using solenoid-actuated directional valves 1026 to replace the manual lever-controlled valves of the control panel and using electrical pressure switches 1030 to sense the feedback signals. The solenoid valves 1026 and pressure switches 1030 are mounted on the tool 1002 (see FIG. 27B), not on a separate control panel. Optionally, spider control is built into the computer controls 1007 or switch controls used to operate the CRT if desired. Electrical cables 1014, 1016 and/or 1018 in the form of a service loop are used to transfer the solenoid power and pressure switch signals to and from the tool 1002. The cables are connected to the tool 1002 using multi-pin connectors 1022, 1032 that are, in one aspect, rated for use in the hazardous environment of a drilling rig.

The operator interface 1010 includes a control box of switches and indicator lights or a computer interfaced touch screen panel (e.g. 1050). Additionally, the operator interface can be integrated into a top drive control system 1008 or a whole rig control system by incorporating tool control software into a top drive computer (e.g. 1007) or supplying a separate computer 1009 and networking it with a top drive computer. The control functions and status indicators are included in the top drive controls 1008 or built into computer screen(s) of the top drive control system.

The solenoids 1026 are mounted on the tool (e.g. by changing out the inlet manifold assembly 316*b*, FIG. 15B) with a new manifold assembly 1028. The manifold assembly 1028 duplicates the hydraulic function selection circuits from a manual control panel described above. The pressure switches are mounted on the link tilt frame 1040 behind the manifold 1028 and are plumbed to feedback signal lines and the switches close or open depending upon the pressure sensed. The switch opening or closing is used to turn on or off indicator lights or computer inputs to provide feedback signals.

The electrical control of the solenoids and the electrical feedback signals can be directly connected to/from switches and indicator lights in a control panel 1010 to provide direct control of the functions, or they can be connected to a computer (1007 and/or 1009) and controlled through software logic based on inputs from the operator. The operator inputs can be from hardwired switches to the computer inputs or from a touch screen panel. The feedback signals can be connected the same way, by hardwiring directly to indicator lights or connected to computer inputs for output controlled by computer software.

The "gate" or interlock functions are provided by computer software controlling the power signals to the solenoids 1026. For direct wired applications, where control switches in a panel directly control the solenoids 1026, the gate functions are provided by hardwiring the switches in a pattern that provides electrical power to a given switch only when other switches are in a specific state.

All electrical components may be rated for hazardous area use in a drilling rig environment. Normally, the hazardous area requirements demand specific electrical components be used that are very large and bulky. To conserve space and reduce components, an electrical assembly utilizing multi-pin connectors to combine multiple cables into a single connection point may be used. Using the hazardous area requirement of "potting" the electrical cables into a gland to seal them from the outside environment, multiple cables can be routed to the multi-pin connectors and all potted together to create a single termination point. One method to accomplish this involves using a single multicore cable from the multi-pin connector going to a junction box from which the multiple individual cables are then routed to the individual solenoids or pressure switches. This can eliminate the junction boxes and save space, weight, and cost.

Certain solenoid valves control the following functions:

1026*a*, 1026*b*: Link tilt extend and retract (or a double solenoid valve)

1026*c*: Link tilt float

1026*d*: SJH elevator open (energizing solenoid selects "open" and de-energizing solenoid selects "armed to close")

1026*e*: CRT slips open (energizing solenoid selects "open" and de-energizing solenoid selects "armed to close")

Pressure switches 1023 provide the following feedback signals:

"Stop Lowering"

CRT slips closed

SJH elevator closed.

The multi-pin plug connectors 1022, 1032 connect two electrical service loops:

solenoid power cable pressure switch signal cable

It is within the scope of the present invention for the electric operator panel 1010 to take various forms such as: a switch box with operating switches and indicating lights to a computer controlled touch screen panel with graphics, switch functions and indicators; an extension of an existing top drive driller control console incorporating on/off switches for each solenoid and an indicator light for each pressure switch; an individual tool specific control console with on/off switches for each solenoid and an indicator light for each pressure switch; a computer controlled touch screen panel 1054 displaying graphics to indicate solenoid status, operator selections, indicator status, virtual buttons or switches to operate solenoids, warning messages, etc.; a combination of physical switches in a console for solenoid control and computer screen for indicator status, messages, warning enunciators, etc.; an individually computer controlled system; and it can be interfaced with an existing top drive computer control system and use the top drive computer as a basis of control.

It is within the scope of the present invention for the top drive electric control system 1008 to be: a computer or Programmable Logic Controller ("PLC") to control Input/Output functions on the top drive; which can contain control hardware and software to control speed and torque of the top drive motor and/or can contain wiring termination points for service loop cables to the top drive. These can be a mounting point for a separate stand alone tool-specific computer.

The system 1008, in one aspect, provides an interface point on a rig for the tool cables, which are run in parallel with top drive cables and service loops; and/or the system 1008 can provide an interface point to the top drive computer when this unit is used as the basis of control of the tool.

In one aspect, tool inputs/outputs are programmed into the top drive computer and the electric operators panel 1010 interfaces with this computer.

The system 1008 can provide an interface point to the top drive motor controller MC for control of motor speed and torque (for controlling tubular connections makeup and breakout) and for reading, displaying, and recording top drive motor rpm and torque to obtain tubular connection rpm, number of turns, and torque.

The electric cables ("service loop") are bundles of various cables required to operate the tool electrical functions and, in one aspect, include two cable bundles, one for solenoid power and one for pressure switch signals which run in parallel with the top drive service loop. These cables include wires to pass power to each solenoid and to provide signals from each pressure switch. Two cable bundles are used to prevent interference between the power wires and the signal wires. Plug connectors are used to provide quick rig-up and rig-down in a drilling rig environment. The service loops connect to the top drive control system 1008. An alternate service loop 1020 is provided for direct connection to individual switches and indicators in an individual tool operators panel.

The electric cables 1018 connect the top drive computer and I/O and the operators panel 1010 and carry power and signals between the operators panel 1010 and the top drive control system computer and I/O to provide switch and indicator control.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventor may rely on the Doctrine of Equivalents to determine and assess the scope of the invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements. requires that there be one and only one of the elements.

What is claimed is:

1. A tubular running system comprising a torque frame having a body with a top part with a top opening, a plurality of spaced-apart side members, a bottom part with a bottom opening, and the side members connected at a top end thereof to the top part and a bottom end thereof to the bottom part, a main shaft extending through the top opening, the main shaft rotatable by rotation apparatus, slip setting apparatus connected to the torque frame, the slip setting apparatus including a levelling beam and a plurality of slip assemblies, the levelling beam movable within the torque frame, each of the plurality of slip assemblies connected independently and pivotably to the levelling beam, and the slip setting assembly including movement apparatus connected to the levelling beam for moving the levelling beam to move the slip assemblies in unison with respect to a tubular projecting through the bottom opening of the bottom part.

2. The tubular running system of claim 1 wherein the levelling beam is visible from outside the torque frame.

3. The tubular running system of claim 1 further comprising each slip assembly connected to the levelling beam with a link, and each link having a top end and a bottom end, each top end pivotably connected to the levelling beam and each bottom end pivotably connected to a corresponding slip assembly.

4. The tubular running system of claim 3 wherein no radial forces act on the slip assemblies as they contact the tubular projecting into the torque frame.

5. The tubular running system of claim 1 further comprising the levelling beam having a bottom, a plurality of projections spaced-apart around and projecting from the bottom of the levelling beam, the plurality of projections including a number of projections equal to a number of slip assemblies with one projection corresponding to and located above each of the slip assemblies, and the movement apparatus for moving the levelling beam downward so that each projection contacts a corresponding slip assembly and forces the slip assembly down to contact the tubular.

6. The tubular running system of claim 5 wherein the movement apparatus is for moving the levelling beam with the projections against the slip assemblies so that all slip assemblies are movable evenly and simultaneously axially downward.

7. The tubular running system of claim 5 further comprising booster apparatus connected to the slip setting apparatus for providing boosting power fluid to the movement apparatus to enhance gripping engagement of the slip assemblies with the tubular.

8. The tubular running system of claim 1 further comprising actuation apparatus for controlling flow of power fluid to the movement apparatus, the actuation apparatus activatable by contact with the tubular projecting into the torque frame so that upon said contact the actuation apparatus permits power fluid to flow to the movement apparatus to move the slip assemblies to engage the tubular.

9. The tubular running system of claim 1 further comprising the main shaft having a fluid flow channel therethrough, a fill-and-circulation tool connected to the main shaft and having a fill-and-circulate valve apparatus therein for selectively controlling fluid flow from the main shaft through the tubular running system into the tubular, and a portion of the fill-and-circulation tool positionable within the tubular.

10. The tubular running system of claim 9 further comprising the fill-and-circulation tool having a mandrel connected to the main shaft, the mandrel with a flow channel therethrough, a catch plate assembly above the slip setting apparatus and around the mandrel, and the catch plate assembly contactable by the tubular projecting into the torque frame to open the fill-and-circulate valve to allow fluid flow from the main shaft, through the mandrel, into the tubular.

11. The tubular running system of claim 1 further comprising the slip setting apparatus including a bowl connected to the torque frame and forming the bottom part thereof, the bowl having a channel therethrough for accommodating the slip assemblies and through which the tubular is movable, the bowl having a top, and each slip assembly having a top slip projection restable on the top of the bowl prior to moving to engage the tubular.

12. The tubular running system of claim 11 wherein the bowl has a top bowl projection projecting into the bowl, the slip assemblies each have a slip recess, and the top bowl projection receivable within the slip recesses of the slip assemblies while the slip assemblies rest on the top of the bowl.

13. The tubular running system of claim 12 wherein the bowl has a bowl recess, and each slip assembly has a lower slip projection, each lower slip projection receivable within the bowl recess prior to movement of the slip assemblies to engage the tubular.

14. The tubular running system of claim 13 wherein the bowl has a lower shoulder with a top shoulder surface defining a bottom of the bowl recess, the lower shoulder having a side surface, and each slip assembly's lower slip projection having a lowermost part restable on the top shoulder surface prior to movement of the slip assemblies to engage the tubular.

15. The tubular running system of claim 14 wherein the top bowl projection having a side surface, the slip assemblies are movable down so that the top slip projections of the slip assemblies abut the side surface of the top bowl projection, and the lower slip projections abut the side surface of the lower shoulder of the bowl.

16. The tubular running system of claim 11 further comprising the bowl having a receiver at a bottom thereof with a receiver opening for receiving a tubular and for guiding a tubular into the bowl.

17. The tubular running system of claim 1 further comprising a top drive system connected to the main shaft for rotating the torque frame and a tubular engaged by the slip assemblies.

18. The tubular running system of claim 1 further comprising a swivel assembly above the torque frame and for transferring fluid to the movement apparatus, the swivel assembly including a non-rotating part, a torque backup assembly connected to the non-rotating part, the torque backup assembly adjustably connectible to a rig in which the tubular running system is used.

19. The tubular running system of claim 1 wherein the torque frame transfers torque from a drive system to a tubular engaged by the slip assemblies, and the torque frame has load transmission structure to transmit hoisting loads to the main shaft.

20. The tubular running system of claim 1 further comprising a swivel assembly above the torque frame, a link tilt assembly pivotably connected to the swivel assembly, and a single joint elevator connected to the link tilt assembly.

21. The tubular running system of claim 1 further comprising compensator apparatus connected to the torque frame for reducing thread damage to a tubular within the torque frame.

22. The tubular running system of claim 1 further comprising a slip bowl for housing the slip assemblies, torque frame bayonet mount structure, and slip bowl bayonet mount structure for releasably securing the slip bowl to the torque frame bayonet mount structure.

23. The tubular running system of claim 1 further comprising a drive system for rotating the main shaft, the drive system being one of top drive system, rotary drive system, and power swivel system.

24. The tubular running system of claim 1 further comprising a tubular handling system connected to the running tool system, the tubular handling system having two arms comprising two movable spaced-apart extensible arms extendable in length, anti-rotation apparatus for selectively preventing the tubular handling system from rotating with the torque frame, an elevator pivotably connected to the arms for releasably engaging a tubular to be moved, a tilt system connected to the elevator and to a first arm of the two arms, for selective tilting of the elevator with respect to the arms, and a control system in communication with the tilt system for controlling the elevator.

25. The tubular running system of claim 24 further comprising the control system including arm hydraulic circuitry and arm hydraulic apparatus for selectively limiting loads applied to the two arms and for preventing overload of the tilt system.

26. The tubular running system of claim 1 further comprising a swivel assembly above the torque frame, a tubular handling system connected to the swivel assembly, the tubular handling system having two arms comprising two movable spaced-apart extensible arms extendable in length, each arm of the two arms comprising a first part with a portion thereof in a second part so that the two parts can telescope with respect to each other, and power apparatus within each arm for moving the first part with respect to the second part.

27. The tubular running system of claim 1 further comprising a control system for controlling functions of the tubular running system.

28. The tubular running system of claim 27 further comprising feedback signal apparatus for providing feedback signals to the control system indicating status of the slip assemblies.

29. The tubular running system of claim 28 further comprising the status including one of slip assemblies set against a tubular, slip assemblies not set against a tubular, and slip assemblies sufficiently lowered for setting against a tubular.

30. The tubular running system of claim 27 further comprising the control system being remotely operable.

31. The tubular running system of claim 27 further comprising decompression hydraulic apparatus for decompressing hydraulic fluid lines of the tubular running system to reduce or eliminate signal transfer delay.

32. A method for engaging a tubular, the method comprising moving part of a tubular into a torque frame of a tubular running system, the tubular running system comprising the torque frame, the torque frame having a body with a top part with a top opening, a plurality of spaced-apart side members, a bottom part with a bottom opening, and the side members connected at a top end thereof to the top part and a bottom end thereof to the bottom part, a main shaft extending through the top opening, the main shaft rotatable by rotation apparatus, slip setting apparatus connected to the torque frame, the slip setting apparatus including a levelling beam and a plurality of slip assemblies, the levelling beam movable within the torque frame, each of the plurality of slip assemblies connected independently and pivotably to the levelling beam, and the slip setting assembly including movement apparatus connected to the levelling beam for moving the levelling beam to move the slip assemblies in unison with respect to a tubular projecting through the bottom opening of the bottom part, and moving the slip assemblies in unison with the movement apparatus to engage the tubular within the torque frame.

33. A slip system for engaging a tubular for wellbore operations, the slip system comprising slip setting apparatus connected to a torque frame, the slip setting apparatus including a levelling beam and a plurality of slip assemblies, the levelling beam movable within the torque frame, each of the plurality of slip assemblies connected independently and pivotably to the levelling beam, and the slip setting assembly including movement apparatus connected to the levelling beam for moving the levelling beam to move the slip assemblies in unison with respect to a tubular projecting through a bottom opening of a bottom part of the torgue frame.

* * * * *